US008264915B2

(12) United States Patent
Abe et al.

(10) Patent No.: US 8,264,915 B2
(45) Date of Patent: Sep. 11, 2012

(54) TIME INFORMATION-ACQUIRING APPARATUS AND RADIO WAVE TIMEPIECE

(75) Inventors: Hideo Abe, Tokorozawa (JP); Keiichi Nomura, Uenohara (JP)

(73) Assignee: Casio Computer Co., Ltd, Tokyo (JP)

( * ) Notice: Subject to any disclaimer, the term of this patent is extended or adjusted under 35 U.S.C. 154(b) by 222 days.

(21) Appl. No.: 12/888,678

(22) Filed: Sep. 23, 2010

(65) Prior Publication Data

US 2011/0075522 A1 Mar. 31, 2011

(30) Foreign Application Priority Data

Sep. 25, 2009 (JP) ..... 2009-220124
Oct. 23, 2009 (JP) ..... 2009-244095
Oct. 29, 2009 (JP) ..... 2009-248786

(51) Int. Cl.
*G04C 11/02* (2006.01)

(52) U.S. Cl. ..... 368/47

(58) Field of Classification Search ..... 368/47, 368/46, 52, 66; 375/149, 354, 352; 386/66; 709/248; 342/357.02, 357.15
See application file for complete search history.

(56) References Cited

U.S. PATENT DOCUMENTS 7,460,012 B2 * 12/2008 Ii ..... 340/539.1
7,848,180 B2 * 12/2010 Someya et al. ..... 368/47
2005/0195690 A1 9/2005 Kondo
2012/0082008 A1 * 4/2012 Eliezer et al. ..... 368/47

FOREIGN PATENT DOCUMENTS

| | | |
|---|---|---|
| EP | 2 146 257 | 1/2010 |
| EP | 2 219 087 | 8/2010 |
| JP | 2005249632 | 9/2005 |
| WO | 01/75470 | 10/2001 |

OTHER PUBLICATIONS

Extended European Search Report for European Application No. 10178780.2 mailed on Sep. 23, 2011.

* cited by examiner

*Primary Examiner* — Edwin A. Leon
(74) *Attorney, Agent, or Firm* — Turocy & Watson, LLP

(57) ABSTRACT

A time information-acquiring apparatus comprises an input waveform generator which generates an input waveform, a predicted waveform generator which generates plural phase-shifted predicted waveforms, a correlation calculator which calculates a positive correlation based on a first value of the input waveform and a first value of the predicted waveform or a second value of the input waveform and a second value of the predicted waveform, and calculates a negative correlation based on the first value of the input waveform and the second value of the predicted waveform or the second value of the input waveform and the first value of the predicted waveform, a comparator which compares the correlation values to detect an optimal value, and a controller which detects a head position of a second based on a predicted waveform related to the optimal value.

27 Claims, 43 Drawing Sheets

(0 : JJY)

(1 : JJY)

(P : JJY)

(0 : WWVB)

(1 : WWVB)

(P : WWVB)

(A=0, B=0 : MSF)

(A=0, B=1 : MSF)

(A=1, B=0 : MSF)

(A=1, B=1 : MSF)

(M : MSF)

FIRST

SECOND

THIRD

FOURTH

FIFTH

FIRST

SECOND

THIRD

FOURTH

FIFTH

FIG.23A

1700

| NUMBER OF PROCESSES | TABLE COUNT VALUE |
|---|---|
| 1 | 5 |
| 2 | 6 |
| 3 | 7 |
| 4 | 9 |
| 5 | 11 |
| 6 | 13 |
| ⋮ | ⋮ |

FIG.23B

1710

| NUMBER OF PROCESSES | MAXIMUM VALUE |
|---|---|
| 1 | - |
| 2 | 2 |
| 3 | 2 |
| 4 | 4 |
| 5 | 6 |
| 6 | 6 |
| ⋮ | ⋮ |

FIRST

SECOND

THIRD

FOURTH

FIFTH

FIRST

SECOND

THIRD

FOURTH

FIFTH

TIME INFORMATION-ACQUIRING APPARATUS AND RADIO WAVE TIMEPIECE

CROSS-REFERENCE TO RELATED APPLICATIONS

This application is based upon and claims the benefit of priority from prior Japanese Patent Applications No. 2009-220124, filed Sep. 25, 2009; No. 2009-244095, filed Oct. 23, 2009; and No. 2009-248786, filed Oct. 29, 2009, the entire contents of all of which are incorporated herein by reference.

BACKGROUND OF THE INVENTION

1. Field of the Invention

The present invention relates to a time information-acquiring apparatus that receives a standard time radio wave and acquires the time information thereof, and a radio wave timepiece comprising the time information-acquiring apparatus.

2. Description of the Related Art

In recent years, for example, in Japan, Germany, England, and Switzerland, transmitting stations transmit a standard time radio wave of a low frequency. For example, transmitting stations in Fukushima and Saga prefectures in Japan transmit amplitude-modulated standard time radio waves of 40 kHz and 60 kHz. The standard time radio wave includes a code string forming a time code indicating the date and time and is transmitted every 60 seconds. That is, the period of the time code is 60 seconds.

A clock (radio wave timepiece) that receives the standard time radio wave, extracts the time code from the received standard time radio wave, and corrects the time has been put to practical use. A receiver of the radio wave timepiece includes a band-pass filter (BPF) that receives the standard time radio wave through an antenna and extracts only the standard time radio wave signal, a demodulator that demodulates an amplitude-modulated standard time radio wave signal using, for example, envelope detection, and a processor that reads a time code included in the signal demodulated by the demodulator.

The processor in the prior art performs synchronization with the rising edge of the demodulated signal and then performs binarization with a predetermined sampling period to acquire time code output (TCO) data having a unit time length (one second), which is a binary bit string. The processor measures the pulse width (that is, the time of a bit 1 or the time of a bit 0) of the TCO data, determines whether each code is a binary 1 code, a binary 0 code, or a position marker code P based on the measured pulse width, and acquires time information based on the determined code string.

The processing circuit according to the prior art performs processes, such as a second synchronization process, a minute synchronization process, a process of acquiring a code, and a process of determining matching, during the period from the start of the reception of the standard time radio wave to the acquisition of the time information. When each of the processes is not appropriately terminated, the processing circuit needs to start the processes from the beginning. Therefore, in some cases, the processing circuit needs to start the processes from the beginning several times due to the influence of noise included in the signal. Under such instances, it takes a very long time to acquire time information.

The second synchronization detects the rising edge of a code at an interval of one second among the codes indicated by the TCO data. It is possible to detect a portion in which a position marker P0 arranged at the end of a frame and a marker M arranged at the head of the frame are continuously arranged by repeatedly performing the second synchronization. The portion in which the markers are continuously arranged appears at an interval of one minute (60 seconds). Within the TCO data, the marker M shows the position of the head frame data. The detection of the position of the marker is referred to as minute synchronization. The head of the frame is recognized by the minute synchronization. Therefore, after code acquisition starts to acquire one frame of data, a parity bit is checked to determine whether the data has an improper value (the date and time have improper values) (matching determination). For example, since the minute synchronization is for detecting the head of the frame, 60 seconds are required in some cases. Of course, multiples of 60 seconds are required to detect the heads of several frames.

In Jpn. Pat. Appln. KOKAI Publication No. 2005-249632 (corresponding to US 2005/0195690 A1), the demodulated signal is binarized at a predetermined sampling interval (50 ms) to obtain TCO data and a list of data groups (20 samples) in the form of binary bit strings is obtained every one second.

The apparatus disclosed in Jpn. Pat. Appln. KOKAI Publication No. 2005-249632 compares the bit string with each of the templates of a binary bit string indicating a position marker code P, a binary bit string indicating a code 1, and a binary bit string indicating a code 0, calculates a correlation therebetween, and determines to which of the codes P, 1, and 0 the bit string corresponds, based on the correlation.

In the technique disclosed in Jpn. Pat. Appln. KOKAI Publication No. 2005-249632, the TCO data, which is a binary bit string, is acquired and matched with the template. When the field intensity is weak or a large amount of noise is mixed with the demodulated signal, many errors are included in the acquired TCO data. Therefore, it is necessary to provide a filter which removes noise from the demodulated signal or to finely adjust the threshold of an AD converter, in order to improve the quality of the TCO data.

The process of determining to which of the code 0, the code 1, and the position marker code P data with a unit time length (one second) corresponds is insufficient to detect the head of the second or the head of the minute, and it is necessary to perform the determining process again based on the determination result. When the head of the second or the head of the minute is not appropriately detected, it is necessary to perform the process again.

BRIEF SUMMARY OF THE INVENTION

An object of the invention is to provide a time information-acquiring apparatus capable of accurately acquiring a code included in a standard time radio wave to obtain the current time while reducing the amount of calculation and the calculation time, without being affected by the field intensity or the noise of signals and further provide a radio wave timepiece including the time information-acquiring apparatus.

According to one embodiment of the present invention, a time information-acquiring apparatus comprises:

a receiver configured to receive a standard time radio wave including a time code;

an input waveform generator configured to sample a signal output from the receiver and including the time code with a predetermined sampling period and to generate input waveform data with one or more unit time lengths, the input waveform data at each sampling point having one of a first value indicating a low level and a second value indicating a high level;

a predicted waveform generator configured to generate plural predicted waveform data, each of the plural predicted waveform data having the one or more unit time lengths, each of the plural predicted waveform data at each sampling point having one of the first value and the second value, and a phase of each of the plural predicted waveform data being shifted by a predetermined number of samples;

a correlation calculator configured to arithmetically operate the input waveform data at a sampling point and the plural predicted waveform data at a corresponding sampling point and to calculate correlation values between the input waveform data and the plural predicted waveform data, wherein the correlation calculator is configured to calculate a first correlation value indicating a positive correlation by arithmetically operating the first value of the input waveform data and the first value of the predicted waveform data or arithmetically operate the second value of the input waveform data and the second value of the predicted waveform data, and to calculate a second correlation value indicating a negative correlation by arithmetically operating the first value of the input waveform data and the second value of the predicted waveform data or arithmetically operate the second value of the input waveform data and the first value of the predicted waveform data;

a comparator configured to compare the correlation values calculated by the correlation calculator and to detect an optimal value of the correlation values; and a controller configured to detect a head position of a second in the time code based on predicted waveform data related to the optimal value.

Additional objects and advantages of the invention will be set forth in the description which follows, and in part will be obvious from the description, or may be learned by practice of the invention.

The objects and advantages of the invention may be realized and obtained by means of the instrumentalities and combinations particularly pointed out hereinafter.

BRIEF DESCRIPTION OF THE SEVERAL VIEWS OF THE DRAWINGS

The accompanying drawings, which are incorporated in and constitute a part of the detection, illustrate embodiments of the invention, and together with the general description given above and the detailed description of the embodiments given below, serve to explain the principles of the invention.

FIG. 23A is a diagram illustrating an example of the structure of a count value interruption condition table according to the second embodiment;

FIG. 23B is a diagram illustrating an example of the structure of a maximum value interruption table according to the second embodiment;

DETAILED DESCRIPTION OF THE INVENTION

Hereinafter, a first embodiment of the invention will be described with reference to the accompanying drawings. According to the first embodiment, a time information-acquiring apparatus is provided in a radio wave timepiece that receives a standard time radio wave in a long wavelength band, detects the signal thereof, extracts a code string indicating a time code in the signal, and corrects time based on the code string.

In recent years, for example, in Japan, Germany, England, and Switzerland, a standard time radio wave is transmitted from a predetermined transmitting station. For example, transmitting stations in Fukushima and Saga prefectures in Japan transmit amplitude-modulated standard time radio waves of 40 kHz and 60 kHz, respectively. The standard time radio wave includes a code string forming a time code indicating the date and time and is transmitted with a period of 60 seconds. Since one code has a unit time length (one second), one period may include 60 codes.

Figure 1:
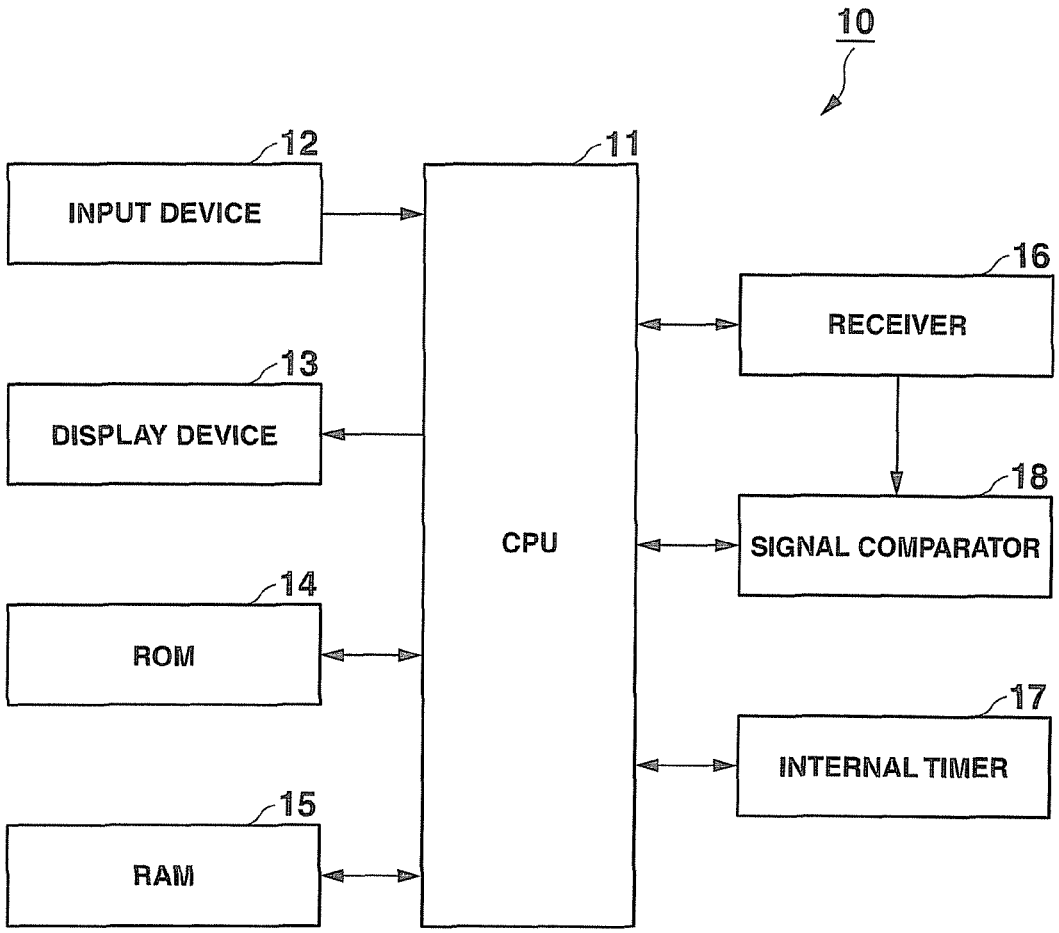
FIG. 1 is a block diagram illustrating the structure of a radio wave timepiece according to a first embodiment of the invention.

FIG. 1 is a block diagram illustrating the structure of a radio wave timepiece according to the first embodiment. As shown in FIG. 1, a radio wave timepiece 10 includes a CPU 11, an input device 12, a display device 13, a ROM 14, a RAM 15, a receiver 16, an internal timer 17, and a signal comparator 18.

The CPU 11 reads a program stored in the ROM 14 at predetermined timing or in response to an operation signal input from the input device 12, expands the read program in the RAM 15, and transmits instructions or data to each unit or device of the radio wave timepiece 10 based on the program. Specifically, for example, the CPU 11 performs a process of controlling the receiver 16 to receive a standard time radio wave at predetermined time intervals, specifying a code string included in the standard time radio wave signal from digital data which is based on the signal obtained from the receiver 16, and a process of correcting the current time measured by the internal timer 17 based on the code string, or a process of transmitting the current time measured by the internal timer 17 to the display device 13. In the first embodiment, predicted waveform data of a standard time radio wave signal with one or more unit time lengths and a predetermined format is generated, and the predicted waveform data is compared with input waveform data which is obtained from the standard time radio wave received by the receiver to detect the head of the second.

In the first embodiment, the head of the minute and the values of various kinds of codes including hour, minute, and date codes, are specified by the same method as that in the prior art. When the date and time are specified, it is possible to calculate an error in the internal timer 17 and correct the current time measured by the internal timer 17.

The input device 12 includes switches configured to instruct the radio wave timepiece 10 to perform various kinds of functions. When a switch is operated, a corresponding operation signal is output to the CPU 11. The display device 13 includes a liquid crystal panel, an analog pointer mechanism controlled by the CPU 11, and a dial and displays the current time measured by the internal timer 17. The ROM 14 stores, for example, a system program or an application program configured to operate the radio wave timepiece 10 and to implement a predetermined function. The programs configured to implement the predetermined function also include a program configured to control the signal comparator 18 in order to perform a process of detecting a second pulse position, which will be described below. The RAM 15 is used as a work area of the CPU 11 and temporarily stores, for example, the program or data read from the ROM 14 and data processed by the CPU 11.

The receiver 16 includes, for example, an antenna circuit or a detector. The receiver 16 obtains a demodulated signal from the standard time radio wave received by the antenna circuit and outputs the signal to the signal comparator 18. The internal timer 17 includes an oscillator. The internal timer 17 counts clock signals output from the oscillator to measure the current time and outputs data of the current time to the CPU 11.

Figure 2:
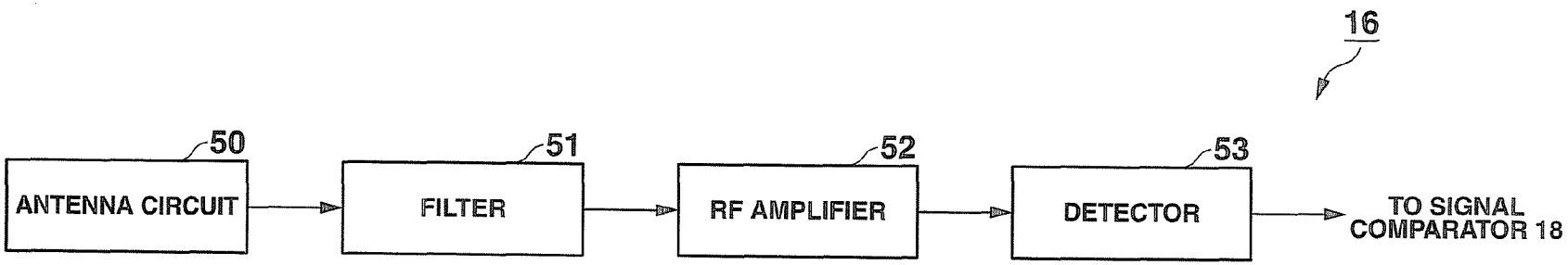
FIG. 2 is a block diagram illustrating an example of the structure of a receiver according to the first embodiment.

FIG. 2 is a block diagram illustrating an example of the structure of the receiver according to the first embodiment. As shown in FIG. 2, the receiver 16 comprises an antenna circuit 50 that receives a standard time radio wave, a filter 51 that removes a noise from the signal of the standard time radio wave (standard time radio wave signal) received by the antenna circuit 50, an RF amplifier 52 that amplifies a high frequency signal, which is the output of the filter 51, and a detector 53 that detects a signal output from the RF amplifier 52 and demodulates the standard time radio wave signal. The signal demodulated by the detector 53 is output to the signal comparator 18.

Figure 3:
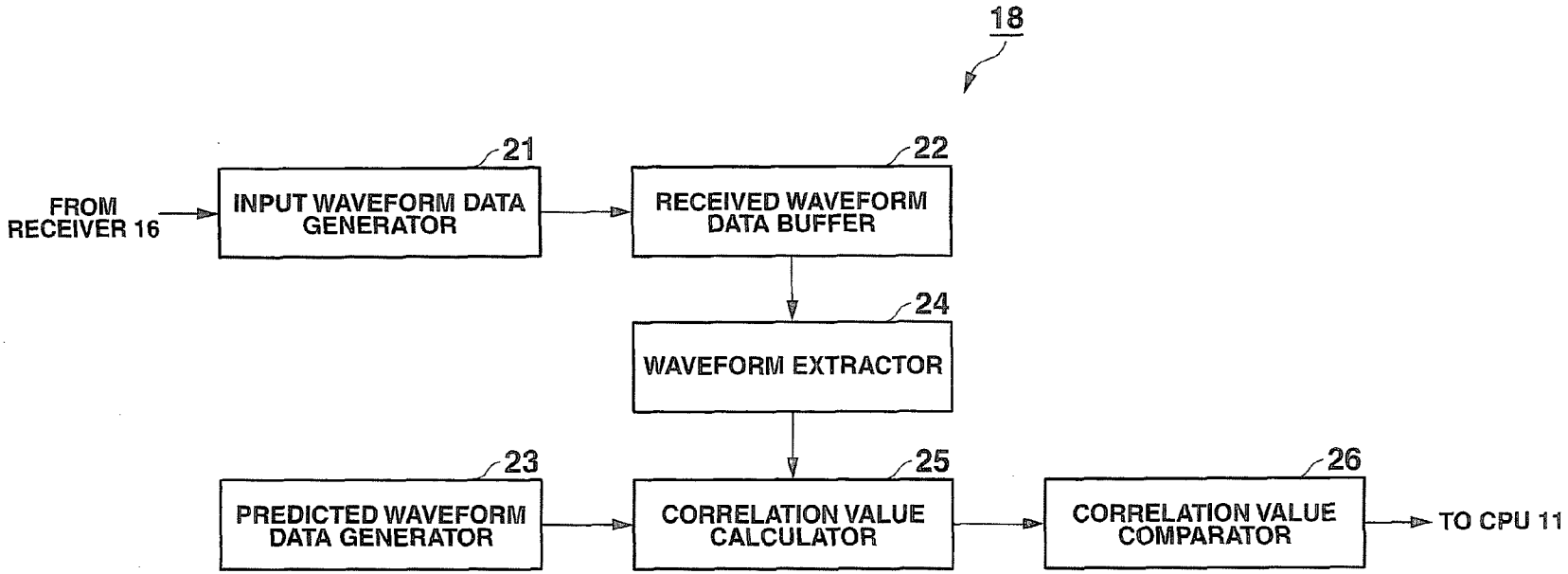
FIG. 3 is a block diagram illustrating the structure of a signal comparator according to the first embodiment.

FIG. 3 is a block diagram illustrating the structure of the signal comparator according to the first embodiment. As shown in FIG. 3, the signal comparator 18 includes an input waveform data generator 21, a received waveform data buffer 22, a predicted waveform data generator 23, a waveform extractor 24, a correlation value calculator 25, and a correlation value comparator 26.

The input waveform data generator 21 converts the signal output from the receiver 16 into digital data having any one of plural values at predetermined sampling intervals and outputs the converted digital data. For example, the sampling interval is 50 ms and data of 20 samples per second may be acquired. The value of the digital data according to the first embodiment will be described below. The received waveform data buffer 22 sequentially stores data generated by the input waveform data generator 21. The received waveform data buffer 22 may store data of plural unit time lengths (for example, 10 unit time lengths (10 seconds)) when the unit time length is one second. When new data is stored, the old data is erased in chronological order.

The predicted waveform data generator 23 generates predicted waveform data, with a predetermined time length, which is a comparison target and used in the following processes. For example, the predicted waveform data is used in each process, which will be described below. The predicted waveform data generated by the predicted waveform data generator 23 will be described in detail in a process of detecting the second pulse position. The waveform extractor 24 extracts input waveform data from the received waveform data buffer 22 with the same time length as that of the predicted waveform data.

The correlation value calculator 25 calculates a correlation value between each of a plurality of predicted waveform data and the input waveform data. In this embodiment, covariance is used for correlation, which will be described below in detail. The correlation value comparator 26 compares the correlation values (covariance values) calculated by the correlation value calculator 25 to detect the optimal value thereof.

Figure 4:
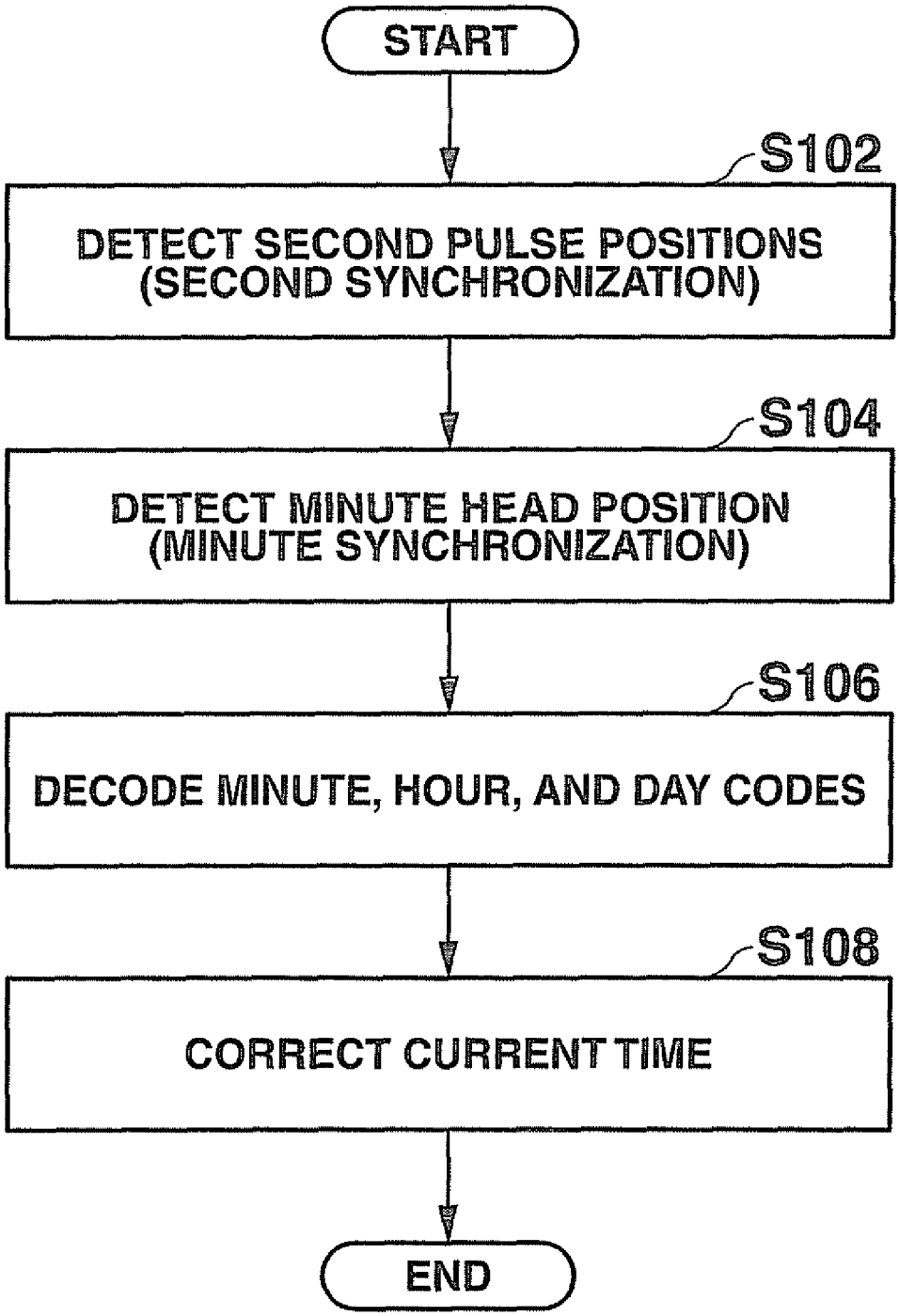
FIG. 4 is a flowchart schematically illustrating a process performed in the radio wave timepiece according to the first embodiment.
Figure 5A:
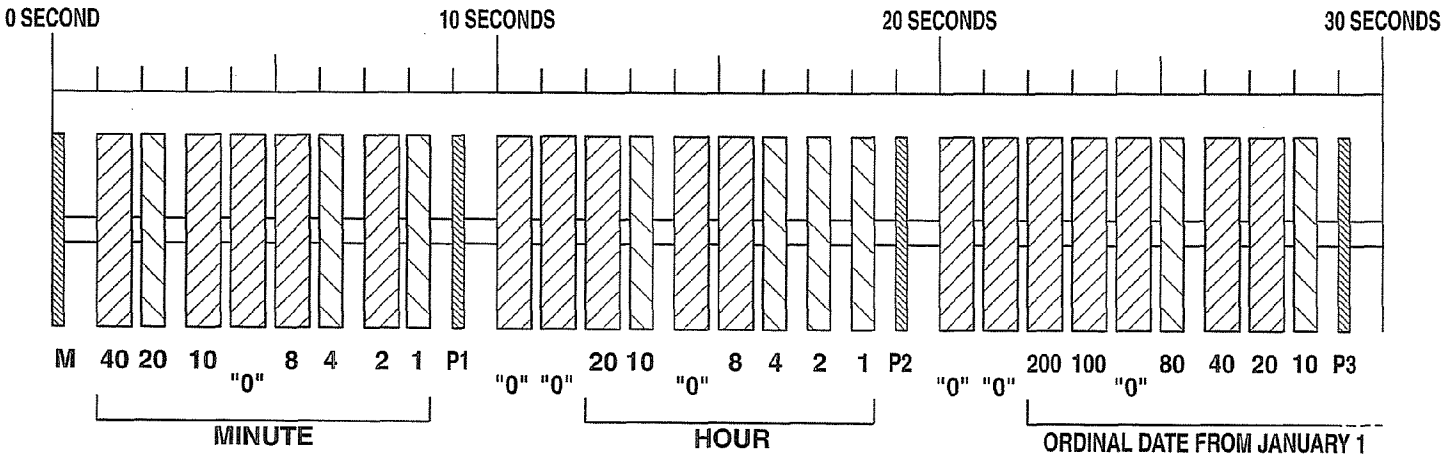
FIG. 5A is a diagram illustrating the structure of one standard time radio wave based on a JJY standard during the period from 0 to 30 seconds.
Figure 5B:
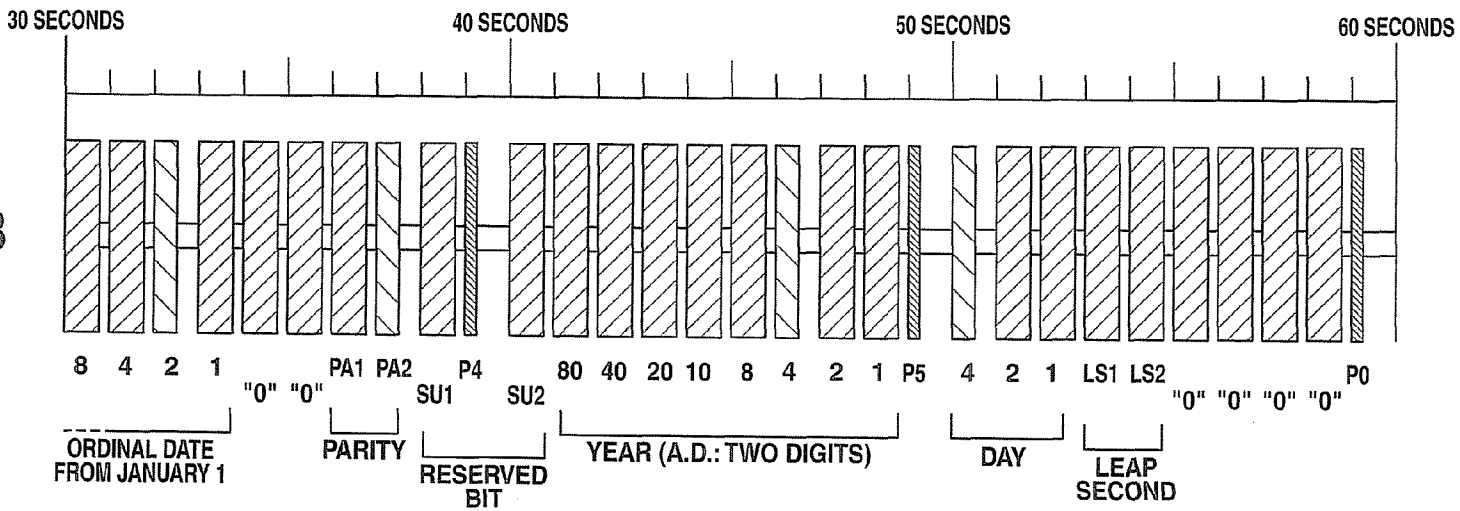
FIG. 5B is a diagram illustrating the structure of one standard time radio wave based on the JJY standard during the period from 30 to 60 seconds.

FIG. 4 is a flowchart schematically illustrating a process performed in the radio wave timepiece according to the first embodiment. The process shown in FIG. 4 is mainly performed by the CPU 11 and the signal comparator 18 based on instructions from the CPU 11. As shown in FIG. 4, the CPU 11 and the signal comparator 18 (hereinafter, referred to as "CPU 11 and the like" for convenience of explanation) detect the second pulse position (Step S102). The process of detecting the second pulse position is also referred to as second synchronization. FIGS. 5A and 5B are diagrams illustrating the standard for a standard time radio wave signal. As shown in FIGS. 5A and 5B, the standard time radio wave signal is transmitted according to a predetermined standard. In the standard time radio wave signal, codes P, 1, and 0 each having a unit time length of 1 second are continuously arranged. In the standard time radio wave, one frame is 60 seconds and includes 60 codes. In addition, in the standard time radio wave, position markers P1, P2, . . . or a marker M is arranged every ten seconds. It is possible to know the head of the frame appearing every sixty seconds, that is, the head position of the minute by detecting a portion in which a position marker P0 arranged at the end of the frame and the marker M arranged at the head of the frame are continuously arranged.

Figure 6A:
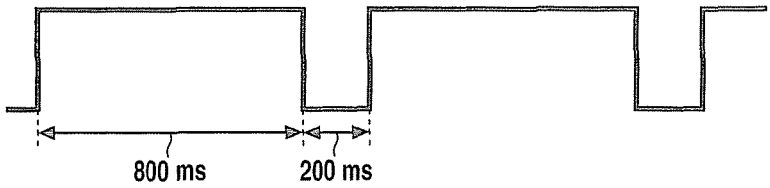
FIG. 6A is a diagram illustrating a code 0 based on the JJY standard.
Figure 6B:
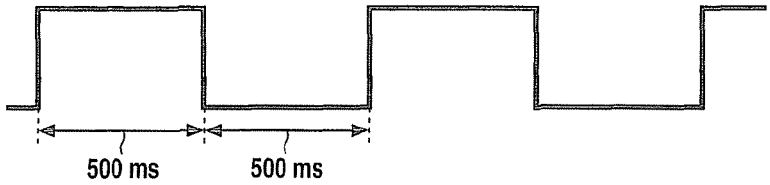
FIG. 6B is a diagram illustrating a code 1 based on the JJY standard.
Figure 6C:
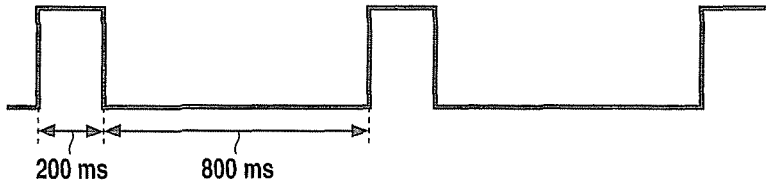
FIG. 6C is a diagram illustrating a code P based on the JJY standard.

FIGS. 6A to 6C, FIGS. 6D to 6F, and FIGS. 6G to 6K are diagrams illustrating examples of codes in the JJY, WWVB, and MSF standards, respectively. As shown in FIGS. 5A and 5B and FIGS. 6A to 6C, JJY includes three codes indicating 0, 1, and P. In JJY, each of the codes has a unit time length (one second) and changes from a low level to a high level at the head of the second. As shown in FIG. 6A, in JJY, the code 0 is at a high level during a first period of 800 ms and is at a low level during the next period of 200 ms. That is, the code 0 is a signal with an 80% duty. As shown in FIG. 6B, the code 1 is at a high level during a first period of 500 ms and is at a low level during the next period of 500 ms. That is, the code 1 is a signal with a 50% duty. As shown in FIG. 6C, the code P which is used as a position marker or a marker is at a high level during a first period of 200 ms and is at a low level during the next period of 800 ms. That is, the code P is a signal with a 20% duty.

In this embodiment, though described later, in order to accurately detect the signal of JJY which changes from a low level to a high level at the head of the second, plural items of predicted waveform data are generated in which a predetermined number of waveform data items (for example, four items of data in this embodiment) each having a unit time length and a predetermined data value are continuously arranged and a phase of the plural items of predicted waveform data is shifted by a time interval of 50 ms. The covariance values between the plural items of predicted waveform data and the input waveform data are calculated and a changing point of the predicted waveform data indicating the optimal covariance value from a low level to a high level is determined to be the second pulse position (the head position of the second).

Then, the CPU 11 and the like detect the head position of the minute, that is, the head position of one frame of the standard time radio wave signal (Step S104).

Then, the CPU 11 and the like decode various kinds of codes (a code M1 indicating one's place of the minute, a code M10 indicating ten's place of the minute, and other codes indicating the date or day) of the standard time radio wave signal based on the comparison between the predicted waveform data and the input waveform data (Step S106).

In this embodiment, the standard time radio wave signal of JJY is received and second synchronization is performed on the received signal. However, this embodiment may be modified such that standard time radio wave signals based on other standards, for example, WWVB or MSF are received. Here, the codes based on WWVB and MSF will be described briefly.

Figure 6D:
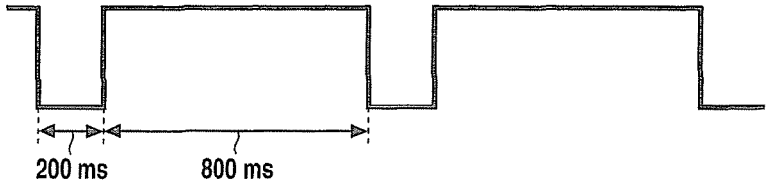
FIG. 6D is a diagram illustrating a code 0 based on the WWVB standard.
Figure 6E:
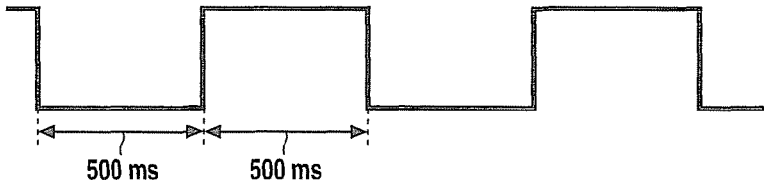
FIG. 6E is a diagram illustrating a code 1 based on the WWVB standard.
Figure 6F:
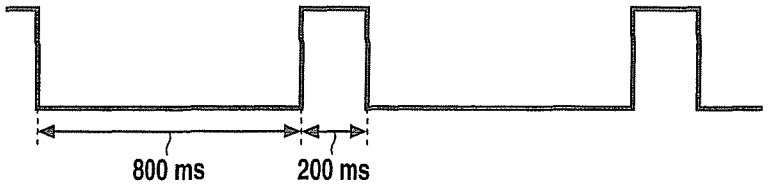
FIG. 6F is a diagram illustrating a code P based on the WWVB standard.

FIGS. 6D to 6F are diagrams illustrating codes included in WWVB used in US. WWVB includes three codes indicating 0, 1, and P. In WWVB, each of the codes changes from a high level to a low level at the head of the second. As shown in FIG. 6D, in WWVB, the code 0 is at a low level during a first period of 200 ms and is at a high level during the next period of 800 ms. As shown in FIG. 6E, the code 1 is at a low level during a first period of 500 ms and is at a high level during the next period of 500 ms. As shown in FIG. 6F, the code P is at a low level during a first period of 800 ms and is at a high level during the next period of 200 ms.

Figure 6G:
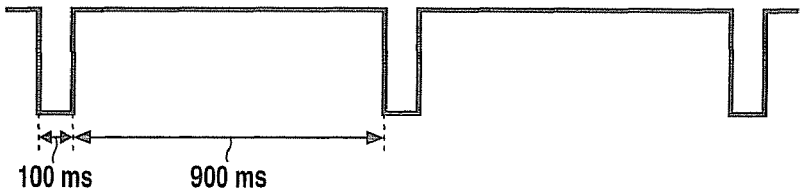
FIG. 6G is a diagram illustrating a code corresponding to A=0 and B=0 based on an MSF standard.
Figure 6H:
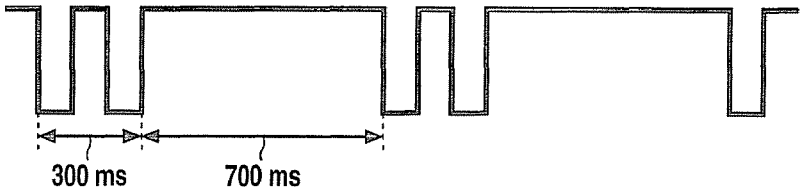
FIG. 6H is a diagram illustrating a code corresponding to A=0 and B=1 based on the MSF standard.
Figure 6I:
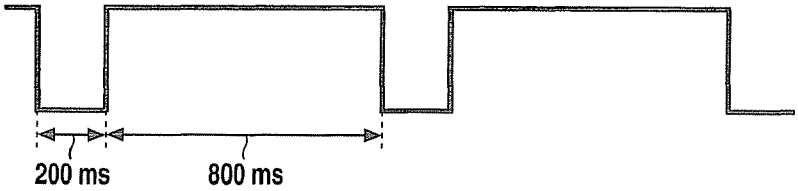
FIG. 6I is a diagram illustrating a code corresponding to A=1 and B=0 based on the MSF standard.
Figure 6J:
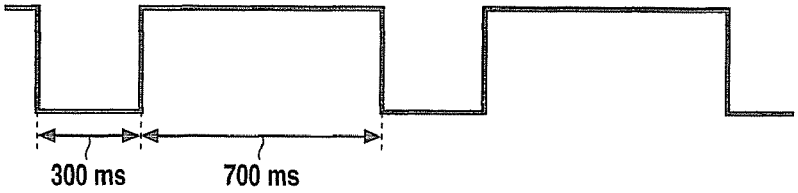
FIG. 6J is a diagram illustrating a code corresponding to A=1 and B=1 based on the MSF standard.
Figure 6K:
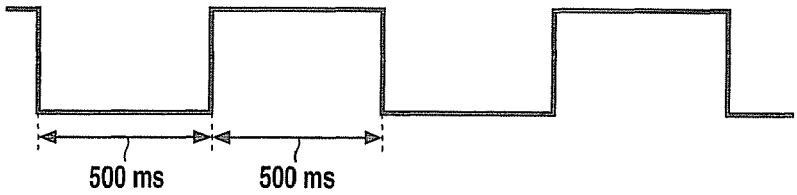
FIG. 6K is a diagram illustrating a code M based on the MSF standard.

FIGS. 6G to 6K are diagrams illustrating codes included in MSF used in England. MSF includes five codes unlike JJY and WWVB, of which four codes may indicate the value of each of two bits A and B. In MSF, the code changes from a high level to a low level at the head of the second. As shown in FIG. 6G, a code corresponding to A=0 and B=0 is at a low level during a first period of 100 ms and is at a high level during the next period of 900 ms. As shown in FIG. 6H, a code corresponding to A=0 and B=1 is sequentially changed to a low level, a high level, and a low level at an interval of 100 ms during a first period of 300 ms and is then at a high level during the next period of 700 ms. As shown in FIG. 6I, a code corresponding to A=1 and B=0 is at a low level during a first period of 200 ms and is at a high level during the next period of 800 ms. A code corresponding to A=1 and B=1 is at a low level during a first period of 300 ms and is at a high level during the next period of 700 ms. A code M corresponding to a marker is also at a low level during a first period of 500 ms and is at a high level during the next period of 500 ms.

Figure 7:
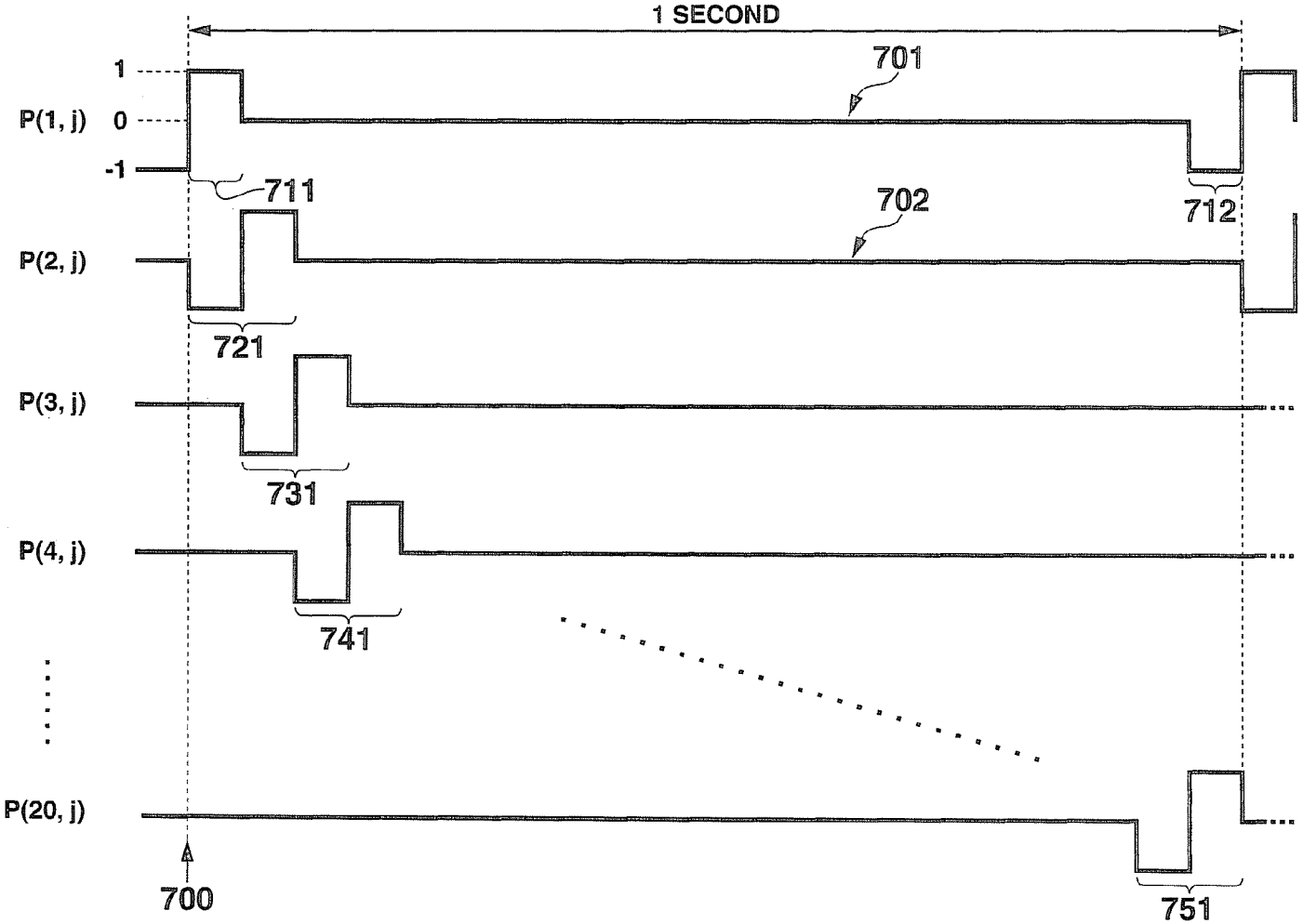
FIG. 7 is a diagram illustrating an example of a portion of predicted waveform data used in second synchronization according to the first embodiment.

Next, the process of detecting the second pulse position (or the process of second synchronization) according to this embodiment (Step S102) will be described in more detail. FIG. 7 is a diagram illustrating an example of a portion of the predicted waveform data used in the second synchronization according to this embodiment. FIG. 7 shows the predicted waveform data items corresponding to one second, which is a first unit time length in each of the predicted waveform data items. A dashed line represented by reference numeral 700 indicates the head of the predicted waveform data. In this embodiment, actually, the predicted waveform data generator 23 generates predicted waveform data items with 4 unit time lengths, that is, predicted waveform data items corresponding to four seconds in which four predicted waveform data items each having a unit time length shown in FIG. 7 are continuously arranged. In this embodiment, the predicted waveform data generator 23 generates 20 predicted waveform data items P(1, j) to P(20, j) in which the heads of the data (change from a low level to a high level) are shifted by 50 ms.

As shown in FIG. 7, the first predicted waveform data item P(1, j) changes from a low level to a high level at the head of the data (see reference numeral 700). The predicted waveform data according to the first embodiment has a first value indicating a low level in a predetermined section (temporally old side) before a point where the data changes from a low level to a high level (in the first predicted waveform data item, a point represented by reference numeral 700) and has a second value indicating a high level in a predetermined section (temporally new side) after the point. In addition, the predicted waveform data has a third value in sections other than the predetermined sections before and after the point. In the example shown in FIG. 7, −1 is used as the first value, 1 is used as the second value, and 0 is used as the third value. In this embodiment, each of the predetermined section with the first value indicating the low level and the predetermined section with the second value indicating the high level is 50 ms.

In the actual calculation, in a portion having the first value and a portion having the second value, that is, in the first predicted waveform data item P(1, j) (see reference numeral 701), only portions represented by reference numerals 711 and 712 are substantially valid in calculation. In the second predicted waveform data item P(2, j) to the twentieth predicted waveform data item P(20, j), only portions represented by reference numerals 721, 731, 741, . . . , and 751 are substantially valid in calculation.

As can be seen from FIG. 7, the second predicted waveform data item P(2, j) (see reference numeral 702) changes from a low level to a high level after a lapse of 50 ms from the head of the data. Hereinafter, the points where the third predicted waveform data item P(3, j), the fourth predicted waveform data item P(4, j), . . . , and so on change from a low level to a high level are sequentially arranged at intervals of 50 ms from the head of the data.

Figure 8:
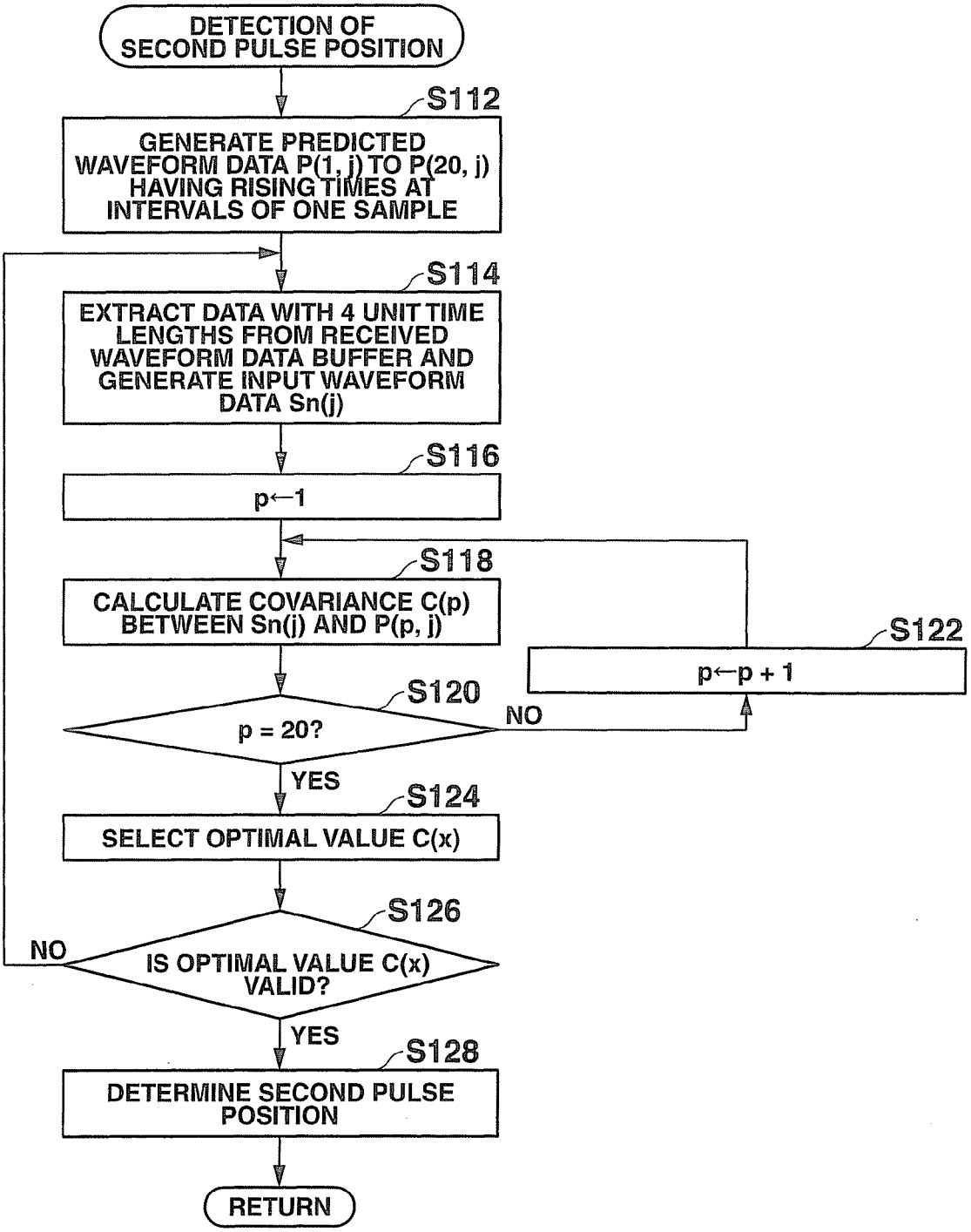
FIG. 8 is a flowchart illustrating a process of detecting a second head position (second pulse position) called second synchronization according to the first embodiment in more detail.
Figure 9:
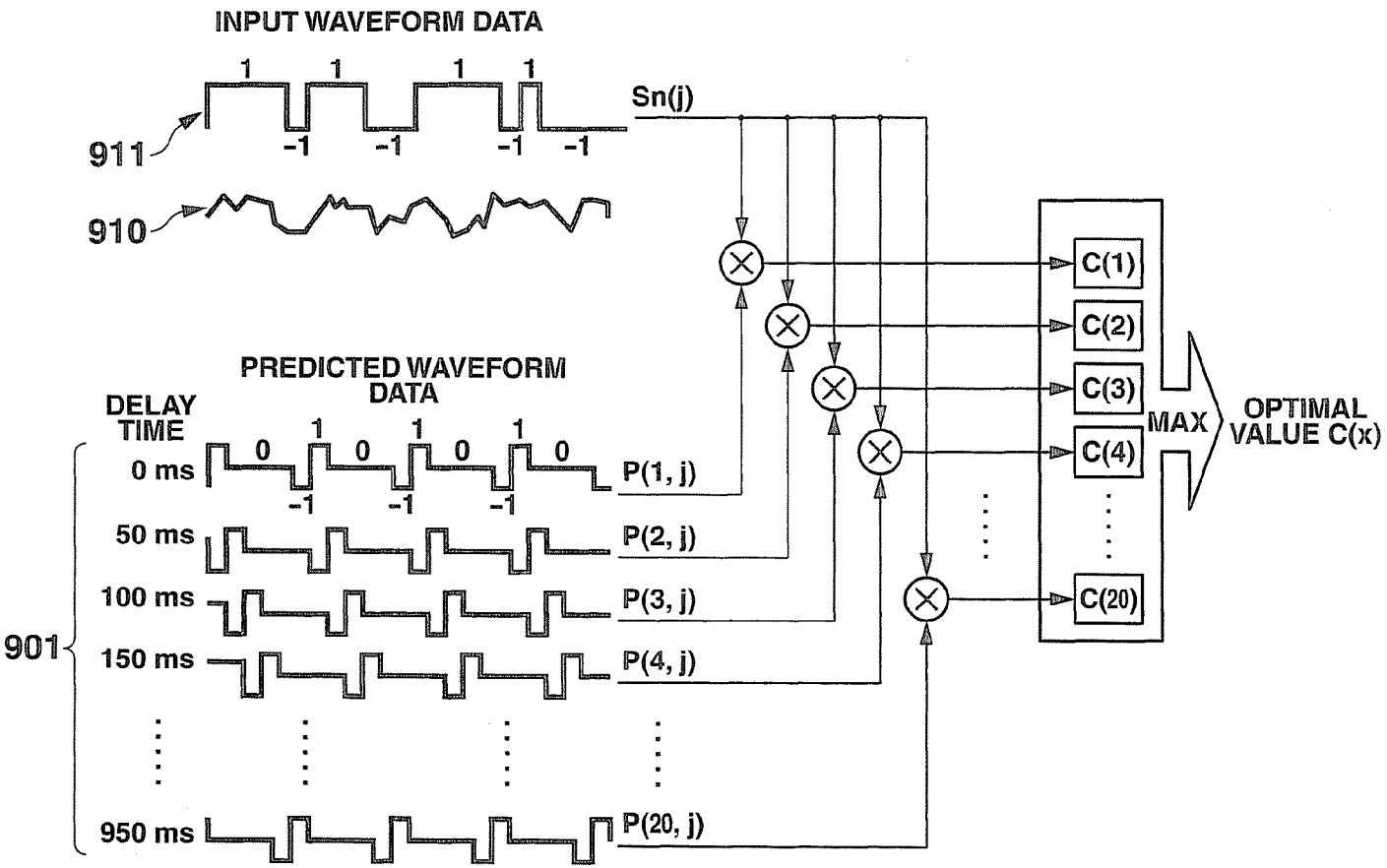
FIG. 9 is a diagram illustrating an example of a process of calculating a covariance value in the process of detecting the second pulse position.
Figure 10:
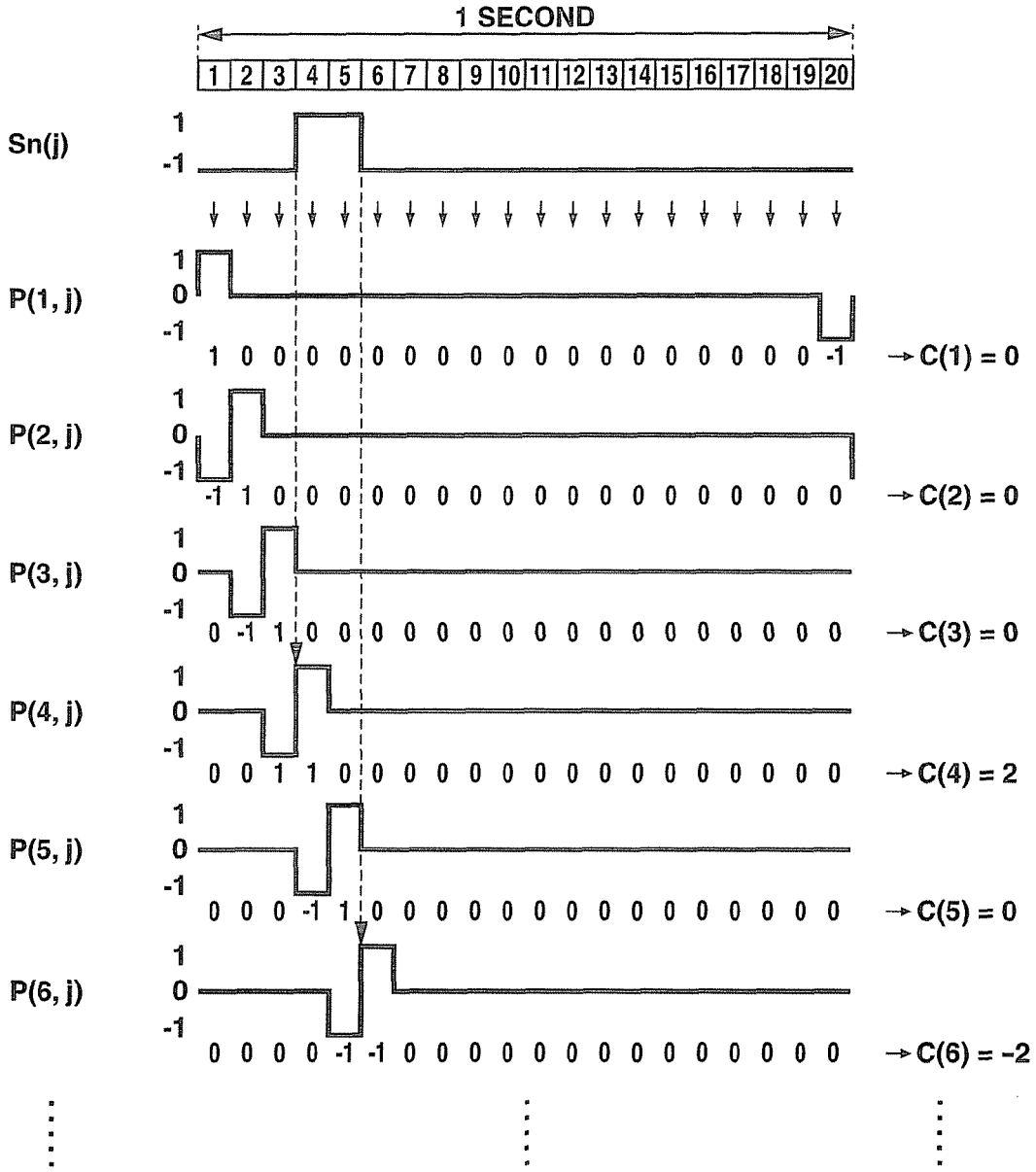
FIG. 10 is a diagram illustrating an example of the process of calculating the covariance value according to the first embodiment.

FIG. 8 is a flowchart illustrating the process of detecting the second pulse position (second synchronization) according to this embodiment in more detail. FIG. 9 is a diagram schematically illustrating the process of detecting the second pulse position according to this embodiment. As shown in FIG. 10, the CPU 11 controls the predicted waveform data generator 23 to generate 20 predicted waveform data items P(1, j) to P(20, j) each with 4 unit time lengths (4 seconds) in which the initial change positions where the data change from a low level to a high level are shifted by 50 ms, as described above (Step S112: reference numeral 901 in FIG. 9). The value of the predicted waveform data is any one of the first value, the second value, and the third value, as described with reference to FIG. 7.

Then, the CPU 11 controls the waveform extractor 24 to extract data (see reference numeral 910 in FIG. 9) with 4 unit time lengths (4 seconds) from data stored in the received waveform data buffer 22 and generate input waveform data Sn(j) (Step S114: reference numeral 911 in FIG. 9). In this embodiment, since data of 20 samples per second is acquired, Sn(j) is data including 80 samples. In order to improve the processing speed or reduce the size of the received waveform data buffer 22, the waveform extractor 24 may extract sample data in the order of Sn(1), Sn(2), and so on from the received waveform data buffer 22 before all data with 4 unit time lengths are stored in the received waveform data buffer 22.

In this embodiment, the input waveform data generator 21 binarizes the analog signal (see reference numeral 910 in FIG. 9) output from the receiver 16 using a predetermined level as a threshold value. During binarization, in the case of the low level, the first value −1 is given as a data value, and in the case of the high level, the second value 1 is given as a data value. Therefore, digital data including the first value and the second value is stored in the received waveform data buffer 22. The input waveform data Sn(j) extracted by the waveform extractor 24 also has the first value or the second value.

Then, the CPU 11 controls the correlation value calculator 25 to initialize a parameter p which detects the predicted waveform data with 1 (Step S116) and to calculate a correlation value (covariance value) C(p) between the input waveform data Sn(j) and the predicted waveform data P(p, j) (Step S118).

In this embodiment, the correlation value calculator 25 calculates the covariance value C(p) using the data value Sn(j) of the input waveform data, the average value Sm thereof, the data value P(p, j) of the predicted waveform data, and the average value Pm thereof according to the following expression:

$$C(p)=(1/N)\times\Sigma((Sn(j)-Sm)\times(P(p,j)-Pm))$$

where $Sm=(1/N)\times\Sigma(Sn(j))$ and $$Pm=(1/N)\times\Sigma(P(p,j))$$

In FIG. 9, C(1), C(2), . . . , and C(20) are obtained by calculating the covariance values between Sn(j) and P(1, j), P(2, j), . . . , and P(20, j).

In addition, Σ is for j=1 to N. As described above, when the waveform extractor 24 extracts sample data in the order of Sn(1), Sn(2), . . . , and so on, not all of Sn(j) (j=1 to N) are acquired in Step S118. Therefore, in at the beginning of Step S118, the average value Sm=(1/N)×Σ(Sn(j)) is not obtained.

However, C(p) is modified as follows:

$$C(p)=(1/N)\times\Sigma(Sn(j)\times(p,j))-Sm\times Pm.$$

Therefore, whenever the waveform extractor 24 acquires the sample data Sn(j), the correlation value calculator 25 calculates Sn(j)×P(p, j) and repeats a process of accumulating the calculated value, which is the multiplication result, to the addition result. When the last sample data Sn(N) is acquired, the correlation value calculator 25 may calculate the average value Sm and subtract Sm×Pm from the accumulation result.

In this embodiment, when Sn(j) is the first value −1 and P(p, j) is the first value −1, Sn(j)×P(p, j) is 1. Similarly, when Sn(j) is the second value 1 and P(p, j) is the second value 1, Sn(j)×P(p, j) is 1. That is, when P(p, j) has the first value or the second value and Sn(j) and P(p, j) have the same value, a predetermined value (in this embodiment, 1) indicating a positive correlation is obtained.

When Sn(j) is the first value −1 and P(p, j) is the second value 1, Sn(j)×P(p, j) is −1. Similarly, when Sn(j) is the second value 1 and P(p, j) is the first value −1, Sn(j)×P(p, j) is −1. That is, when P(p, j) has the first value or the second value and Sn(j) and P(p, j) do not have the same value, a predetermined negative value (in this embodiment, −1) indicating a negative correlation is obtained.

When P(p, j) is the third value 0, Sn(j)×P(p, j) is 0 which has no effect on the calculation of the covariance value, regardless of the value of Sn(j).

FIG. 10 is a diagram illustrating an example of the calculation of the covariance value according to this embodiment. FIG. 10 shows the input waveform data and the predicted waveform data corresponding to the initial one second (j=1 to 20). C(1) to C(6) shown on the right side of FIG. 10 do not indicate the covariance values, but indicate the accumulated value of Sn(j)×P(p, j). The input waveform data Sn(j) is at a high level indicating the second value 1 when j is 4 and 5. The input waveform data Sn(j) is at a low level indicating the first value −1 in the other cases.

In the predicted waveform data P(1, j) to P(3, j), C(1) to C(3) are 0. However, in the predicted waveform data P(4, j) in which the rising edge position of the waveform is aligned with the rising edge position of the waveform of the input waveform data Sn(j), C(4) is 2. In the predicted waveform data P(6, j) in which the rising edge position of the waveform is aligned with the falling edge position of the waveform of the input waveform data Sn(j), C(6) is −2.

As such, in this embodiment, when the rising edge position of the input waveform data is aligned with the rising edge position of the predicted waveform, a large covariance value indicating a strong correlation appears. When the falling edge position of the input waveform data is aligned with the rising edge position of the predicted waveform, that is, when the phases of the waveforms are opposite to each other, a negative covariance value indicating a negative correlation appears. A value of 0 that has no effect on the calculation result appears when the rising edge position of the predicted waveform is aligned with other positions of the input waveform data.

When the parameter p is smaller than 20 (No in Step S120), the parameter p is incremented (Step S122), and the process returns to Step S118. When covariance values C(1) to C(20) are acquired for all of the parameters p, the determination result in Step S120 is "Yes". In this case, the correlation value comparator 26 compares the covariance values C(1) to C(20) to find an optimal value (in this case, the maximum value) C(x) (Step S124). The CPU 11 receives the optimal value C(x) and determines whether the optimal value is valid (Step S126).

The maximum value C(x) of the obtained covariance values C(p) is a predicted waveform with the highest correlation. However, in the covariance value obtained from a sample with insufficient moduli, the maximum value is likely to appear due to an unexpected factor caused by noise. In order to exclude this case, for example, in Step S126, the following criteria are set to prevent an error in detection:

(1) The number of input waveform data used to calculate the covariance is equal to or more than a predetermined value;

(2) The value x indicating C(x) appears plural times, the values x appearing plural times are equal to each other, and the frequency of the value of x is higher than that of other values (x is a mode value);

(3) The values x that continuously appear a predetermined number of times or more are equal to each other (the continuity of a mode value);

(4) The variance of C(p) is equal to or less than a predetermined value; and (5) Kurtosis or the degree of distortion, which is the amount of statistics of C(p), or an evaluation function equivalent thereto is calculated and it is determined whether the calculation result reaches a predetermined value.

When the criteria (1) to (3) are applied, a set of Steps S114 to S124 in FIG. 8 is performed plural times.

A method of determining validity is not limited to the above-mentioned method. The average value of the covariance values or the standard deviation may be used and the covariance value smaller than the average value may be determined to be insignificant even though the covariance value is the maximum value. In addition, the level of significance (for example, 5 percent) that is generally used in statistics may be used.

If it is determined that the optimal value C(x) is valid (Yes in Step S126), the CPU 11 determines the changing point of the signal level of the predicted waveform data indicated by the optimal value C(x), that is, the position where the first value indicating a low level changes to the second value indicating a high level to be the second pulse position (Step S128). The CPU 11 stores the information of the second pulse position in the RAM 15. The second pulse position is used in, for example, the process of detecting the minute head position, which will be described below.

Referring to FIG. 4 again, when the detection of the second pulse position, that is, the second synchronization ends (Step S102), the minute head position is detected (Step S104). The detection of the minute head position is also referred to as minute synchronization. In Step S102, the second pulse position (the head position of the second) has already been set. In JJY, in a one-minute frame, a code indicating the position marker P0 is arranged at the end, and a code indicating the marker M is arranged at the head. Therefore, in the minute synchronization, the CPU 11 and the like determine whether the code that indicates the position marker P0 which is arranged at the end of the frame and the code that indicates the marker M arranged at the head of the frame are continuous.

When the detection of the minute head position (Step S104), that is, minute synchronization ends, codes, such as minute, hour, and day codes, are decoded (Step S106). In Step S106, the CPU 11 and the signal comparator 18 acquire 60 code data items from the minute head position. When the code data is acquired, the CPU 11 determines whether the date (day, month, and year) obtained from the acquired code data is a proper value. When it is determined that there is a consistency in the acquired codes, the current time based on the codes is stored in the RAM 15. In addition, the CPU 11 corrects the current time measured by the internal timer 17 based on the current time obtained from the codes and displays the obtained current time on the display device 13 (Step S108).

The second synchronization and minute synchronization of the signal in JJY and the decoding of the code have been described above. In other standards, such as WWVB and MSF, the second synchronization, the minute synchronization, and the decoding of the code may also be performed.

Figure 11A:
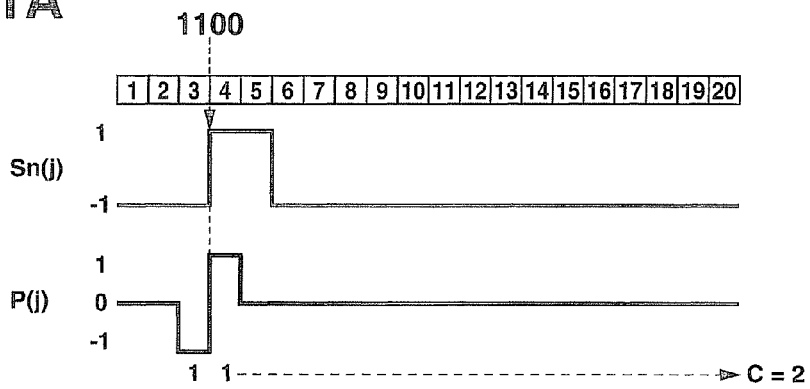
FIG. 11A is a diagram illustrating the covariance value between input waveform data and predicted waveform data.
Figure 11B:
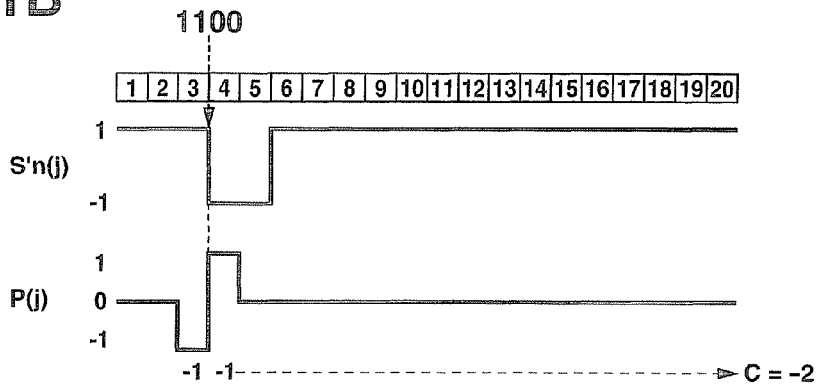
FIG. 11B is a diagram illustrating the covariance value between input waveform data obtained by inverting the code of the value of each sampling point shown in FIG. 11A and the predicted waveform data.
Figure 11C:
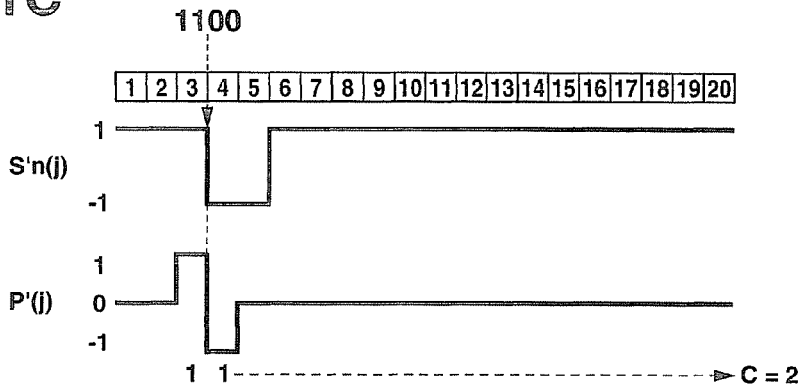
FIG. 11C is a diagram illustrating the covariance value between input waveform data obtained by inverting the code of the value of each sampling point shown in FIG. 11A and predicted waveform data obtained by inverting the code of the value of each sampling point shown in FIG. 11A.

Next, second synchronization in WWVB or MSF will be described. As shown in FIGS. 6D to 6F and FIGS. 6G to 6K, in WWVB or MSF, a signal changes from a high level to a low level at the head of the second. As such, it is considered that the predicted waveform data used in JJY is applied to the signal that falls at the head. FIGS. 11A to 11C are diagrams illustrating the covariance value between the input waveform data and the predicted waveform data. In FIG. 11A, input waveform data Sn(j) changes from a low level to a high level at the head position of the second (see reference numeral 1100). The value of the covariance value C between the predicted waveform data P(j) that has the first value corresponding to a low level before the rising point and has the second value corresponding to a high level after the rising point and the input waveform data Sn(j) is 2 (maximum). For ease of explanation, the covariance value is simply the sum of the products between the data values of the predicted waveform data and the data values of the input waveform data.

As shown in FIG. 11B, input waveform data S'n(j) that changes from a high level to a low level at the head position of the second is considered. The value of the covariance value C between the input waveform data S'n(j) and the predicted waveform data P(j) is −2 (minimum). That is, as in WWVB or MSF, for the data that changes from a high level to a low level at the head position of the second, in order to detect the head position of the second, the minimum value of the covariance value may be selected as the optimal value in the process shown in FIG. 8.

Alternatively, as in WWVB or MSF, in order to detect the head position of the second in the data that changes from a high level to a low level at the head position of the second, another predicted waveform data, which is the inverted data of the predicted waveform data P(j), may be used. In FIG. 11C, the input waveform data S'n(j) is the same as that shown in FIG. 11B. Predicted waveform data P'(j) is the inverted data of the predicted waveform data P(j) shown in FIG. 11B. In this case, the covariance value C(2) when p is 2 is the maximum value (=2). Therefore, the head position of the second may be determined based on the predicted waveform data P(2) and the input waveform data Sn(2).

In this embodiment, in the input waveform data with one or more unit time lengths, each sampling point has either the first value −1 indicating a low level or the second value 1 indicating a high level. In addition, in each of a plurality of predicted waveform data item with one or more unit time lengths, each sampling point has any one of the first value −1 indicating a low level in one predetermined section either before or after the changing point of the signal level, the second value 1 indicating a high level in the other predetermined section before or after the changing point of the signal level, and the third value 0 in sections other than the predetermined sections.

Figure 12A:
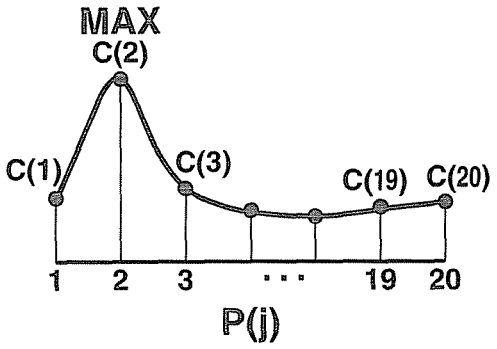
FIG. 12A is a histogram illustrating an example of the covariance value between input waveform data Sn(j) that changes from a low level to a high level at the second head position as in JJY and predicted waveform data P(p, j) (p=1 to 20)
Figure 12B:
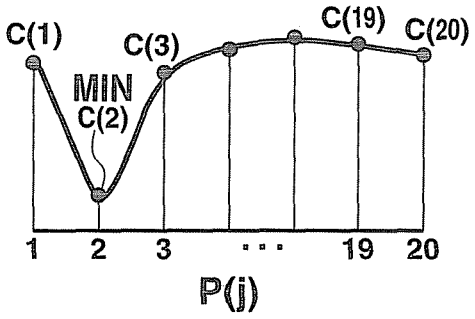
FIG. 12B is a histogram illustrating an example of the covariance value between input waveform data S'n(j) that changes from a high level to a low level at the second head position as in WWVB or MSF and the predicted waveform data P(p, j) (p=1 to 20)

When the input waveform data item and the predicted waveform data item have the above-mentioned values, the first values are multiplied by each other or the second values are multiplied by each other to obtain a first calculated value 1 indicating a positive correlation, and the first value is multiplied by the second value to obtain a second calculated value −1 indicating a negative correlation. Therefore, it is possible to increase the correlation when the changing points of the signal levels of the input waveform data and the predicted waveform data and the changes of the signal levels from a low level to a high level are identical to each other and enhance sensitivity when each of the level changing points and the changes of the signal levels are identical to each other. Therefore, when the histogram of the covariance values is considered for each of a plurality of predicted waveform data (for example, FIG. 12A), it is possible to obtain the optimal value as a sharp peak value. In addition, it is possible to significantly increase the possibility that the maximum value will be at the head of the second, that is, it is possible to significantly improve the accuracy of second synchronization.

In this embodiment, the third value is set to 0 such that the third value is multiplied by the first value or the second value to produce a value (=0) which does not have an effect on the calculation of the covariance value. In this way, the optimal value of the covariance value is appropriately calculated.

In this embodiment, the CPU 11 determines the changing point of the signal level of the predicted waveform data indicated by the optimal value C(x), that is, the position where the first value indicating a low level changes to the second value indicating a high level to be the second pulse position. In this way, it is possible to appropriately specify the head position of the second.

For example, as in the time code based on the JJY standard, when each code changes from a low level to a high level at the head of the second, the predicted waveform data has the first value −1 in a predetermined section before the changing point of the signal level, the second value 1 in a predetermined section after the changing point, and the third value 0 in the other sections. In this case, the calculated correlation values are compared with each other and the maximum value of the correlation value is selected as the optimal value. In this way, it is possible to detect the predicted waveform data with the highest correlation with the input waveform data.

Alternatively, as in the time code based on the WWVB or MSF standard, even though each code changes from a high level to a low level at the head of the second, the predicted waveform data may has the first value −1 only in a predetermined section before the changing point of the signal level, the second value 1 only in a predetermined section after the changing point, and the third value 0 in the other sections. In this case, the calculated correlation values are compared with each other and the minimum value of the correlation value is selected as the optimal value. In this way, it is possible to detect the predicted waveform data with a large negative correlation with the input waveform data. It is possible to appropriately obtain the head position of the second in the time code according to the WWVB or MSF standard, based on the specified predicted waveform data.

In this embodiment, the head position of the minute in the time code is specified based on the second head position and the signal levels before and after the head position of the time code, and codes included in the time code are acquired. Then, the values of codes including the day, hour, and minute forming the time code are acquired based on values indicated by the codes. Thereafter, the current time is calculated based on the acquired codes. As a result, it is possible to correct the time obtained by the internal timer with the calculated current time.

In the first embodiment, the predicted waveform data has the first value indicating a low level in a predetermined section (temporally old side) before a rising point from a low level to a high level and has the second value having a high level in a predetermined section (temporally new side) after the point. In addition, the predicted waveform data has the third value indicating 0 in sections other than the predetermined sections before and after the point. However, the invention is not limited thereto. For example, sections other than the predetermined sections before and after the point may be excluded from calculation. That is, the predicted waveform data may have an indefinite or invalid value, not the third value 0, in the sections other than the predetermined sections.

In this case, only the data of the predetermined sections before and after the changing point of the signal level of the predicted waveform data, that is, a point where the signal level changes from a low level to a high level is extracted, and the covariance values between the data values of the predetermined sections and the data values of the corresponding input waveform data are calculated. In FIG. 7, in the first predicted waveform data item P(1, j), the sections represented by reference numerals 711 and 712 are the predetermined sections. In the second predicted waveform data item P(2, j), the third predicted waveform data item P(3, j), the fourth predicted waveform data item P(4, j), . . . , the twentieth predicted waveform data item P(20, j), the sections represented by reference numerals 721, 731, 731, . . . , 751 are the predetermined sections.

Figure 13:
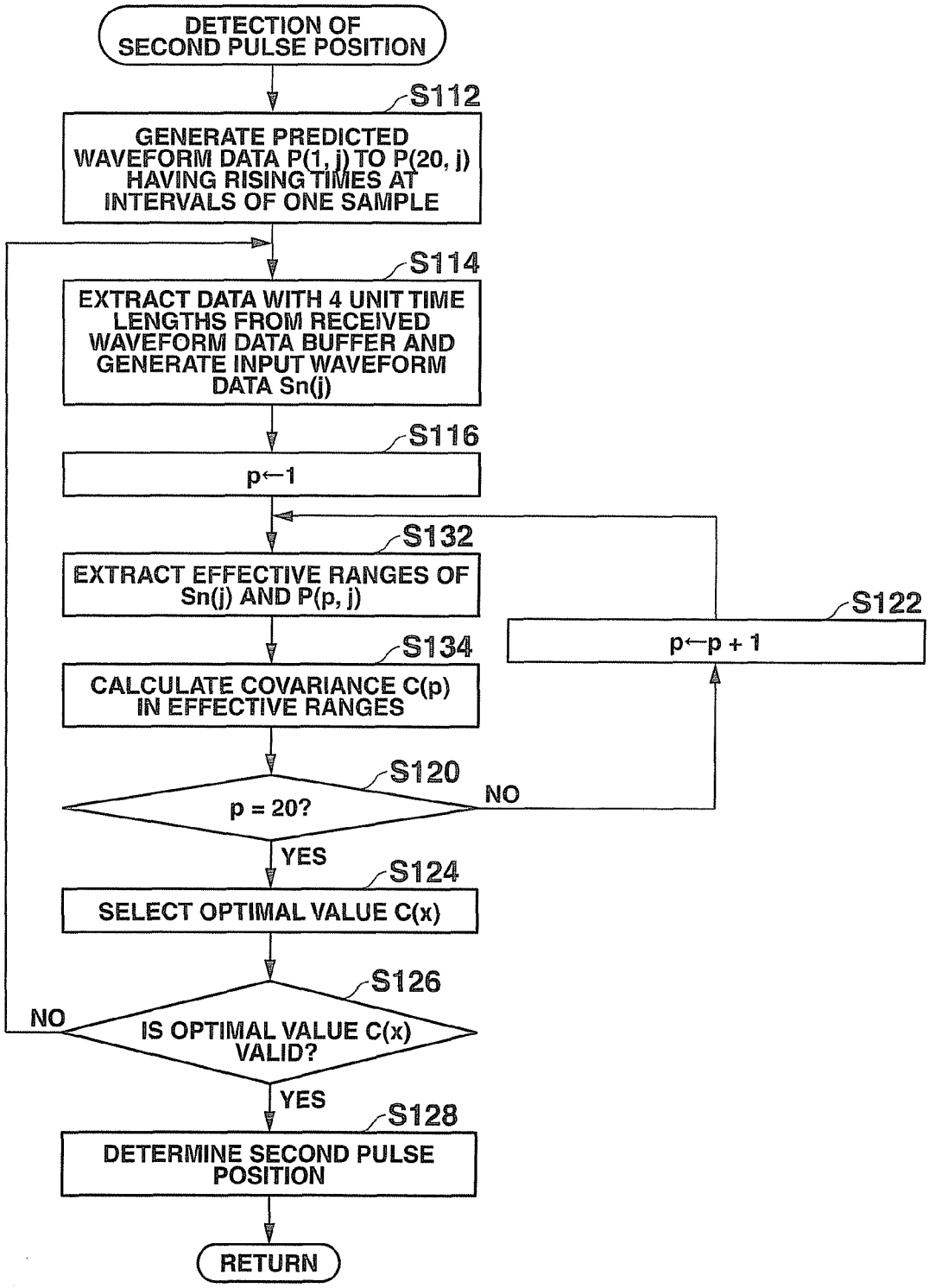
FIG. 13 is a flowchart illustrating an example of a process of detecting the second pulse position when a predetermined section of the input waveform data and the predicted waveform data is used as an effective range according to the first embodiment.

FIG. 13 is a flowchart illustrating a modification of the process of detecting the second pulse position according to the first embodiment shown in FIG. 8. In the modification, after Step S116, the correlation value calculator 25 extracts the predetermined section of the predicted waveform data P(p, 1) as a valid range and extracts a section of the input waveform data Sn(j) corresponding to the valid range of the predicted waveform data P(p, j) as a valid range (Step S132). Then, the correlation value calculator 25 calculates the covariance value of corresponding data values in the valid range of the input waveform data Sn(j) and the valid range of the predicted waveform data P(p, j) (Step S134). The covariance value is calculated by the same method as that in the embodiment. After Step S134, the process proceeds to Step S120.

According to the above-mentioned structure, it is possible to omit the calculation of the data values of the predicted waveform data and the data value of the input waveform data in sections other than the predetermined sections. Therefore, it is possible to reduce the number of calculations or shorten the time for calculation.

In the first embodiment, the first value indicating a low level is −1, the second value indicating a high level is 1, and the third value other than the first and second values is 0. However, the invention is not limited to these values. The first value and the second value may be as follows.

(1) When the input waveform data indicates the first value and the predicted waveform data indicates the first value, or when the input waveform data indicates the second value and the predicted waveform data indicates the second value, the first value is multiplied by the first value or the second value is multiplied by the second value to obtain a predetermined positive value indicating a positive correlation. That is, when the input waveform data and the predicted waveform data indicate the same value, a predetermined positive value is obtained.

(2) When the input waveform data indicates the first value and the predicted waveform data indicates the second value, or when the input waveform data indicates the second value and the predicted waveform data indicates the first value, the first value is multiplied by the second value to obtain a predetermined negative value indicating a negative correlation. That is, when the input waveform data and the predicted waveform data indicate different values, a predetermined negative value is obtained. It is preferable that the predetermined negative value be opposite to the predetermined positive value in polarity.

In the calculation of the second pulse position, the third value may not be 0. However, the third value should not affect the correlation value, such as the covariance value, when it is multiplied by the first value or the second value.

In the above-described embodiment, the covariance value is used as the correlation value, but the invention is not limited thereto. For example, a residual, which is the total sum of the absolute values of differences, may be used as the correlation value. Alternatively, a mutual correlation coefficient may be used instead of the covariance or the residual.

Figure 14:
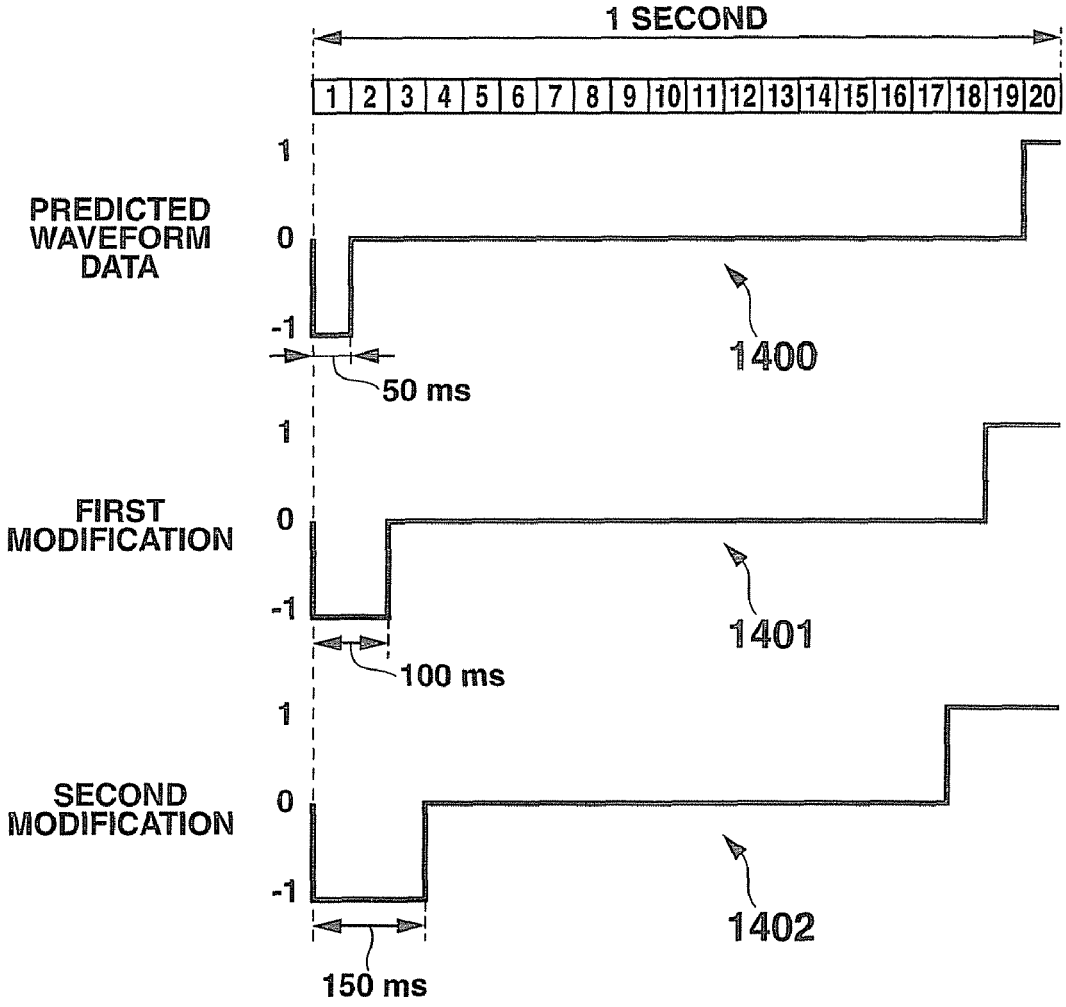
FIG. 14 is a diagram illustrating the predicted waveform data and a modification of the predicted waveform data according to the first embodiment.

In the first embodiment, in each of the predicted waveform data, each sampling point has the first value −1 indicating a low level in a section that is 50 ms before the changing point of the signal level, the second value 1 indicating a high level in a section that is 50 ms after the changing point, and the third value 0 in the other sections. That is, as in the predicted waveform data (see reference numeral 1400) shown in FIG. 14, each of the predetermined sections before and after the changing point is 50 ms. However, the predetermined section is not limited thereto. For example, in a first modification (see reference numeral 1401), the predetermined section is 100 ms. In addition, the predetermined section may be extended to 150 ms, as in a second modification (see reference numeral 1402).

In general, the narrower the predetermined section, the higher the accuracy of detection, as in the predicted waveform data 1400. However, as in the modifications 1401 and 1402, when the predetermined section has a constant width (time length), a stable detection result is likely to be obtained, without being affected by noise.

Figure 21A:
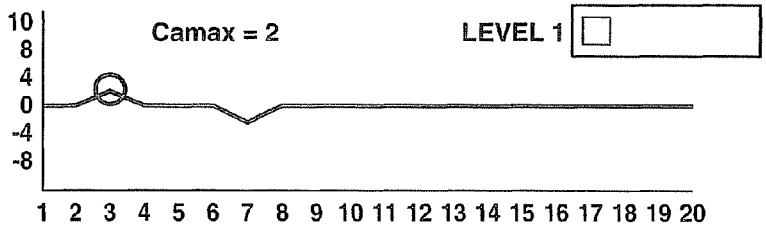
FIG. 21A is a diagram illustrating a first process of calculating the accumulated value of the covariance value based on the first input waveform data shown in FIG. 19B.
Figure 21B:
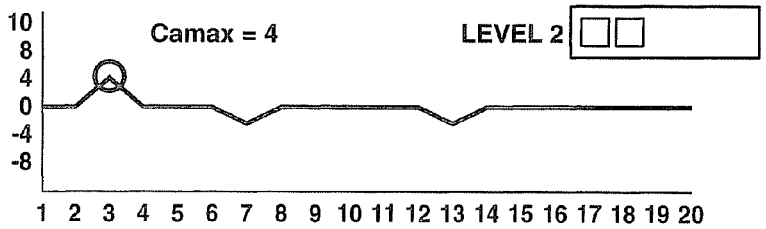
FIG. 21B is a diagram illustrating a second process of calculating the accumulated value of the covariance value based on the second input waveform data shown in FIG. 19B.
Figure 21C:
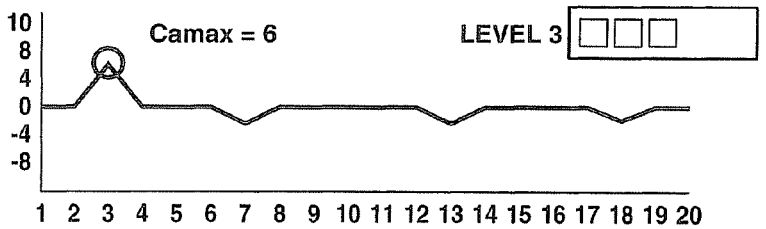
FIG. 21C is a diagram illustrating a third process of calculating the accumulated value of the covariance value based on the third input waveform data shown in FIG. 19B.
Figure 21D:
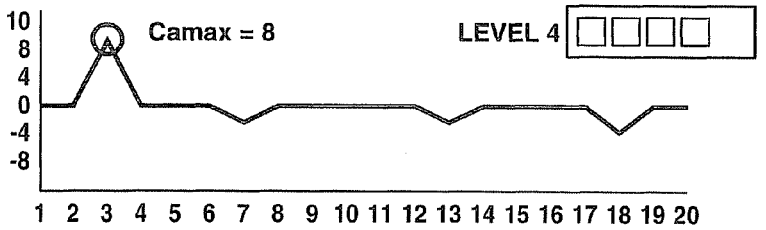
FIG. 21D is a diagram illustrating a fourth process of calculating the accumulated value of the covariance value based on the fourth input waveform data shown in FIG. 19B.
Figure 21E:
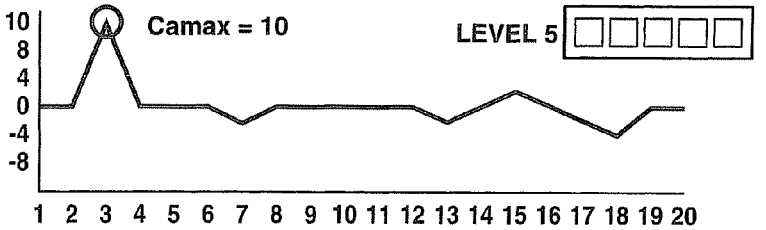
FIG. 21E is a diagram illustrating a fifth process of calculating the accumulated value of the covariance value based on the fifth input waveform data shown in FIG. 19B.

Next, minute synchronization and the decoding of a code in WWVB or MSF will be described. In WWVB, the data value in the characteristic section is extracted and only the data value of characteristic section is used to calculate the covariance value. FIGS. 21A to 21C are diagrams illustrating the characteristic section of each code in WWVB. For codes in WWVB, a marker (see reference numeral 1901) shown in FIG. 21A, a code 0 (see reference numeral 1902) shown in FIG. 21B, and a code 1 (see reference numeral 1903) shown in FIG. 21C have characteristic sections with different data values. The marker is at a low level (data value −1) and has a data value −1 different from those of other codes in the section (see reference numeral 1911) from 500 ms to 800 ms. In this embodiment, in WWVB, the section from 500 ms to 800 ms in the marker is the characteristic section. In addition, the data value of the characteristic section is −1 indicating a low level.

The code 0 is at a high level (data value 1) and has a data value 1 different from those of other codes in the section (see reference numeral 1912) from 200 ms to 500 ms. The code 1 is at a low level (data value −1) and has a data value −1 different from that of the code 0 in the section (see reference numeral 1913) from 200 ms to 500 ms. Therefore, in each of the codes 0 and 1, the section from 500 ms to 800 ms is the characteristic section. In addition, the data values of the characteristic sections are 1 and −1.

Similar to JJY, it is possible to perform the process of detecting the minute head position and the code decoding process using the data value of the characteristic section.

FIGS. 22A to 22E are diagrams illustrating the characteristic section of each code in MSF. For codes in MSF, a marker (see reference numeral 2001) shown in FIG. 22A, a code 00 (see reference numeral 2002) shown in FIG. 22B, a code 01 (see reference numeral 2003) shown in FIG. 22C, a code 10 (see reference numeral 2004) shown in FIG. 22D, and a code 11 (see reference numeral 2005) shown in FIG. 22E have sections with different eigenvalues.

The marker is at a low level (data value −1) and has a data value −1 different from those of other codes in the section (see reference numeral 2011) from 300 ms to 500 ms. In this embodiment, in MSF, the section from 300 ms to 500 ms in the marker is the characteristic section. In addition, the data value of the characteristic section is −1 indicating a low level.

The code 00 is at a high level (data value 1) and has a data value 1 different from those of other codes in the section (see reference numeral 2012) from 100 ms to 300 ms. The code 01 is at a high level (data value 1) in the section (see reference numeral 2013) from 100 ms to 200 ms and is at a low level (data value −1) in the section (see reference numeral 1014) from 200 ms to 300 ms. The code 01 has a combination of values (the first half is 1 and the second half is −1) different from those of other codes in the sections. The code 10 is at a low level (data value −1) in the section (see reference numeral 2015) from 100 ms to 200 ms and is at a high level (data value 1) in the section (see reference numeral 1016) from 200 ms to 300 ms. The code 10 has a combination of values (the first half is −1 and the second half is 1) different from those of other codes in the sections. The code 11 is at a low level (data value −1) and has a data value −1 different from those of other codes in the section (see reference numeral 2017) from 100 ms to 300 ms. Therefore, the section from 100 ms to 300 ms is the characteristic section. The data value of each of the sections is the same as that shown in FIG. 20.

In MSF, the data values of the characteristic sections of the codes 00 to 11 are not constant. For example, the data values of the first half and the second half of the characteristic section of the code 01 are 1 and −1, respectively. Therefore, in the code decoding process based on the MSF standard, similar to the detection of the minute head position, the data value in the characteristic section of the input waveform data may be multiplied by a corresponding data value in the characteristic section of the predicted waveform data, the calculated values may be added to obtain the total sum, and the covariance value may be calculated based on the obtained total sum. In this embodiment, the data value accumulator 29 accumulates the data value of the characteristic section, which has a constant and unique data value different from those of other codes, of each of the codes forming time information included in the time code in the input waveform data, for example, the codes 0 and 1 based on JJY and stores the accumulated value in the accumulated value buffer 30. The correlation value calculator 25 multiplies the data value of the characteristic section stored in the accumulated value buffer 30 by the characteristic value, which is the first value or the second value of the characteristic section of a specific code, for example, each of the codes 0 and 1 based on JJY and calculates the correlation values between the input waveform data and the codes based on the multiplied value. Originally, multiplication to calculate the correlation value needs to be performed between the data values of the sampling points of waveform data. However, the code has a constant and unique data value (characteristic value) different from those of other codes in the characteristic section. Therefore, the value obtained only by multiplying the accumulated value by the characteristic value indicates the correlation between the input waveform data and the code. As a result, it is possible to acquire an appropriate correlation value with a small amount of calculation.

In this embodiment, when the head position of the minute in the time code is specified based on the signal levels before and after the head position of the time code, the data value accumulator 29 accumulates the data value of a specific section and stores the accumulated value in the accumulated value buffer 30. When the minute head position is specified, the correlation value calculator 25 extracts the data value of the characteristic section corresponding to the code forming time information from the accumulated value buffer 30 based on the detected minute head position, and multiplies the data value by the characteristic value. Therefore, it is possible to acquire the accumulated value of the data value of the characteristic section while the minute head position is detected, and to start to detect the code forming time information immediately after the detection of the minute head position ends.

For example, in this embodiment, in the input waveform data, the data value of the second characteristic section, which has a constant and unique data value different from those of other codes, of a predetermined code with plural unit time lengths which includes the head position of the minute in the time codes, for example, two continuous codes P in JJY are acquired. The correlation value calculator 25 calculates the correlation value between the input waveform data and the predetermined code based on the value obtained by multiplying the data value of the second characteristic section in the acquired input waveform data by a characteristic value which is the first value or the second value of the characteristic section of the predetermined code with the plural unit time lengths which includes the head position of the minute.

According to the above-mentioned embodiment, it is possible to obtain the correlation value only by calculating the data value of the characteristic section in the detection of the minute head position. Therefore, it is possible to obtain an appropriate correlation value with a small amount of calculation.

For example, the first value is set to −1 and the second value is set to 1. The first value is multiplied by the first value or the second value is multiplied by the second value to obtain a first positive value 1 indicating a positive correlation. Meanwhile, the first value is multiplied by the second value to obtain a second negative value −1 indicating a negative correlation. Thus, the correlation value calculator 25 selects the maximum value of the correlation value as an optimal value. In this way, it is possible to detect a code with the highest correlation with the input waveform data.

In this embodiment, time information forming the time code is acquired and the current time is calculated based on the acquired time information. Therefore, it is possible to correct the time obtained by the internal timer with the calculated current time.

The invention is not limited to the above-described embodiment, but various modifications and changes of the invention can be made without departing from the scope and spirit of the invention. The modifications and changes are also included in the scope of the invention.

In the detection of the second pulse position according to the above-described embodiment, the predicted waveform data has the first value indicating a low level in a predetermined section (temporally old side) before a rising point from a low level to a high level and has the second value having a high level in a predetermined section (temporally new side) after the point. In addition, the predicted waveform data has a third value indicating 0 in sections other the predetermined sections before and after the point. However, the invention is not limited thereto. For example, sections other than the predetermined sections before and after the point may be excluded from calculation. That is, the predicted waveform data may have an indefinite or invalid value, not the third value 0, in sections other than the predetermined sections.

In this case, only the data of the predetermined sections before and after the changing point of the signal level of the predicted waveform data, that is, a point where the signal level changes from a low level to a high level is extracted, and the covariance values between the data values of the predetermined sections and the data values of the corresponding input waveform data are calculated. In FIG. 9, in the first predicted waveform data item P(1, j), the sections represented by reference numerals 711 and 712 are the predetermined sections. In the second predicted waveform data item P(2, j), the third predicted waveform data item P(3, j), the fourth predicted waveform data item P(4, j), . . . , and the twentieth predicted waveform data item P(20, j), the sections represented by reference numerals 721, 731, 741, . . . , and 751 are the predetermined sections.

According to the above-mentioned embodiment, it is possible to omit the calculation of the data value of the predicted waveform data and the data value of the input waveform data in sections other than the predetermined sections. Therefore, it is possible to reduce the number of calculations.

In the embodiment, in the detection of the second pulse position, the first value indicating the low level of the input waveform data and the predicted waveform data is −1, the second value indicating the high level thereof is 1, and the third value other than the first and second values is 0. In the detection of the minute head position and the decoding of the code, the first value indicating the low level of the input waveform data and the predicted waveform data is −1 and the second value indicating the high level thereof is 1. However, the invention is not limited to these values. The first value and the second value may be as follows.

(1) When the input waveform data indicates the first value and the predicted waveform data indicates the first value, or when the input waveform data indicates the second value and the predicted waveform data indicates the second value, the first value is multiplied by the first value or the second value is multiplied by the second value to obtain a predetermined positive value indicating a positive correlation. That is, when the input waveform data and the predicted waveform data indicate the same value, a predetermined positive value is obtained.

(2) When the input waveform data indicates the first value and the predicted waveform data indicates the second value, or when the input waveform data indicates the second value and the predicted waveform data indicates the first value, the first value is multiplied by the second value to obtain a predetermined negative value indicating a negative correlation. That is, when the input waveform data and the predicted waveform data indicate different values, a predetermined negative value is obtained. It is preferable that the predetermined negative value be opposite to the predetermined positive value in polarity.

In the calculation of the second pulse position, the third value may not be 0. However, the third value should not affect the correlation value, such as the covariance value, when it is multiplied by the first value or the second value.

In the above-described embodiment, the covariance value is used as the correlation value, but the invention is not limited thereto. For example, a residual, which is the total sum of the absolute values of differences, may be used as the correlation value. Alternatively, a mutual correlation coefficient may be used instead of the covariance or the residual.

In the above-described embodiment, in the detection of the minute head position, the data value in the characteristic section of Sn(i, j) is extracted so as to correspond to the characteristic section of the predicted waveform data (Step 1105 in FIG. 13). In the calculation of the covariance, the correlation value (covariance value) C(i) between the input waveform data Sn(i, j) in the characteristic section and the predicted waveform data P(j) in the characteristic section is calculated. However, the data value of the predicted waveform data may be multiplied by the corresponding data value of the input waveform data and the covariance value may be calculated based on the multiplied value, without extracting the data value in the characteristic section.

When the data value of the predicted waveform data is multiplied by the corresponding data value of the input waveform data to obtain a multiplied value, the amount of calculation increases, but it is possible to accurately specify input waveform data corresponding to the head position of the minute since the entire waveform is compared.

While the description above refers to particular embodiments of the present invention, it will be understood that many modifications may be made without departing from the spirit thereof. The accompanying claims are intended to cover such modifications as would fall within the true scope and spirit of the present invention. The presently disclosed embodiments are therefore to be considered in all respects as illustrative and not restrictive, the scope of the invention being indicated by the appended claims, rather than the foregoing description, and all changes that come within the meaning and range of equivalency of the claims are therefore intended to be embraced therein. For example, the present invention can be practiced as a computer readable recording medium in which a program for allowing the computer to function as predetermined means, allowing the computer to realize a predetermined function, or allowing the computer to conduct predetermined means.

Other embodiments of the present invention will be described. The same portions as those of the first embodiment will be indicated in the same reference numerals and their detailed description will be omitted.

A second embodiment will be described. A block diagram illustrating the structure of a radio wave timepiece according to the second embodiment is the same as that in the first embodiment shown in FIG. 1 and thus a description thereof will be omitted.

A diagram illustrating an example of the structure of a receiver according to the second embodiment is the same as that in the first embodiment shown in FIG. 2 and thus a description thereof will be omitted.

In this embodiment, for example, predicted waveform data and input waveform data are compared with each other to detect the head of the minute and the values of various kinds of codes including time (minute and hour) and date (day, month, and year) codes. When the date and time are specified, it is possible to calculate an error in the internal timer 17 and correct the current time measured by the internal timer 17.

Figure 15:
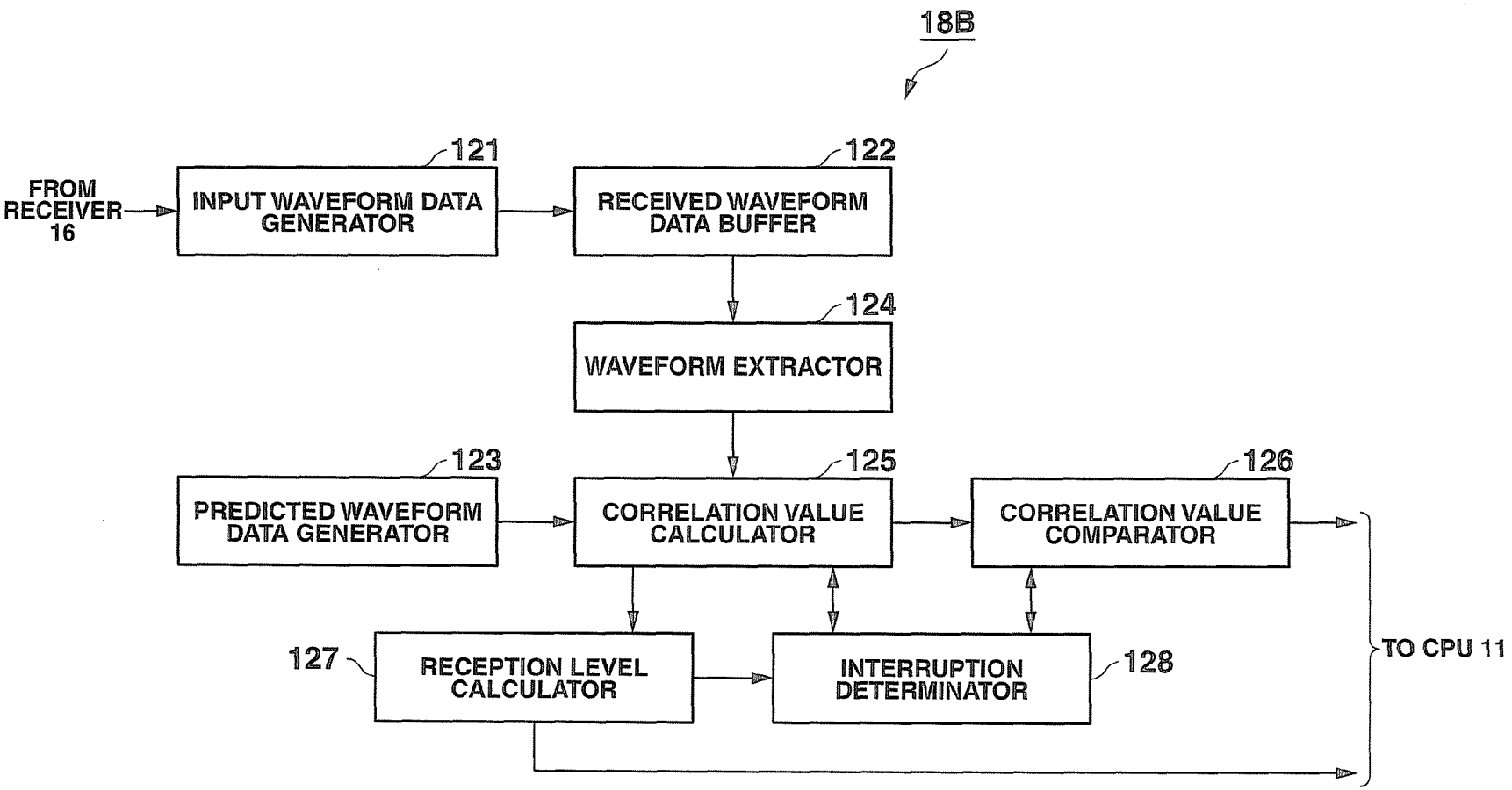
FIG. 15 is a block diagram illustrating the structure of a signal comparator according to a second embodiment.

The signal comparator 18 in the radio wave timepiece shown in FIG. 1 of the first embodiment is replaced by a signal comparator 18B in the second embodiment. FIG. 15 is a block diagram illustrating the structure of the signal comparator 18B. As shown in FIG. 15, the signal comparator 18B includes an input waveform data generator 121, received waveform data buffer 122, predicted waveform data generator 123, waveform extractor 124, correlation value calculator 125, a correlation value comparator 126, a reception level calculator 127, and an interruption determinator 128. Components other than the reception level calculator 127 and the interruption determinator 128 are the same as those in the first embodiment.

The operations of the input waveform data generator 121 and the received waveform data buffer 122 are the same as those the input waveform data generator 21 and the received waveform data buffer 22 according to the first embodiment.

The predicted waveform data generator 123 generates predicted waveform data, which is a comparison target, with a predetermined time length. The predicted waveform data is used in each process, which will be described below. The predicted waveform data generated by the predicted waveform data generator 123 will be described in a process of detecting a second pulse position, a process of detecting a head position of the minute, and a code decoding process. The operations of the waveform extractor 124, the correlation value calculator 125, and the correlation value comparator 126 are the same as those of the waveform extractor 24, the correlation value calculator 25, and the correlation value comparator 26 according to the first embodiment.

The reception level calculator 127 calculates the signal level of a standard time radio wave signal based on the covariance value calculated by the correlation value calculator 125 and outputs the signal level to the CPU 11. The interruption determinator 128 determines whether to continue or stop the process of detecting the second pulse position based on the covariance value.

A flowchart schematically illustrating a process performed in the radio wave timepiece according to this embodiment is the same as that in the first embodiment shown in FIG. 4 and thus a description thereof will be omitted. A diagram illustrating a standard time radio wave signal standard is the same as FIGS. 5A and 5B in the first embodiment and thus a description thereof will be omitted.

Examples of the codes based on the JJY, WWVB, and MSF standards are the same as those shown in FIGS. 6A to 6K in the first embodiment and thus a description thereof will be omitted.

The predicted waveform data used in the process of detecting the second pulse position (Step S102 in FIG. 4) (second synchronization) according to this embodiment is the same as that shown in FIG. 7 in the first embodiment and thus a description thereof will be omitted.

Figure 16:
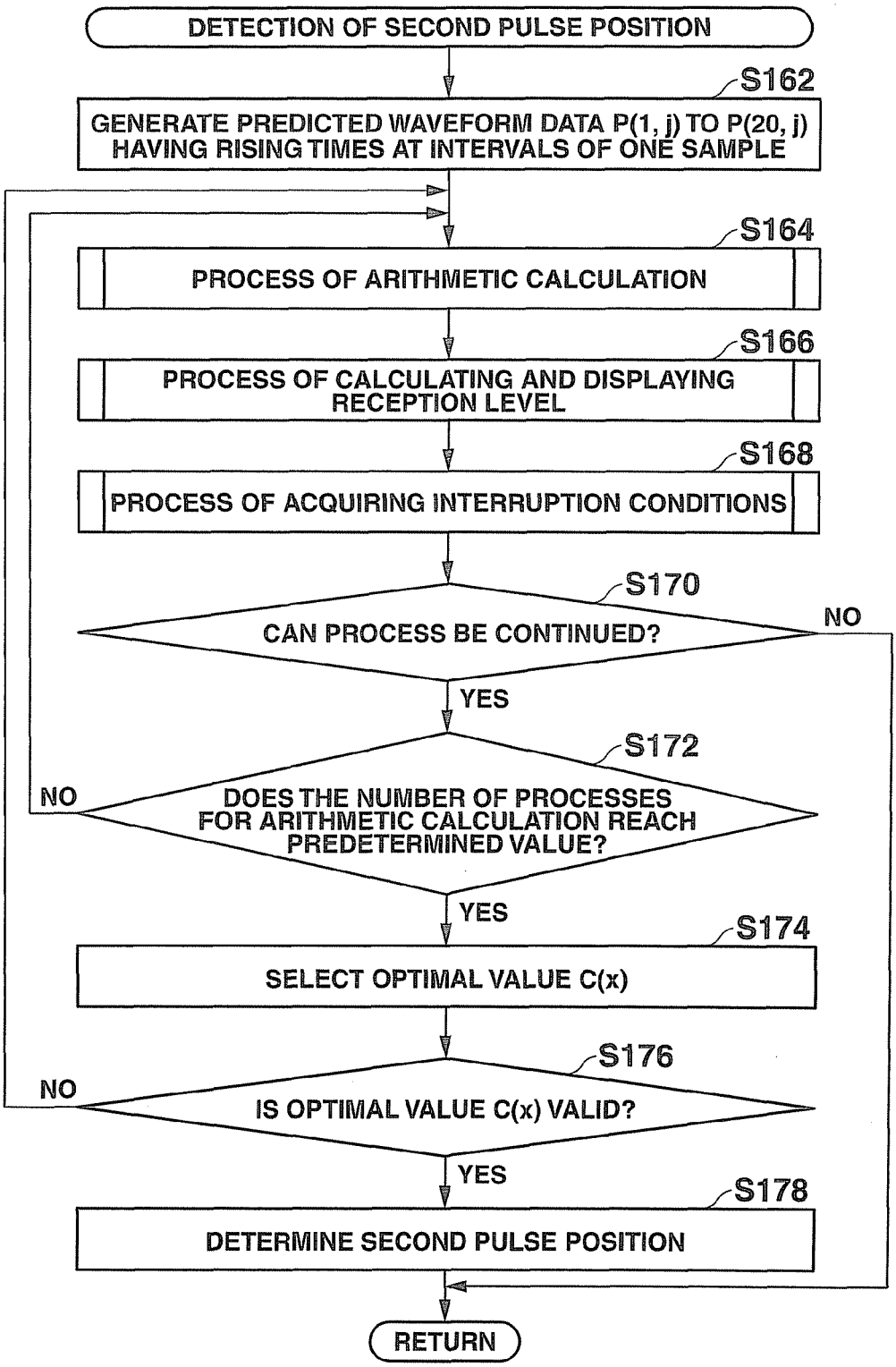
FIG. 16 is a flowchart illustrating a process of detecting the second pulse position (second synchronization) according to the second embodiment.
Figure 17:
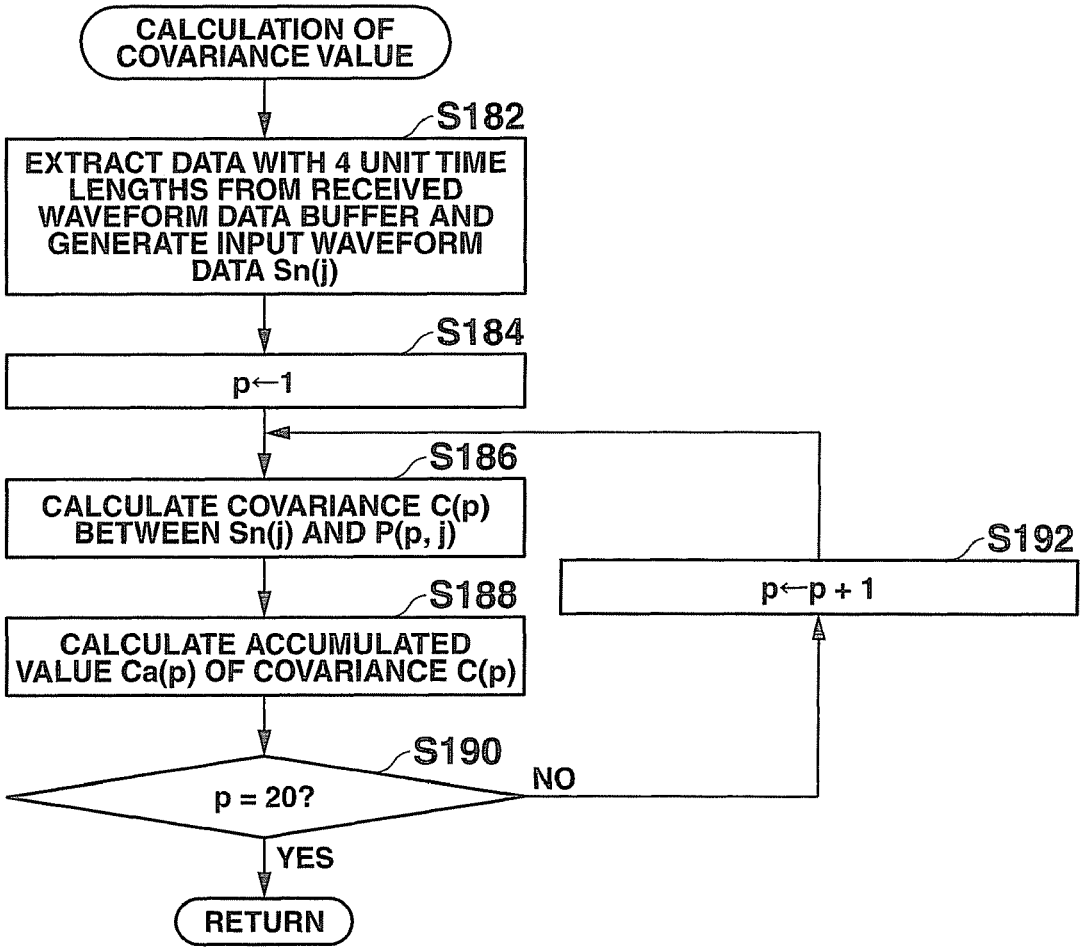
FIG. 17 is a flowchart illustrating an example of a process of calculating a covariance value in the process of detecting the second pulse position according to the second embodiment.

This embodiment differs from the first embodiment in the details of second synchronization. FIG. 16 is a flowchart illustrating the process of detecting the second pulse position (second synchronization) according to this embodiment in more detail, and FIG. 17 is a flowchart illustrating the details of a process of calculating a covariance value (Step S164 in FIG. 16) in the process of detecting the second pulse position. A diagram schematically illustrating the process of detecting the second pulse position according to this embodiment is the same as FIG. 9 in the first embodiment and thus a description thereof will be omitted.

As shown in FIG. 16, the CPU 11 and the like control the predicted waveform data generator 123 to generate 20 predicted waveform data items P(1, j) to P(20, j) with 4 unit time lengths (4 seconds) in which the heads of the data (change from a low level to a high level) are shifted by 50 ms, as shown in FIG. 7 (Step S162: reference numeral 901 in FIG. 9). The value of the predicted waveform data is any one of the first value, second value, and third value, as described with reference to FIG. 7.

Then, the signal comparator 18B performs the process of calculating the covariance value (Step S164). In the calculation of the covariance value, as shown in FIG. 17, the CPU 11 and the like control the waveform extractor 24 to extract data with 4 unit time lengths (4 seconds) from the received waveform data buffer 122 and generate input waveform data Sn(j) (Step S182 in FIG. 17: reference numeral 910 in FIG. 9). In this embodiment, since data of 20 samples per second is acquired, Sn(j) is data including 80 samples. In order to improve the processing speed or allow the reduction in the size of the received waveform data buffer 122, the waveform extractor 24 may extract sample data in the order of Sn(1), Sn(2), . . . , from the received waveform data buffer 122 before all data with 4 unit time lengths are stored.

In this embodiment, the input waveform data generator 121 binarizes the analog signal (see reference numeral 910 in FIG. 9) output from the receiver 16 using a predetermined level as a threshold value. During binarization, in the case of the low level, the first value −1 is given as a data value, and in the case of the high level, the second value 1 is given as a data value. Therefore, digital data including the first value and the second value is stored in the received waveform data buffer 122. The input waveform data Sn(j) extracted by the waveform extractor 124 also has the first value or the second value.

Then, the CPU 11 and the like control the correlation value calculator 125 to initialize a parameter p for specifying the predicted waveform data to 1 (Step S184) and calculate a correlation value (covariance value) C(p) among the input waveform data Sn(j) and the predicted waveform data P(p, j) (Step S186). In addition, the correlation value calculator 125 calculates the accumulated value Ca(p) of the covariance value C(p) (Step S188).

A diagram illustrating an example of the calculation of the covariance value according to this embodiment is substantially the same as FIG. 10 in the first embodiment and thus a description thereof will be omitted. FIG. 10 shows the input waveform data and the predicted waveform data corresponding to the first one second (j=1 to 20). In the first embodiment, C(1) to C(6) shown on the right side of FIG. 10 indicate the covariance values. However, in the second embodiment, C(1) to C(6) do not indicate the covariance values, but indicate the accumulated values of Sn(j)×P(p, j). The input waveform data Sn(j) is at a high level and has the second value 1 when j is 4 and 5. The input waveform data Sn(j) is at a low level and has the first value −1 in the other cases.

The covariance value is calculated as follows:

$$C(p)=(1/N)\times\Sigma(Sn(j)\times P(p,j))-Sm\times Pm$$

As such, the total sum Σ(Sn(j)×P(p, j)) of the value Sn(j)×P(p, j), which is the product of the data values at the sampling point, is divided by the number N of samples. However, in this embodiment, the covariance value itself is not needed, but is used to detect the optimal value (the maximum value in this embodiment) of the covariance value by using comparison, which will be described below. Therefore, the division by N may be omitted. The omission of the division makes it possible to reduce the amount of calculation. In this embodiment, since the average value of the predicted waveform data P(p, j) is 0, Sm×Pm is also 0.

Therefore, in this embodiment, Σ(Sn(j)×P(p, j)) is used as the covariance value C(p). In other embodiments, Σ(Sn(j)×P(p, j)) may also be used as the covariance value C(p).

When the parameter p is smaller than 20 (No in Step S190), the parameter p increases (Step S192), and the process returns to Step S186. When covariance values C(1) to C(20) are acquired for all of the parameters p (Yes in Step S190), the process ends.

Figure 18:
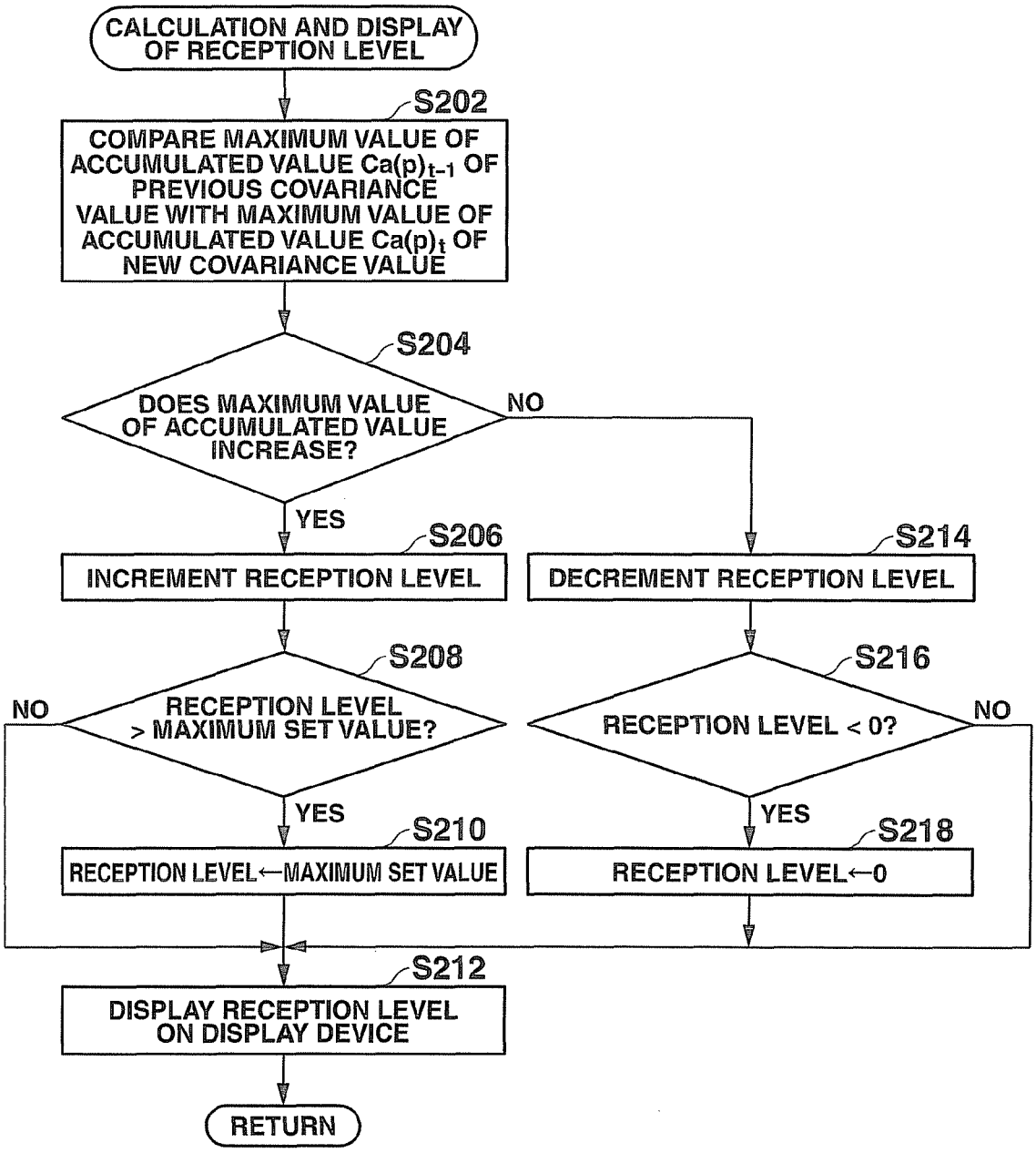
FIG. 18 is a flowchart illustrating an example of a process of calculating and displaying a reception level according to the second embodiment.

Returning to the flowchart of FIG. 16, the CPU 11 controls the reception level calculator 127 to calculate the value of the reception level and displays the value of the reception level on a liquid crystal display device (Step S166). FIG. 18 is a flowchart illustrating a process of calculating and displaying the reception level according to this embodiment.

As shown in FIG. 18, the reception level calculator 127 compares the maximum value $Camax_{t-1}$ (t is a parameter indicating the current process) of the accumulated value $Ca(p)_{t-1}$ (p=1 to 20) of the covariance value obtained by the previous process with the maximum value $Camax_t$ of the accumulated value $Ca(p)_t$ of the covariance value obtained in Step S164 (Step S202) and determines whether the current maximum value $Camax_t$ is more than the previous maximum value $Camax_{t-1}$, that is, $Camax_t > Camax_{t-1}$ (Step S204).

If the determination result in Step S204 is "Yes," the reception level calculator 127 increases the value of the reception level (Step S206). Then, it is determined whether the value of the reception level is more than a maximum set value (for example, 5) (Step S208). If it is determined that the value of the reception level is more than the maximum set value (Yes in Step S208), the reception level calculator 127 sets the value of the reception level to the maximum set value (Step S210). Then, the reception level calculator 127 outputs the calculated value of the reception level to the CPU 11. The CPU 11 displays the value of the reception level on a screen of the liquid crystal display device (Step S212). The level value (0 to 5) may be displayed as a bar on the screen of the liquid crystal display device (for example, see reference numeral 1401 in FIGS. 20A to 20E), or a corresponding value may be displayed on the screen without any change.

If the determination result in Step S204 is "No," the reception level calculator 127 decreases the value of the reception level (Step S214). Then, it is determined whether the value of the reception level is less than 0, which is a minimum set value (Step S216). If it is determined that the value of the reception level is less than the minimum set value (Yes in Step S216), the reception level calculator 127 sets the value of the reception level to 0 (Step S218). Then, the process returns to Step S212.

Figure 19A:
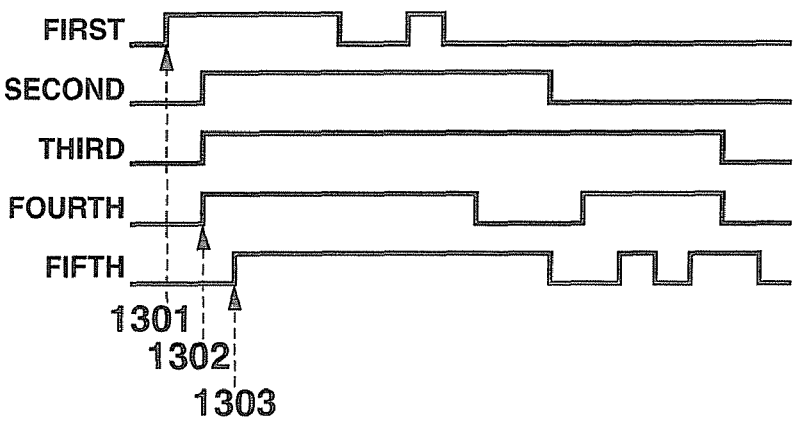
FIG. 19A is a diagram illustrating an example of a portion of the input waveform data based on JJY and having a large amount of noise mixed therewith.
Figure 19B:
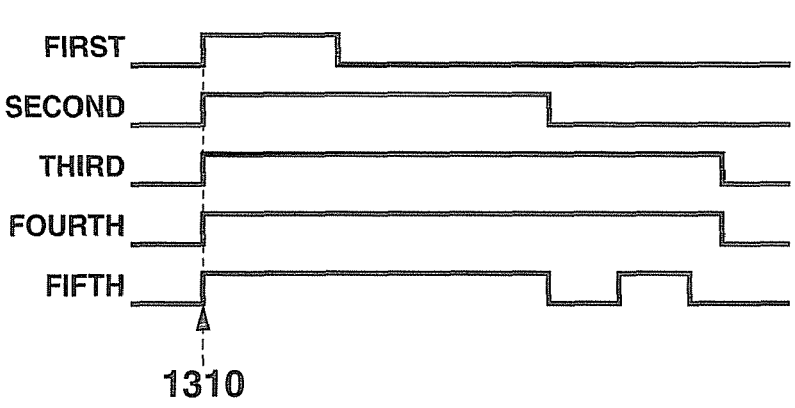
FIG. 19B is a diagram illustrating an example of a portion of the input waveform data based on JJY and having a small amount of noise mixed therewith.
Figure 20A:
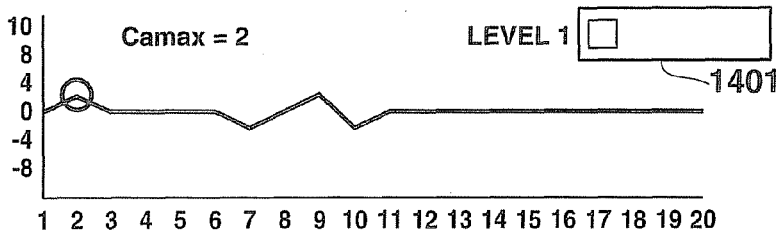
FIG. 20A is a diagram illustrating a first process of calculating the accumulated value of the covariance value based on the first input waveform data shown in FIG. 19A.
Figure 20B:
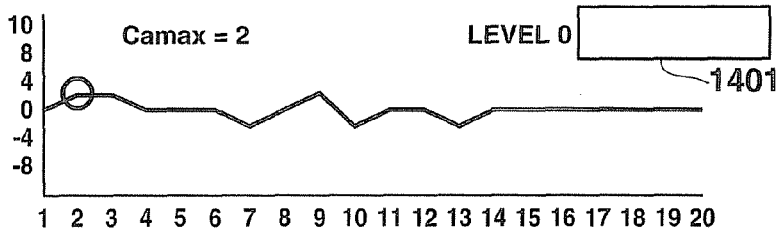
FIG. 20B is a diagram illustrating a second process of calculating the accumulated value of the covariance value based on the second input waveform data shown in FIG. 19A.
Figure 20C:
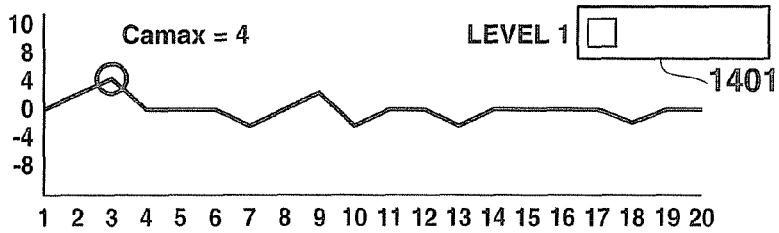
FIG. 20C is a diagram illustrating a third process of calculating the accumulated value of the covariance value based on the third input waveform data shown in FIG. 19A.
Figure 20D:
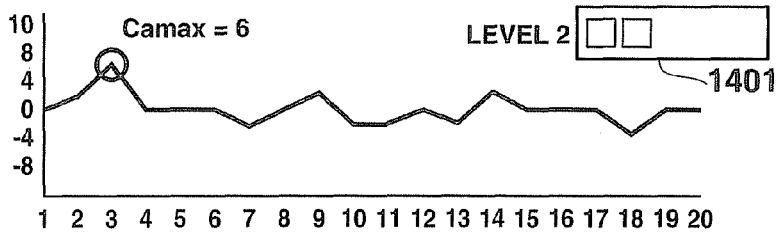
FIG. 20D is a diagram illustrating a fourth process of calculating the accumulated value of the covariance value based on the fourth input waveform data shown in FIG. 19A.
Figure 20E:
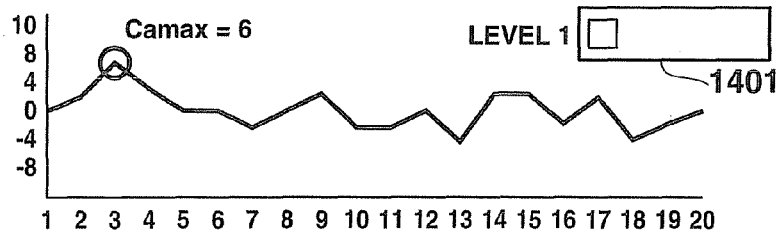
FIG. 20E is a diagram illustrating a fifth process of calculating the accumulated value of the covariance value based on the fifth input waveform data shown in FIG. 19A.

FIGS. 19A and 19B are diagrams illustrating examples of the input waveform data based on JJY. FIGS. 19A and 19B each show only a portion of the input waveform data corresponding to one second from the head. In FIGS. 19A and 19B, the input waveform data is acquired plural times (five times in the drawings). FIG. 19A shows the input waveform data with a large amount of noise and FIG. 19B shows the input waveform data with a small amount of noise. As shown in FIG. 19B, in the input waveform data with a small amount of noise, for example, the first rising edge positions are substantially aligned with each other (see an arrow 1310). On the other hand, as shown in FIG. 19A, in the input waveform data with a large amount of noise, for example, the first rising edge positions are not aligned with each other (see arrows 1301 to 1303).

FIGS. 20A to 20E are diagrams illustrating examples of the accumulated value of the covariance value based on the input waveform data shown in FIG. 19A. In FIGS. 20A to 20E, for convenience of explanation, the covariance value C(p) is calculated based on a portion of the input waveform data corresponding to one second shown in FIG. 19A and the accumulated value Ca(p) of the covariance value in each process is shown as a histogram. In FIGS. 20A to 20E, the maximum values Camax of the accumulated values in the first to fifth processes are 2, 2, 4, 6, and 6, respectively. The values of the reception levels based on the maximum values of the accumulated values are 1, 0, 1, 2, and 1, respectively, as shown in the drawings.

FIGS. 21A to 21E are diagrams illustrating examples of the accumulated value of the covariance value based on the input waveform data shown in FIG. 19B. In FIGS. 21A to 21E, for convenience of explanation, the covariance value C(p) is calculated based on a portion of the input waveform data corresponding to one second shown in FIG. 19B and the accumulated value Ca(p) of the covariance value in each process is shown as a histogram. In FIGS. 21A to 21E, the maximum values Camax of the accumulated values in the first to fifth processes are 2, 4, 6, 8, and 10, respectively. The values of the reception levels based on the maximum values of the accumulated values are 1, 2, 3, 4, and 5, respectively, as shown in the drawings.

As such, in this embodiment, the accumulated value of the covariance value in each process is referred to, and when the maximum value of the accumulated value increases, the value of the reception level increases. The maximum value of the accumulated value of the covariance value indicates the maximum degree of alignment between the rising edges of the input waveform data and the predicted waveform data. Therefore, a large maximum value of the accumulated value indicates that the signal with a relatively small amount of noise is received. In addition, the increase of the maximum value of the accumulated value indicates that the signal with a relatively small amount of noise is repeatedly received. In this embodiment, when the maximum value of the accumulated value increases, the level of the reception level increases.

Figure 22:
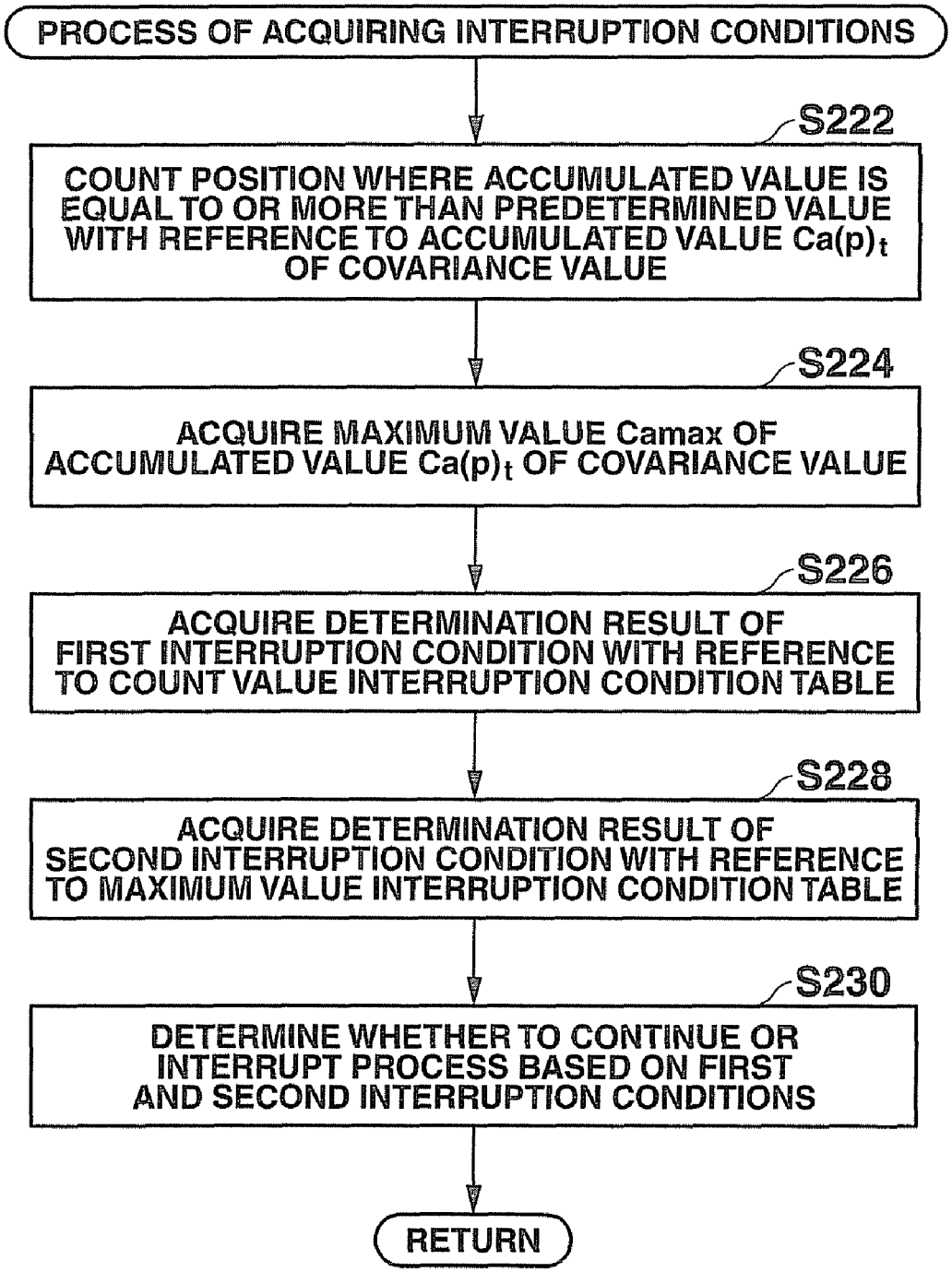
FIG. 22 is a flowchart illustrating an example of a process of acquiring interruption conditions according to the second embodiment.
Figure 24A:
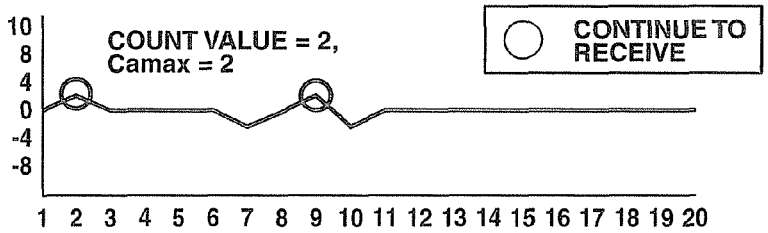
FIG. 24A is a diagram illustrating a first process of calculating the accumulated value of the covariance value based on the input waveform data shown in FIG. 19A.
Figure 24B:
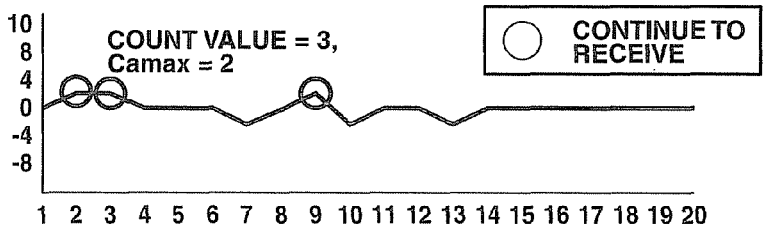
FIG. 24B is a diagram illustrating a second process of calculating the accumulated value of the covariance value based on the input waveform data shown in FIG. 19A.
Figure 24C:
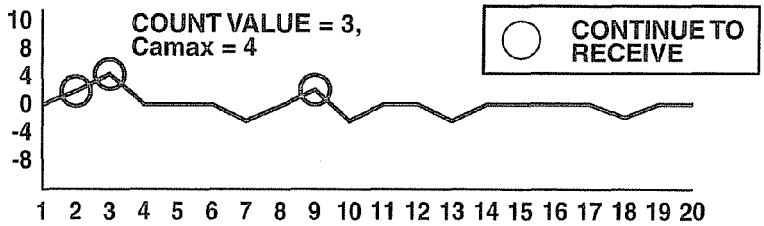
FIG. 24C is a diagram illustrating a third process of calculating the accumulated value of the covariance value based on the input waveform data shown in FIG. 19A.
Figure 24D:
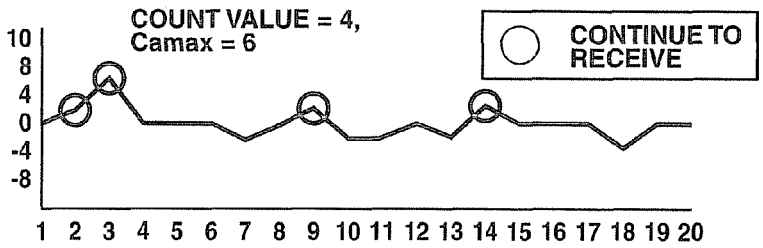
FIG. 24D is a diagram illustrating a fourth process of calculating the accumulated value of the covariance value based on the input waveform data shown in FIG. 19A.
Figure 24E:
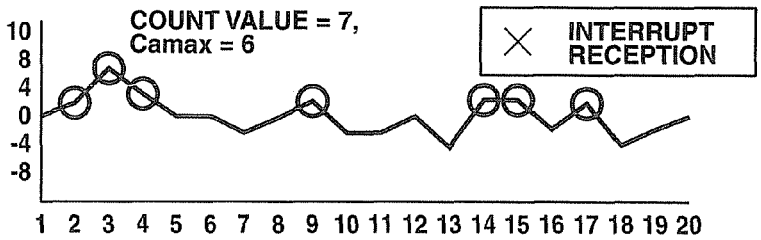
FIG. 24E is a diagram illustrating a fifth process of calculating the accumulated value of the covariance value based on the input waveform data shown in FIG. 19A.
Figure 25A:
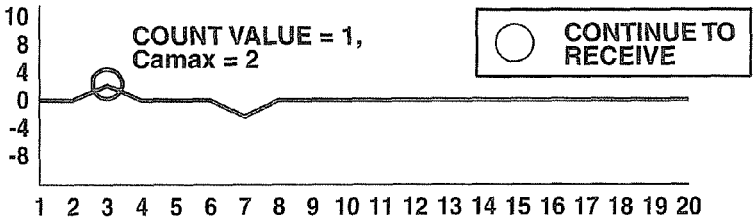
FIG. 25A is a diagram illustrating a first process of calculating the accumulated value of the covariance value based on the input waveform data shown in FIG. 19B.
Figure 25B:
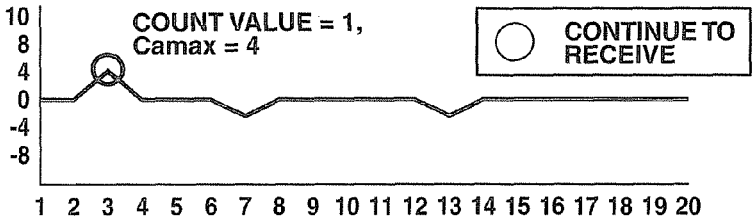
FIG. 25B is a diagram illustrating a second process of calculating the accumulated value of the covariance value based on the input waveform data shown in FIG. 19B.
Figure 25C:
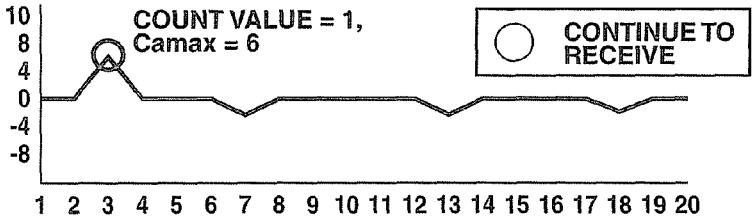
FIG. 25C is a diagram illustrating a third process of calculating the accumulated value of the covariance value based on the input waveform data shown in FIG. 19B.
Figure 25D:
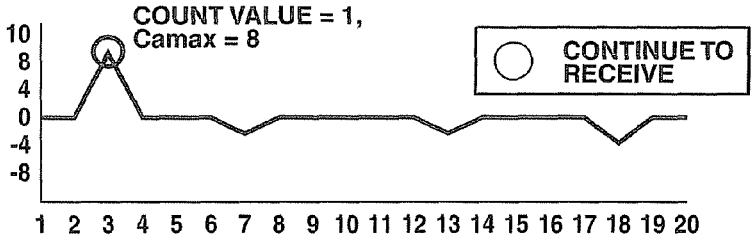
FIG. 25D is a diagram illustrating a fourth process of calculating the accumulated value of the covariance value based on the input waveform data shown in FIG. 19B.
Figure 25E:
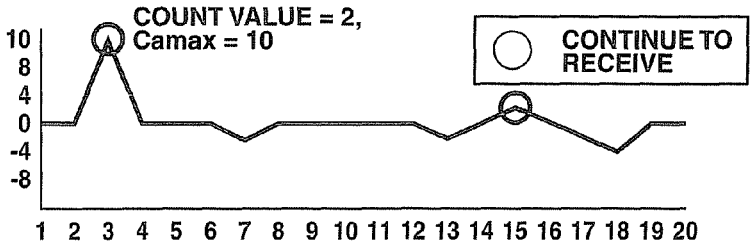
FIG. 25E is a diagram illustrating a fifth process of calculating the accumulated value of the covariance value based on the input waveform data shown in FIG. 19B.

Returning to the flowchart of FIG. 16, the interruption determinator 128 performs a process of acquiring interruption conditions according to instructions from the CPU 11 (Step S168). FIG. 22 is a flowchart illustrating an example of the process of acquiring the interruption conditions according to this embodiment. As shown in FIG. 22, the interruption determinator 128 counts the number of positions p where the accumulated value is more than a predetermined value indicating a positive correlation with reference to the accumulated value $Ca(p)_t$ of the covariance value (Step S222). Similar to the calculation and display of the reception level, when a portion of the input waveform data corresponding to one second is considered, the predetermined value may be, for example, 2. In this embodiment, a covariance value of 2 indicates that the rising edge positions of the pulses between a portion of the input waveform data corresponding to one second and a portion of the predicted waveform data corresponding to one second are aligned with each other. Therefore, when the accumulated value of the covariance value is 2, it is expected that the rising edge positions of the pulses are aligned with each other in any process in any one of the first time to five time.

The interruption determinator 128 acquires the maximum value Camax of the accumulated value Ca(p) of the covariance value (Step S224). Then, the interruption determinator 128 acquires the determination result of a first interruption condition with reference to a count value interruption condition table stored in the ROM 14 (Step S226). FIG. 23A is a diagram illustrating an example of the structure of the count value interruption condition table according to this embodiment. As shown in FIG. 23A, a count value interruption condition table 1700 includes count values (table count value) stored so as to be associated with the number of processes.

When the count value calculated in Step S222 is equal to or more than the table count value associated with the number of processes shown in FIG. 23A, the determination result of the first interruption condition by the interruption determinator 118 indicates "stop." On the other hand, when the count value calculated in Step S222 is less than the table count value, the determination result of the first interruption condition indicates "continuation."

In the count value interruption condition table shown in FIG. 23A, the number of positions p where the accumulated value is equal to or more than a predetermined value indicates a variation in the predicted waveform data with the rising edges aligned with the rising edge of the input waveform data. That is, as the count value (the number of items) increases, the number of predicted waveform data items with the rising edges aligned with the rising edge of the input waveform data increases. It is preferable that the count value (the number of items) not increase regardless of the number of processes repeated. That is, it is most preferable that the accumulated value at only one position increase but the accumulated values at the other positions not increase. In this case, the count value does not increase.

It is allowed that, as the number of repeated processes increases, the count value increases within a predetermined range. The table count value within the allowable range is stored in the count value interruption condition table 1700.

The interruption determinator 118 acquires the determination result of a second interruption condition with reference to a maximum value interruption condition table stored in the ROM 14 (Step S228). FIG. 23B is a diagram illustrating an example of the structure of the maximum value interruption condition table according to this embodiment. As shown in FIG. 23B, maximum values (table maximum values) are stored in a maximum value interruption condition table 1710 so as to be associated with the number of processes.

When the maximum value Camax acquired in Step S224 is equal to or less than the table maximum value associated with the number of processes shown in FIG. 23B, the determination result of the second interruption condition by the interruption determinator 118 indicates "stop." On the other hand, when the maximum value Camax acquired in Step S224 is more than the table maximum value, the determination result of the second interruption condition indicates "continuation."

The maximum value Camax acquired in Step S224 indicates the degree of alignment between the rising edges of the predicted waveform data and the input waveform data. It is preferable that the maximum value increase as the process is repeated.

In this embodiment, it is assumed that, as the process is repeated, the maximum value increases. The minimum allowable value of the increasing maximum value is stored in the maximum value interruption condition table 1710. When the acquired maximum value is equal to or less than the allowable value, the process is stopped.

Then, the interruption determinator 118 determines whether to continue or stop a final second synchronization process based on the determination result of the first interruption condition and the determination result of the second interruption condition (Step S230). In this embodiment, when the determination result of the first interruption condition or the determination result of the second interruption condition indicates "stop," the interruption determinator 118 determines that the process is stopped. When it is determined that the process can be continuously performed by the interruption condition acquiring process shown in FIG. 22 (Step S170 in FIG. 16), the CPU 11 determines whether the number of processes of calculating the covariance value (Step S164) reaches a predetermined value (Step S172). If the determination result in Step S172 is "No," the process returns to Step S164.

If the determination result in Step S170 is "No," the process of detecting the second pulse position ends. In this case, the process of detecting the minute head position or the process of decoding the codes, which will be described below, is not performed.

FIGS. 24A to 24E are diagrams illustrating examples of the accumulated value of the covariance value based on the input waveform data shown in FIG. 19A, which are the same as the examples shown in FIGS. 20A to 20E. Therefore, in FIGS. 24A to 24E, for convenience of explanation, the covariance value C(p) is calculated based on a portion of the input waveform data corresponding to one second shown in FIG. 19A and the accumulated value $Ca(p)_t$ of the covariance value in each process is shown as a histogram. In FIGS. 24A to 24E, the count values in the first to fifth processes are 2, 3, 3, 4, and 7, respectively, and the maximum values Camax of the accumulated values are 2, 2, 4, 6, and 6. In this example, in the fifth process, the count value is 7, "continuation" is written in the first interruption condition field. In addition, the maximum value Camax is 6 and "stop" is written in the second interruption condition field. Therefore, finally, in the fifth process, it is determined in Step S230 (see FIG. 22) that second synchronization is stopped.

FIGS. 25A to 25E are diagrams illustrating examples of the accumulated value of the covariance value based on the input waveform data shown in FIG. 19B, which are the same as the examples shown in FIGS. 21A to 21E. Therefore, in FIGS. 25A to 25E, for convenience of explanation, the covariance value C(p) is calculated based on a portion of the input waveform data corresponding to one second shown in FIG. 19B and the accumulated value $Ca(p)_t$ of the covariance value in each process is shown as a histogram. In FIGS. 25A to 25E, the count values in the first to fifth processes are 1, 1, 1, 1, and 2, respectively, and the maximum values Camax of the accumulated values are 2, 4, 6, 8, and 10. Therefore, in each of the five processes, it is determined that second synchronization must be continuously performed.

If the determination result in Step S172 of FIG. 16 is "Yes," the correlation value comparator 126 compares the accumulated values Ca(1) to Ca(20) of the correlation values, and finds the optimal value (in this case, the maximum value) C(x) (Step S174). The CPU 11 receives the optimal value C(x) and determines whether the optimal value is valid (Step S176). The determination process in Step S176 is the same as that in the first embodiment.

That is, the maximum value C(x) of the obtained covariance values C(p) is a predicted waveform with the highest correlation. However, in the covariance value obtained from a sample with insufficient parameters, there is a possibility that the maximum value erroneously appears due to an unexpected factor caused by noise. In order to exclude this case, for example, in Step S176, the following criteria are set to prevent an error in detection:

(1) The number of input waveform data used to calculate the covariance is equal to or more than a predetermined value;

(2) The value of x indicating C(x) appears plural times, the values of x appearing plural times are equal to each other, and the frequency of the value of x is higher than that of other values (x is a mode value);

(3) The values of x that continuously appear a predetermined number of times or more are equal to each other (the continuity of a mode value);

(4) The variance of C(p) is equal to or less than a predetermined value; and (5) Kurtosis or the degree of distortion which is the amount of statistics of C(p), or an evaluation function equivalent thereto is calculated and it is determined whether the calculation result reaches a predetermined value.

When the criteria (1) to (3) are applied, a set of Steps S164 to S174 in FIG. 16 is performed plural times.

A method of determining validity is not limited to the above-mentioned method. The average value of the covariance values or the standard deviation may be used and the covariance value smaller than the average value may be determined to be insignificant even though the covariance value is the local maximum value. In addition, the level of significance (for example, 5 percent) that is generally used in statistics may be used.

If it is determined that the optimal value C(x) is valid (Yes in Step S176), the CPU 11 determines the changing point of the signal level of the predicted waveform data indicated by the optimal value C(x), that is, the position where the first value indicating a low level changes to the second value indicating a high level, to be the second pulse position (Step S178). The CPU 11 stores the information of the second pulse position in the RAM 15. The second pulse position is used in, for example, a process of detecting a minute head position, which will be described below.

Similar to the first embodiment shown in FIG. 4, when the detection of the second pulse position, that is, when second synchronization ends, the minute head position is detected. The detection of the minute head position is also referred to as minute synchronization. In JJY, as shown in FIG. 5 in the first embodiment, in a one-minute frame, a code indicating the position marker P0 is arranged at the end and a code indicating the marker M is arranged at the head. Each of the position marker P0 and the marker M is a code P with a 20% duty.

Therefore, in the minute synchronization, predicted waveform data with 2 unit time lengths is generated in which the codes P with a 20% duty are continuously arranged. In addition, 60 input waveform data items each having 2 unit time lengths (2 seconds) starting at the second pulse position (that is, the head position of the second) are generated. It is possible to obtain 60 correlation values (covariance values) C(1) to C(60) by calculating the correlation value between the predicted waveform data and each of the 60 input waveform data items.

Figure 26:
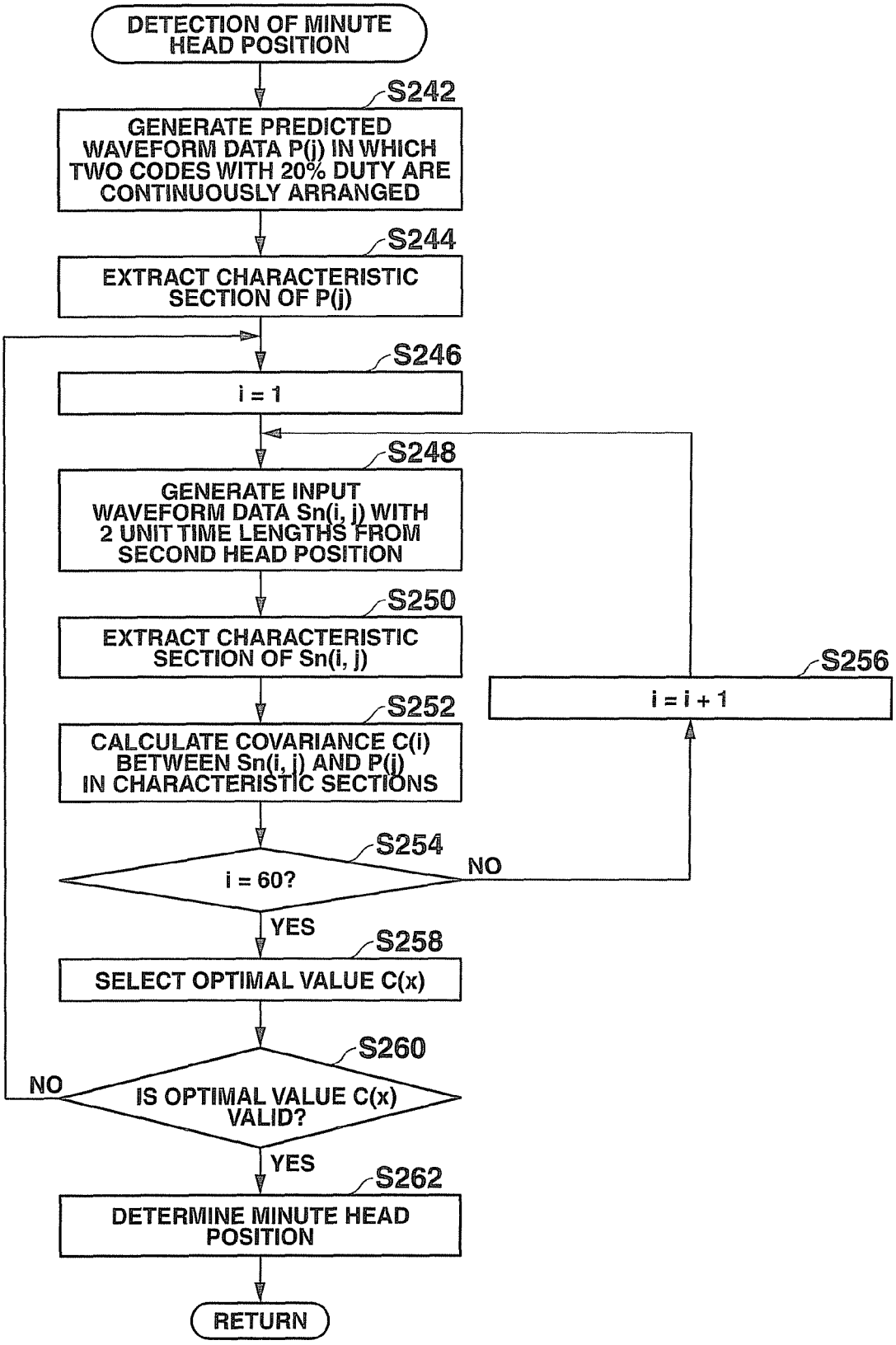
FIG. 26 is a flowchart illustrating a process of detecting a minute head position (minute synchronization) according to the second embodiment.
Figure 27:
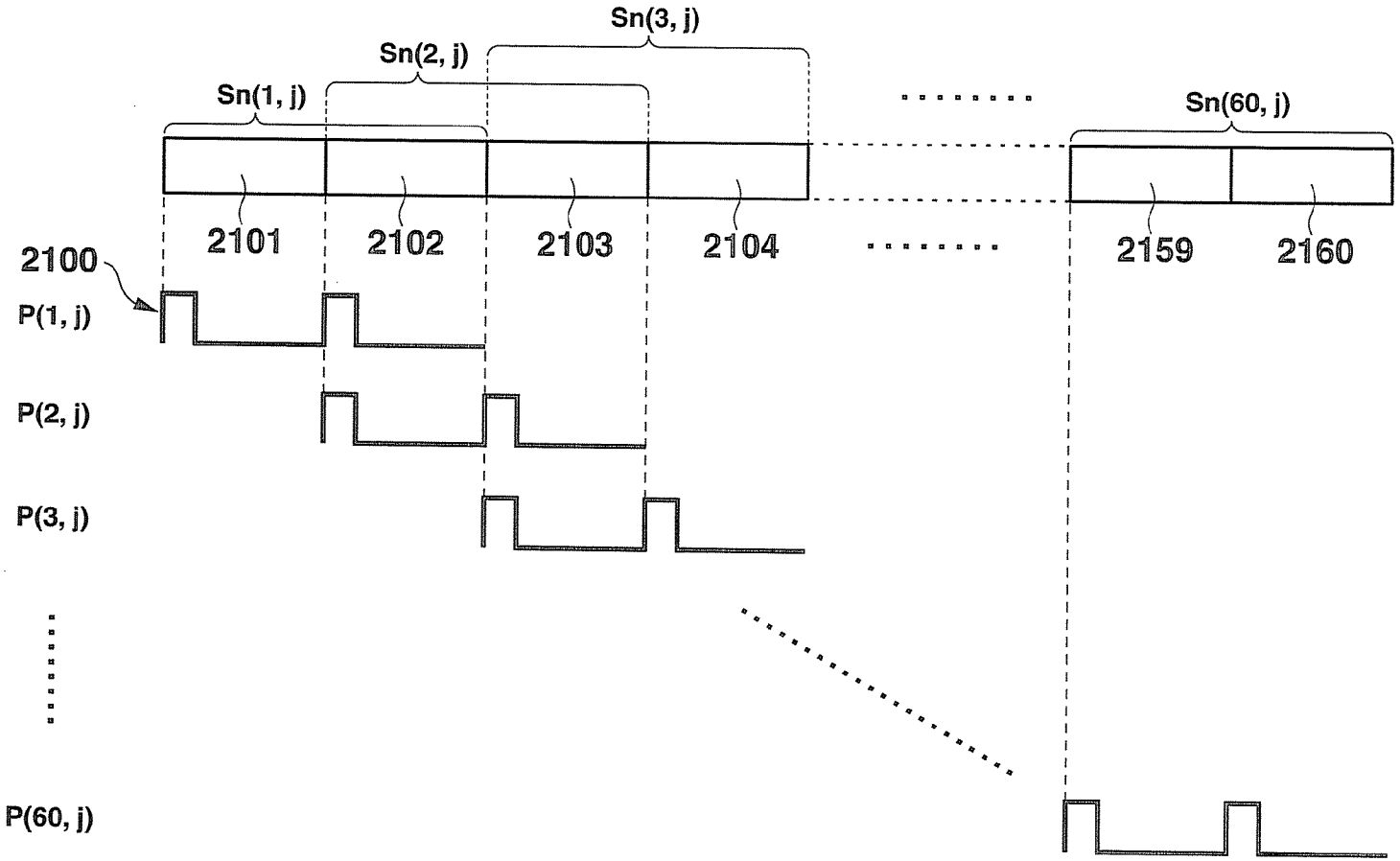
FIG. 27 is a diagram illustrating input waveform data and predicted waveform data in the process of detecting the minute head position according to the second embodiment.

FIG. 26 is a flowchart illustrating the process of detecting the minute head position (minute synchronization) according to this embodiment in more detail. FIG. 27 is a diagram illustrating the input waveform data and the predicted waveform data in the detection of the minute head position according to this embodiment. The second pulse position (the head position of the second) has already been set by the second synchronization.

The predicted waveform data generator 123 generates predicted waveform data P(j) with 2 unit time lengths in which two codes P are arranged, under the control of the CPU 11 (Step S242). As shown in FIG. 27, the predicted waveform data (see reference numeral 2100) has two waveforms, in each of which the predicted waveform data is at a high level during a first period of 200 ms (20%) and is at a low level during the remaining period in the unit time length (one second).

Figure 28A:
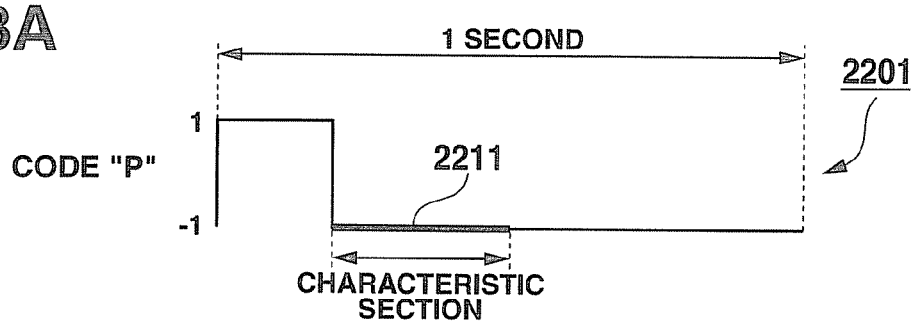
FIG. 28A is a diagram illustrating a characteristic section of a code P of JJY.
Figure 28B:
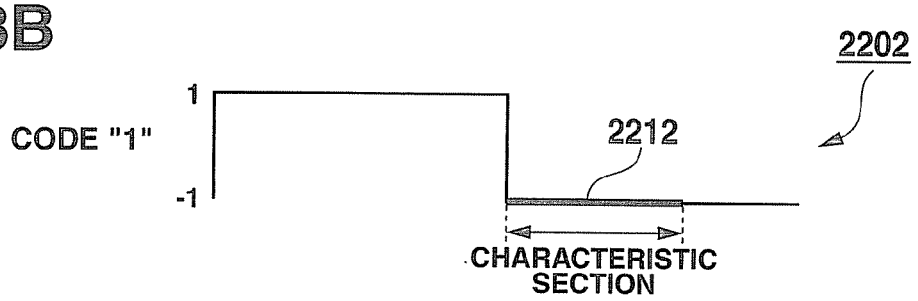
FIG. 28B is a diagram illustrating a characteristic section of a code 1 of JJY.
Figure 28C:
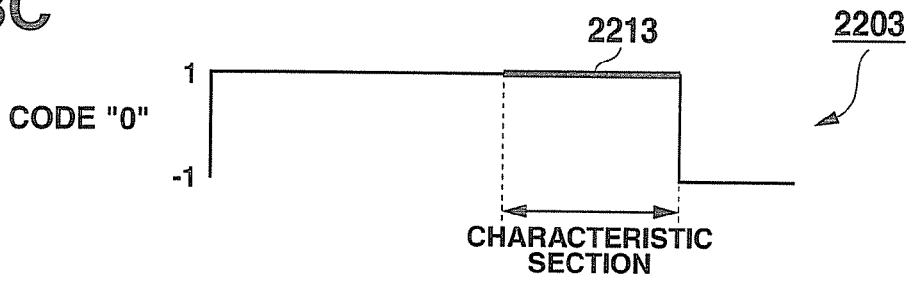
FIG. 28C is a diagram illustrating a characteristic section of a code 0 of JJY.

The predicted waveform data generator 123 extracts a data value (characteristic value) in the characteristic section of the generated predicted waveform data P(j) (Step S244). FIGS. 28A, 28B, and 28C are diagrams illustrating the characteristic section of each code in JJY. As shown in FIGS. 28A, 28B, and 28C, a code P (see reference numeral 2201), a code 1 (see reference numeral 2202), and a code 0 (see reference numeral 2203) have sections in which they have different eigenvalues. For example, the code P is at a low level and has a data value −1 which is peculiar to the code P and is different from the data value of other codes in the section (see reference numeral 2211) from 200 ms to 500 ms.

Therefore, in this embodiment, in the code P, the section from 200 ms to 500 ms is a characteristic section. In the predicted waveform data P(j) shown in FIG. 27, when the number of samples with a unit time length is 20, j is 1 to 40. In this case, the predicted waveform data generator 123 extracts only data values in the section from 200 ms to 500 ms and the section from 1200 ms to 1500 ms, that is, P(5) to P(10) and P(25) to P(30) as the characteristic values.

In the code decoding process, the characteristic value of the characteristic section of the predicted waveform data is also used, which will be described below. In the code decoding process, it is necessary to determine whether the code is 0 or 1. However, since the minute synchronization has been completed, it is not necessary to determine whether the code is P.

As shown in FIG. 28B, the code 1 is at a low level and has a data value −1 which is peculiar to the code 1 and is different from the data value of other codes in the section (see reference numeral 2212) from 500 ms to 800 ms. As shown in FIG. 28C, the code 0 is at a high level and has a data value 1 which is peculiar to the code 0 and is different from the data value of other codes in the section (see reference numeral 2213) from 500 ms to 800 ms. Therefore, in the codes 1 and 0, the section from 500 ms to 800 ms is the characteristic section. The characteristic value of the code 1 in the characteristic section is −1 and the characteristic value of the code 0 in the characteristic section is 1.

Then, a parameter i for specifying the second head position is initialized (Step S246 in FIG. 26) and the waveform extractor 124 generates input waveform data Sn(i, j) with 2 unit time lengths (2 seconds) from the second head position from the received waveform data buffer 122 under the control of the CPU 11 and the like (Step S248). In addition, the waveform extractor 124 extracts a data value in the characteristic section of Sn(i, j) so as to correspond to the characteristic section of the predicted waveform data (Step S250). When i is 1, the waveform extractor 124 extracts Sn(1, 5) to Sn(1, 10) and Sn(1, 25) to Sn(1, 30) as the data values in the characteristic sections. In general, Sn(i, 5) to S(i, 10) and Sn(i, 25) to S(i, 30) are extracted as data in the characteristic sections.

Then, the correlation value calculator 125 calculates a correlation value (covariance value) C(i) between the input waveform data Sn(i, j) in the characteristic section and the predicted waveform data P(j) in the characteristic section (Step S252). Since the covariance value is calculated by the same method as that in the second synchronization process, only a calculation relating to the characteristic section will be described. In this embodiment, in the input waveform data, Sn(i, 5) to S(i, 10) and Sn(i, 25) to S(i, 30) are extracted as the data values in the characteristic sections. In the predicted waveform data, P(5) to P(10) and P(25) to P(30) are extracted. Therefore, when the covariance value C(i) is calculated, in the total sum $\Sigma Sn(i, j) \times P(j)$ of the products between the data values of the input waveform data and the data values of the predicted waveform data, j is 5 to 10 and 25 to 30, respectively. As described with reference to FIG. 28A, the data value (characteristic value) of the code P in the characteristic section is −1. Therefore, the predicted waveform data P(j) (j=5 to 10 and 25 to 30) in the predicted section is −1. When the total sum of the products is calculated, Sn(i, j) (j=5 to 10 and 25 to 30) are calculated and multiplied by a characteristic value −1.

Then, the CPU 11 determines whether the parameter i is 60 (Step S254). When the determination result in Step S254 is "No," the parameter i increases (Step S256). Then, in Step S248, the waveform extractor 124 acquires the input waveform data Sn(i, j) with 2 unit time lengths (2 seconds) from the next second head position (that is, the position that is 20 samples away from the previous second head position of the input waveform data) under the control of the CPU 11 and the like. Then, the covariance value between the newly acquired input waveform data Sn(i, j) and the predicted waveform data P(j) is calculated.

As shown in FIG. 27, the input waveform data Sn(1, j) includes data items 2101 and 2102 with 2 unit time lengths from the second head position. The next input waveform data Sn(2, j) includes data items 2102 and 2103 with 2 unit time lengths from the next second head position. As such, Sn(n−1, j) and Sn(n, j) are data having a positional deviation of a unit time length (one second) between the second head positions. The last input waveform data Sn(60, j) includes data items 2159 and 2160 with 2 unit time lengths that are 59 seconds away from the first input waveform data Sn(1, j).

The data values in the characteristic sections of the input waveform data S(1, j), S(2, j), S(3, j), S(60, j) and the data values in the characteristic sections of the predicted waveform data are used to calculate the covariance values. In FIG. 27, for convenience of illustration, the predicted waveform data used to calculate the covariance values together with Sn(1, j), Sn(2, j), Sn(3, j), . . . , and Sn(60, j) are P(1, j), P(2, j), P(3, j), . . . , and P(60, j). However, actually, the predicted waveform data P(1, j), P(2, j), P(3, j), . . . , and P(60, j) have the same value P(j).

When all of the correlation values (covariance values) C(1) to C(60) are acquired, the correlation value comparator 126 compares the covariance values C(1) to C(60) to find the optimal value (in this case, the maximum value) C(x) (Step S258). The CPU 11 receives the optimal value C(x) and determines whether the optimal value is valid (Step S260). The process of determining whether the optimal value is valid is performed by the same method as that in the second synchronization process (Step S176 in FIG. 16). When criteria (1) to (3) are applied to the process of determining whether the optimal value is valid in Step S176, a set of Steps S246 to S258 is performed plural times.

If the determination result in Step S260 is "No," the process returns to Step S246 and the waveform extractor 124 acquires input waveform data which is stored in the received waveform data buffer 22, under the control of the CPU 11 and the like.

If the determination result in Step S260 is "Yes," the CPU 11 determines the head position of the second code P in the input waveform data indicated by the optimal value C(x), that is, the second position where the level changes from a low level to a high level, to be the head position of the minute (Step S262). The CPU 11 stores the information of the head position of the minute in the RAM 15.

Similar to the first embodiment shown in FIG. 4, at the time of the detection of the minute head position, that is, when the minute synchronization ends, codes, such as minute, hour, and day codes, are decoded. In a minute decoding process, one's place of the minute and ten's place of the minute are decoded. In an hour decoding process, one's place of the hour and ten's place of the hour are decoded. Next, the decoding of one's place of the minute will be described.

Figure 29:
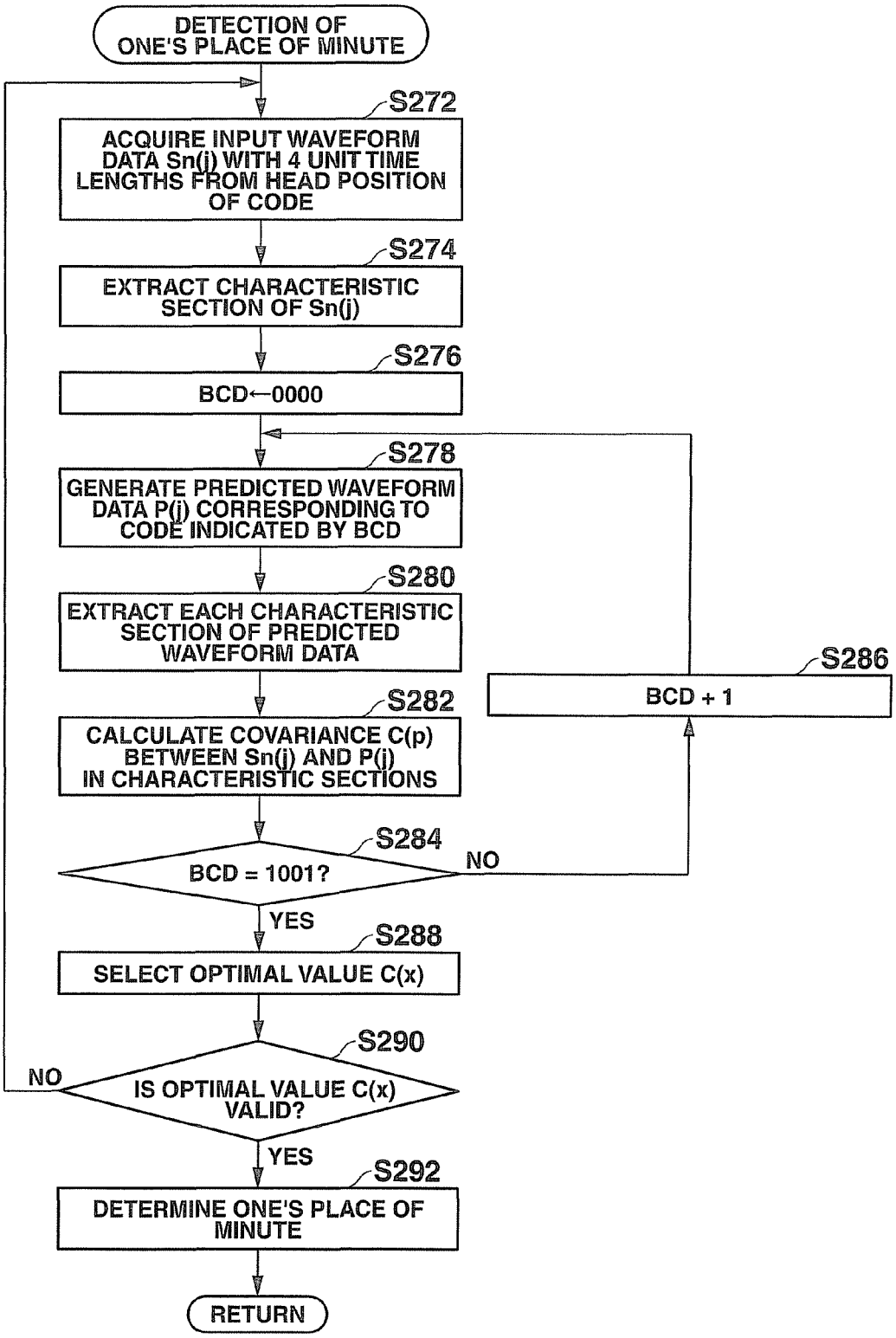
FIG. 29 is a flowchart illustrating an example of a process of detecting one's place of minute according to the second embodiment.

FIG. 29 is a flowchart illustrating an example of a process of detecting one's place of the minute according to the embodiment. In this embodiment, the waveform extractor 124 acquires input waveform data Sn(j) with 4 unit time lengths from the head position of a code (one's place of the minute) (Step S272). When there are 20 samples per second, 80 samples (j=1 to 80) of input waveform data can be obtained.

Then, the waveform extractor 124 extracts the characteristic section of the input waveform data Sn(j) (Step S274). As shown in FIGS. 28B and 28C, in the codes 1 and 0 based on JJY, the section from 500 ms to 800 ms from the head of the code is the characteristic section. Therefore, the characteristic sections of the input waveform data Sn(j) have the data values of Sn(10) to Sn(16), Sn(30) to Sn(36), Sn(50) to Sn(56), and Sn(70) to Sn(76).

Then, a parameter BCD for specifying one's place of the minute indicated by BCD is initialized to "0000" (Step S276). The predicted waveform data generator 123 generates predicted waveform data P(j) with 4 unit time lengths corresponding to the code indicated by the parameter BCD (Step S278). In addition, the predicted waveform data generator 123 extracts the characteristic sections of the predicted waveform data P(j) (Step S280). The characteristic sections have the data values of P(10) to P(16), P(30) to P(36), P(50) to P(56), and P(70) to P(76).

Then, the correlation value calculator 125 multiplies the data values of the characteristic sections of Sn(j) by the corresponding data values (characteristic values) of the characteristic sections of P(j) and calculates the covariance values C(p) based on the multiplied values (Step S282). The number of characteristic sections of the predicted waveform data P(j) is 4 and the data value of each of the characteristic sections is 1 or 0. Therefore, the product of the data values can be obtained as follows:

(the characteristic values of the characteristic sections (P(10) to P(16))×Σ(Sn(10) to Sn(16))+

(the characteristic values of the characteristic sections (P(30) to P(36))×Σ(Sn(30) to Sn(36))+

(the characteristic values of the characteristic sections (P(50) to P(56))×Σ(Sn(50) to Sn(56))+

(the characteristic values of the characteristic sections (P(70) to P(76))×Σ(Sn(70) to Sn(76)).

Therefore, it is not necessary to calculate the total sum of the products of all of the data values.

When the parameter BCD is less than "1001" (No in Step S284), the parameter BCD increases (Step S286) and the process returns to Step S278. If the determination result in Step S284 is "Yes," the process proceeds to Step S288.

When all of the correlation values (covariance values) C(1) to C(10) are acquired, the correlation value comparator 126 compares the covariance values C(1) to C(10) to find the optimal value (in this case, the maximum value) C(x) (Step S288). The CPU 11 receives the optimal value C(x) and determines whether the optimal value is valid (Step S290). The process of determining whether the optimal value is valid is performed by the same method as that in the second synchronization process (Step S176 in FIG. 16). If the determination result in Step S290 is "No," the process returns to Step S272. On the other hand, if the determination result in Step S290 is "Yes," the CPU 11 determines the value (BCD) of the predicted waveform data indicated by the optimal value C(x) to be one's place of the minute (Step S292). The CPU 11 stores the one's place of the minute in the RAM 15.

Similar to the first embodiment shown in FIG. 4, other codes, such as ten's place of the minute, one's place and ten's place of the hour, and day, may be decoded by the same process as the decoding of the one's place of the minute. When time information including, for example, the current date, day, and time is acquired by the code decoding process, the CPU 11 stores the obtained time information in the RAM 15. In addition, the CPU 11 corrects the current time measured by the internal timer 17 based on the current time obtained from the code and displays the obtained current time on the display device 13.

The second synchronization, the minute synchronization, and the code decoding process of the signal of JJY have been described above. In other standards, such as WWVB and MSF, the second synchronization, the minute synchronization, and the decoding of codes may also be performed.

Next, second synchronization in WWVB or MSF will be described. As shown in FIGS. 6D to 6K in the first embodiment, in WWVB or MSF, a signal changes from a high level to a low level at the head of the second. As such, it is considered that the predicted waveform data used in JJY is applied to the signal that falls at the head. FIGS. 11A to 11C related to the first embodiment are diagrams illustrating the covariance value between the input waveform data and the predicted waveform data according to the second embodiment. In FIG. 11A, the input waveform data Sn(j) changes from a low level to a high level at the head position of the second (see reference numeral 1100). The maximum value of the covariance value C between the predicted waveform data P(j) that has the first value corresponding to a low level before the rising point and has the second value corresponding to a high level after the rising point and the input waveform data Sn(j) is 2. For ease of explanation, the covariance value is simply the sum of the products between the data values of the predicted waveform data and the data values of the input waveform data.

As shown in FIG. 11B, input waveform data S'n(j) that changes from a high level to a low level at the head position of the second (second pulse position) is considered. The minimum value of the covariance value C between the input waveform data S'n(j) and the predicted waveform data P(j) is −2. That is, as in WWVB or MSF, for data that changes from a high level to a low level at the head position of the second, in order to detect the head position of the second, the minimum value of the covariance value only need to be selected as the optimal value in the process of detecting the second pulse position as shown in FIG. 16, particularly, at Step S174.

In the calculation of the reception level (FIG. 18), it is determined in Step S204 whether the minimum value of the accumulated value is reduced. In the process of acquiring the interruption conditions (FIG. 22), the minimum value of a negative covariance value or the minimum value of a negative accumulated value is used and the following steps are changed.

In Step S222, the position where the accumulated value $Ca(p)_t$ is equal to or less than a negative predetermined value is counted. In Step S224, the minimum value Camin of the accumulated value $Ca(p)_t$ is acquired. The minimum value interruption condition table is referred to in Step S228 and the minimum value of the accumulated value for each number of processes is stored. In Step S230, when the minimum value Camin acquired in Step S224 is equal to or more than a table minimum value, the determination result of the second interruption condition by the interruption determinator 118 indicates "stop." On the other hand, when the minimum value Camin acquired in Step S224 is less than the table minimum value, the determination result of the second interruption condition indicates "continuation."

Alternatively, as in WWVB or MSF, in order to detect the head position of the second in the data that changes from a high level to a low level at the head position of the second, another predicted waveform data, which is the inverted data of the above-mentioned predicted waveform data P(p, j), may be used. In FIG. 11C, in the first embodiment, the input waveform data S'n(j) is the same as that shown in FIG. 11B. Predicted waveform data P'(j) is the inverted data of the predicted waveform data P(j) shown in FIG. 11B. In this case, the covariance value C(2), a value when p is 2, is the maximum value. Therefore, the head position of the second may be determined based on the predicted waveform data P(2) and the input waveform data Sn(2).

In this embodiment, the interruption determinator 128 determines whether to continue or stop the detection of the second pulse position based on the correlation value that is repeatedly calculated by the correlation value calculator 125 between the input waveform data generated by the input waveform data generator 121 and the predicted waveform data. The optimal value of the correlation value indicates the highest positive correlation. Therefore, it is possible to determine the amount of noise in the input waveform data with reference to the optimal value and perform accurate second synchronization using the input waveform data having a relatively small amount of noise mixed therewith.

In this embodiment, when the degree of the positive correlation indicated by the optimal value of the correlation value which is repeatedly calculated is less than a predetermined value, the interruption determinator 128 stops the detection of the second pulse position. For the optimal value indicating the highest correlation, the decrease in the degree of the positive correlation means that a large amount of noise is mixed with the input waveform data. Therefore, in this case, the second synchronization is stopped to prevent an inappropriate second head position from being detected.

In this embodiment, the interruption determinator 128 accumulates the optimal value of the correlation value to obtain an accumulated value and determines whether the degree of the positive correlation is less than a predetermined value with reference to the maximum value interruption condition table 1710 including the threshold value of the accumulated value corresponding to the number of times the process is repeated. When the optimal value is the maximum value, for the input waveform data having a relatively small amount of noise mixed therewith, the accumulated value of the optimal value (maximum value) increases as the number of processes repeated increases. Therefore, the minimum allowable value of the increasing maximum value is stored in the maximum value interruption condition table 1710 shown in FIG. 23B. When the acquired maximum value is equal to or less than the allowable value, the process is stopped. In this way, it is possible to appropriately stop the second synchronization without performing a complicated operation.

In this embodiment, when the correlation value is calculated, the interruption determinator 128 counts a predetermined correlation value indicating a positive correlation and determines whether to continue or stop the detection of the second pulse position based on the count value. The number, of predetermined correlation values indicating the positive correlation indicates the number of positions that are likely to be determined to be the second pulse position. Therefore, as the number of correlation values increases, the number of positions that are likely to be determined to be the second pulse position increases. As a result, it is difficult to detect an accurate second pulse position. Therefore, the number of positive correlation values is counted and it is determined whether to continue or stop the process based on the count value. In this way, it is possible to reliably specify an accurate second pulse position.

In this embodiment, the interruption determinator 128 refers to the count value interruption condition table 1700 including the threshold value of the count value determined by the number of times the correlation value calculating process is repeated, and interrupts the detection of the second pulse position when the count value is equal to or more than a predetermined threshold value of the count value. It is allowed that, as the number of processes repeated increases, the count value increases within a predetermined range. The count value within the allowable range is stored in the count value interruption condition table. When the count value is equal to or more than that stored in the table, the detection of the second head position is stopped. In this way, it is possible to reliably specify an accurate second pulse position.

In this embodiment, the reception level calculator 127 calculates a level value indicating the reception level of the standard time radio wave based on the optimal value of the correlation value which is repeatedly calculated, and displays the level value as, for example, in the form of a bar on the screen of the display device 13. Therefore, the user of an apparatus including the time information-acquiring apparatus, for example, an electronic watch can appropriately check the conditions of the standard time radio wave received by the apparatus.

The reception level calculator 127 increases or decreases the level value based on whether the degree of the positive correlation in the accumulated value increases or decreases, with reference to the optimal value of the accumulated value. In this way, it is possible to appropriately achieve the increase or the decrease of the level value of the reception level over time.

In this embodiment, the predicted waveform data generator 123 generates a plurality of predicted waveform data in which each sampling point has the first value indicating a low level in any one of predetermined sections before and after the changing point of the signal level, the second value indicating a high level in the other one of the predetermined sections before and after the changing point, the third value in the sections other than the predetermined sections, and the heads of the data (level change point) are shifted by a predetermined period of time. The correlation value calculator 125 calculates the correlation value between the predicted waveform data and the input waveform data.

By setting the predicted waveform data to the values described above, when the rising edge position of the predicted waveform data and the rising edge position of the input waveform data are aligned with each other, a value indicating higher positive correlation can be output. Therefore, it is possible to accurately specify the second head position.

In this embodiment, the head position of the minute in the time code is specified based on the second pulse position specified by the above-mentioned process and the signal levels before and after the head position of the time code, and the codes included in the time code are acquired. Then, the values of codes including the day, hour, and minute codes forming the time code are acquired based on values indicated by the codes. Thereafter, the current time is calculated based on the acquired values of the codes. Therefore, it is possible to correct the time obtained by the internal timer 17 with the calculated current time.

The second embodiment may be modified as follows. For example, in the above-described embodiment, when the position of one second pulse is detected, the predicted waveform data having a following configuration is used. That is, the predicted waveform data has the first value −1 indicating a low level in a predetermined section (temporally old side) before a rising point from a low level to a high level, the second value 1 indicating a high level in a predetermined section (temporally new side) after the rising point, and the third value indicating 0 in sections other than the predetermined sections before and after the rising point. However, the invention is not limited thereto. It may be possible to use, for example, predicted waveform data in which a code forming the time code, for example, code 0 is repeated.

Figure 30:
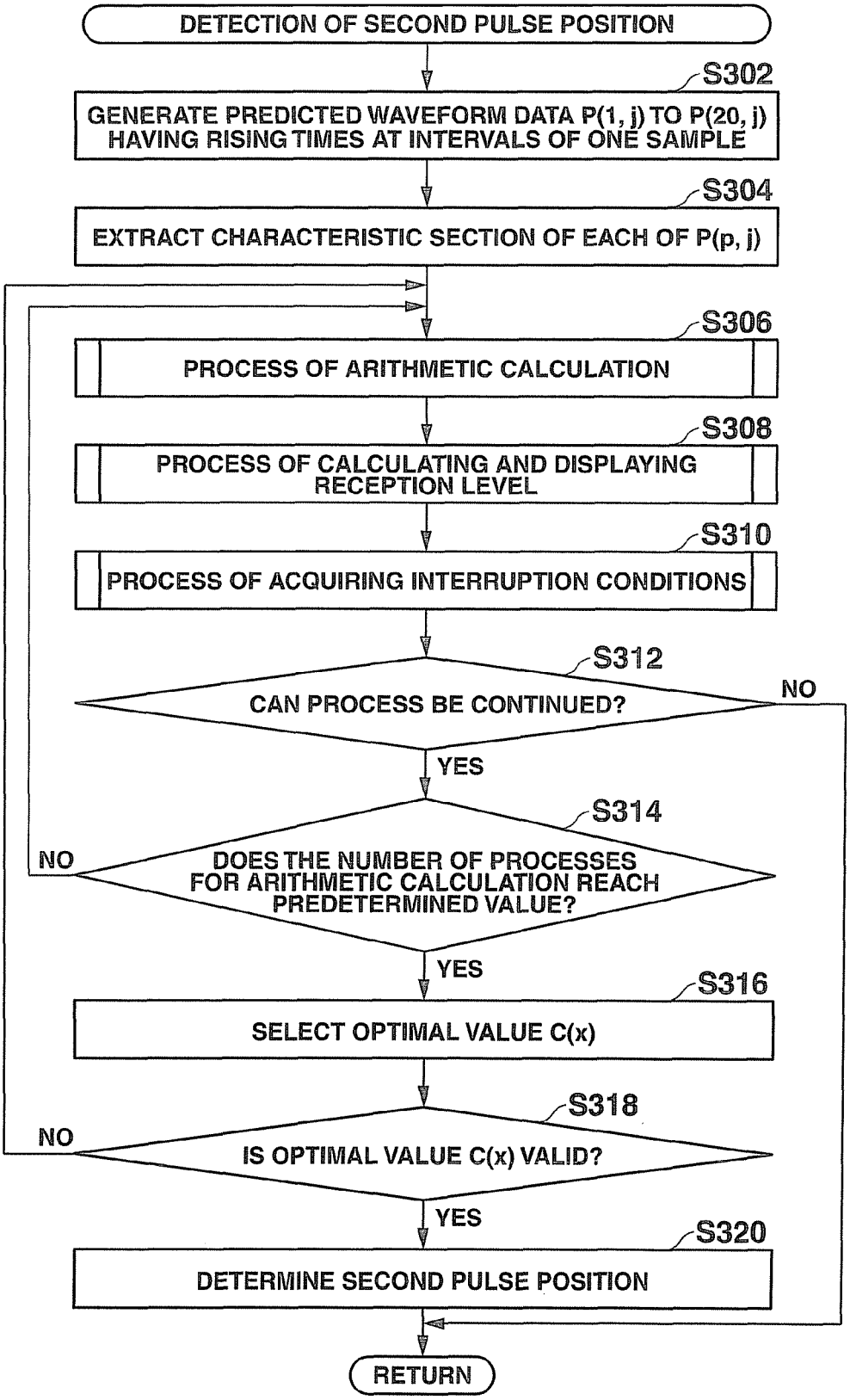
FIG. 30 is a flowchart illustrating the process of detecting the second pulse position (second synchronization) according to the second embodiment.

FIG. 30 is a flowchart illustrating a process of detecting a second pulse position (second synchronization) according to a modification of the second embodiment in more detail. As shown in FIG. 30, the CPU 11 controls the predicted waveform data generator 123 to generate 20 predicted waveform data items P(1, j) to P(20, j) with 4 unit time lengths (4 seconds) in which the head positions of the code 0 (where the level changes from a low level to a high level) are shifted by 50 ms (Step S302).

Then, the predicted waveform data generator 123 extracts the characteristic sections of the predicted waveform data items P(1, j) to P(20, j) (Step S304). As described above, in the code 0, the section from 500 ms to 800 ms from the head of the code is the characteristic section as shown in FIG. 28C and the characteristic value of the characteristic section is 1. Therefore, the characteristic section extractor 128 detects the position of the section from 500 ms to 800 ms from the head of the code 0 in each of the predicted waveform data items P(1, j) to P(20, j).

For example, the characteristic sections of the predicted waveform data P(1, j) have the data values of P(1, 10) to P(1, 16), P(1, 30) to P(1, 36), P(1, 50) to P(1, 56), and P(1, 70) to P(1, 76).

The characteristic sections of the predicted waveform data P(2, j) have the data values of P(1, 11) to P(1, 17), P(1, 31) to P(1, 37), P(1, 51) to P(1, 57), and P(1, 71) to P(1, 77).

In general, the characteristic sections of the predicted waveform data (p, j) have the data values of P(p, 10+(p−1)) to P(p, 16+(p−1)), P(p, 30+(p−1)) to P(p, 36+(p−1)), P(p, 50+(p−1)) to P(p, 56+(p−1)), and P(p, 70+(p−1)) to P(p, 76+(p−1)). When the value j on the right side of P(p, j) is greater than 80, j=j−80 is established. In addition, the data value (characteristic value) of the characteristic section is 1 as shown in FIG. 28C.

Figure 31:
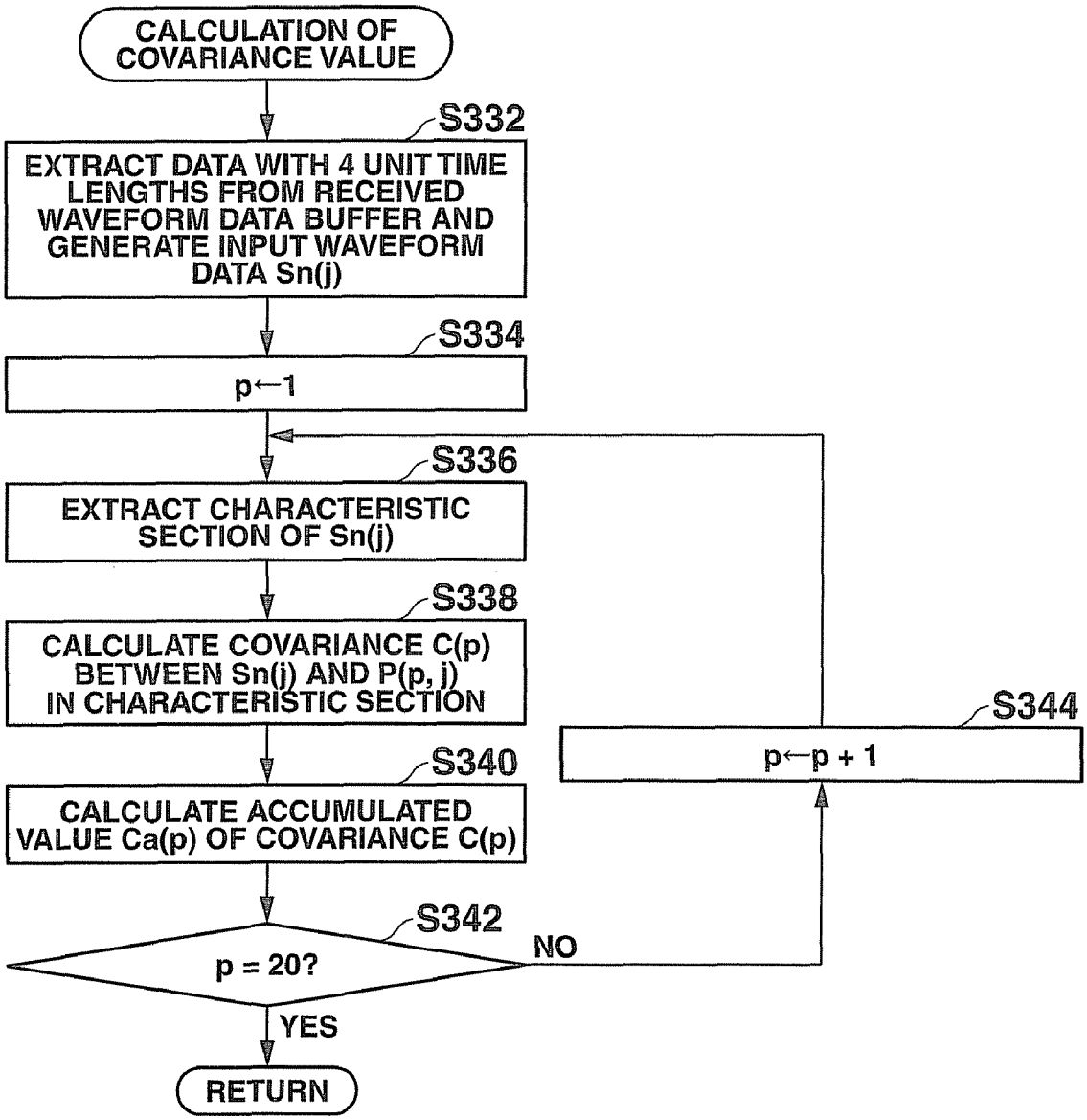
FIG. 31 is a flowchart illustrating an example of the process of calculating the covariance value in the process of detecting the second pulse position according to the second embodiment.

Then, a process of calculating the covariance value is performed (Step S306). FIG. 31 is a flowchart illustrating an example of the process of calculating the covariance value according to the modification of the second embodiment. As shown in FIG. 31, the CPU 11 controls the waveform extractor 124 to extract data with 4 unit time lengths (4 seconds) from the received waveform data buffer 122 and generate input waveform data Sn(j) (Step S332). In the second embodiment, since data of 20 samples per second is acquired, Sn(j) is data including 80 samples. Then, the CPU 11 initializes the parameter p for specifying the predicted waveform data to 1 (Step S334).

Then, the waveform extractor 124 acquires the data values of the characteristic sections of the input waveform data Sn(1) corresponding to the characteristic sections of the predicted waveform data (Step S336). In Step S336, the data values of the characteristic sections of the input waveform data Sn(j) corresponding to the predicted waveform data P(p, j) are Sn(10+(p−1)) to Sn(16+(p−1)), Sn(30+(p−1)) to Sn(36+(p−1)), Sn(50+(p−1)) to Sn(56+(p−1)), and Sn(70+(p−1)) to Sn(76+(p−1)).

Then, the correlation value calculator 127 multiplies the data values of the characteristic sections of Sn(j) by the corresponding data values (characteristic values) of the characteristic sections of P(p, j) and calculates the covariance values based on the result of multiplication (Step S338). As described above, the data values of the characteristic sections of the predicted waveform data P(p, j) are 1. Therefore, in the multiplication of the data values of the characteristic sections of Sn(j) and the corresponding data values (characteristic values) of the characteristic sections of P(p, j), the data values of the characteristic sections of Sn(j) only need to be accumulated to calculate ΣSn(j). In addition, the correlation value calculator 127 calculates the accumulated value Ca(p) of the covariance value C(p) (Step S340).

When the parameter p is smaller than 20 (No in Step S342), the parameter p increases (Step S344) and the process returns to Step S336. If the determination result in Step S342 is "Yes," the process ends.

In FIG. 30, a process of calculating and displaying the reception level (Step S308) and a process of acquiring the interruption conditions (Step S310) subsequent to the process of calculating the covariance value (Step S306) are the same as Steps S166 and S168 in the second embodiment shown in FIG. 16, respectively. In addition, Steps S312 to S320 are the same as Steps S170 to S178 shown in FIG. 16, respectively.

As described above, in the modification of the second embodiment, the predicted waveform data generator 133 generates a plurality of predicted waveform data with waveforms including a predetermined code in the time code (for example, the code 0) and the correlation value calculator 125 calculates the correlation value between the predicted waveform data and the input waveform data. The use of the predicted waveform data makes it possible to reliably specify accurate second synchronization.

In the process of calculating and displaying the reception level according to the second embodiment, the maximum values of the accumulated values Ca(p) of the covariance values are compared with each other to determine whether the maximum value increases. When the maximum value is determined, another index value V(p)=Ca(p−1)+C(p)+C(p+1) considering the previous and next accumulated values may be used to determine whether the maximum value of the index value V(p) increases.

In the process of calculating and displaying the reception level according to the second embodiment, the maximum value of the accumulated value Ca(p) may be divided by the number of processes and then normalized, and the ratio of the normalized value to a predetermined value corresponding to the maximum level may be used as the level value of the reception level.

In the process of acquiring the interruption conditions according to the second embodiment, the maximum value Camax of the accumulated value is acquired and the second interruption condition is determined based on the acquired maximum value. However, the invention is not limited thereto. The second interruption condition may be determined based on another index value V(p)=Ca(p−1)+C(p)+C(p+1) considering the previous and next accumulated values.

In the second embodiment, when "stop" is determined from the first interruption condition or the second interruption condition, the detection of the second head position is stopped. However, the invention is not limited thereto. For example, when "stop" is determined from both the first interruption condition and the second interruption condition, the detection of the second head position may be stopped.

In the second embodiment, the first value indicating a low level is −1, the second value indicating a high level is 1, and the third value other than the first and second values is 0. However, the invention is not limited thereto. For example, the first value and the second value may be as follows.

(1) When the first value appears from the input waveform data and the first value appears from the predicted waveform data, or when the second value appears from the input waveform data and the second value appears from the predicted waveform data, the values are multiplied to obtain a predetermined positive value indicating a positive correlation. That is, when the same value appears from the input waveform data and the predicted waveform data, a predetermined positive value is obtained.

(2) When the first value appears from the input waveform data and the second value appears from the predicted waveform data, or when the second value appears from the input waveform data and the first value appears from the predicted waveform data, the values are multiplied to obtain a predetermined negative value indicating a negative correlation. That is, when different values appear from the input waveform data and the predicted waveform data, a predetermined negative value is obtained. It is preferable that the absolute values of the predetermined positive value and the predetermined negative value are the same.

The third value may not be 0. However, the third value should not affect the correlation value, such as the covariance value, when it is multiplied by the first value or the second value.

In the second embodiment, the covariance value is used as the correlation value, but the invention is not limited thereto. For example, a residual, which is the total sum of the absolute values of differences, may be used as the correlation value. Alternatively, a mutual correlation coefficient may be used instead of the covariance or the residual.

Next, a third embodiment will be described. A block diagram illustrating the structure of a radio wave timepiece according to the third embodiment is the same as that in the first embodiment shown in FIG. 1 and thus a description thereof will be omitted.

However, the CPU 11 (see FIG. 1) reads a program stored in the ROM 14 at predetermined timing or in response to an operation signal input from the input device 12, expands the read program in the RAM 15, and transmits instructions or data to each unit of the radio wave timepiece 10 based on the program. Specifically, for example, the third embodiment differs from the above-described embodiments in that the CPU 11 performs a process of controlling the receiver 16 to receive a standard time radio wave at a predetermined time interval, determining a transmitting station transmitting the standard time radio wave (the kind of standard time radio wave signal) from digital data based on the signal obtained from the receiver 16, specifying a code string included in the standard time radio wave signal, and correcting the current time measured by an internal timer 17 based on the code string, or a process of transmitting the current time measured by the internal timer 17 to the display device 13. In this embodiment, predicted waveform data with one or more unit time lengths and a predetermined format is generated, and the predicted waveform data is compared with input waveform data which is obtained from the standard time radio wave received by the receiver to determine the transmitting station and specify the head of the second.

In this embodiment, for example, the predicted waveform data and the input waveform data are compared with each other to detect the head of the minute and the values of various kinds of codes including hour, minute, and date codes. When the date and time are specified, it is possible to calculate an error in the internal timer 17 and correct the current time measured by the internal timer 17.

The ROM 14 (see FIG. 1) stores, for example, a system program or an application program for operating the radio wave timepiece 10 and implementing a predetermined function. The programs for implementing the predetermined function also include a program for controlling the signal comparator 18C (see FIG. 32) in order to perform a process of determining the transmitting station and a process of detecting a second pulse position and a program for controlling the signal comparator 18C in order to perform a process of detecting a minute head position or a code decoding process, which will be described below. The RAM 15 is used as a work area of the CPU 11 and temporarily stores, for example, the program or data read from the ROM 14 and data processed by the CPU 11.

A block diagram illustrating an example of the structure of a receiver according to the third embodiment is substantially the same as FIG. 2 in the first embodiment and thus a detailed description thereof will be omitted.

Figure 32:
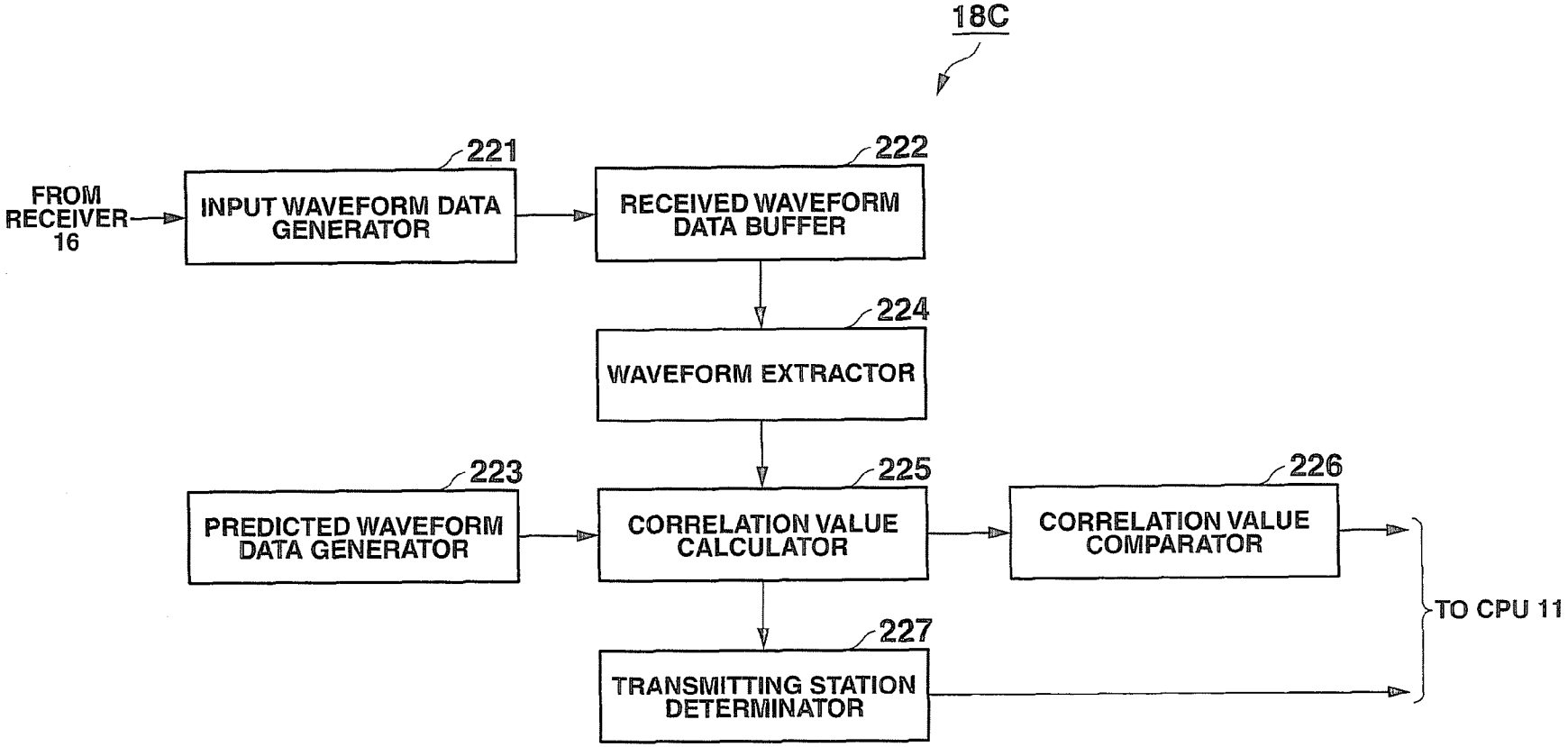
FIG. 32 is a block diagram illustrating the structure of a signal comparator according to a third embodiment.

In this embodiment, for example, the predicted waveform data and the input waveform data are compared with each other to detect the head of the minute and the values of various kinds of codes including hour, minute, and date codes. When the date and time are specified, it is possible to calculate an error in the internal timer 17 and correct the current time measured by the internal timer 17. The receiver 16 includes, for example, an antenna circuit or a detector. The receiver 16 obtains a demodulated signal from the standard time radio wave received by the antenna circuit and outputs the signal to the signal comparator 18C (FIG. 32). The internal timer 17 includes an oscillating circuit. The internal timer 17 counts clock signals output from the oscillating circuit to measure the current time and outputs data of the current time to the CPU 11.

FIG. 32 is a block diagram illustrating the structure of a signal comparator 18C according to the third embodiment. As shown in FIG. 32, the signal comparator 18C according to the third embodiment includes an input waveform data generator 221, a received waveform data buffer 222, a predicted waveform data generator 223, a waveform extractor 224, a correlation value calculator 225, a correlation value comparator 226, and a transmitting station determinator 227. The portions other than the transmitting station determinator 227 are the same as those in the first embodiment.

The operations of the input waveform data generator 221 and the received waveform data buffer 222 are the same as those of the input waveform data generator 21 and the received waveform data buffer 22 according to the first embodiment.

The predicted waveform data generator 223 generates predicted waveform data, which is a comparison target, with a predetermined time length. This predicted waveform data is used in each process, which will be described below. The predicted waveform data generated by the predicted waveform data generator 223 will be described in each of a process of detecting a second pulse position, a process of detecting a minute head position, and a code decoding process. The operations of the waveform extractor 224, the correlation value calculator 225, and the correlation value comparator 226 are the same as those of the waveform extractor 24, the correlation value calculator 25, and the correlation value comparator 26 according to the first embodiment.

The transmitting station determinator 227 determines a transmitting station transmitting the standard time radio wave signal based on the covariance value calculated by the correlation value calculator 225 and outputs the information thereof to the CPU 11.

Figure 33:
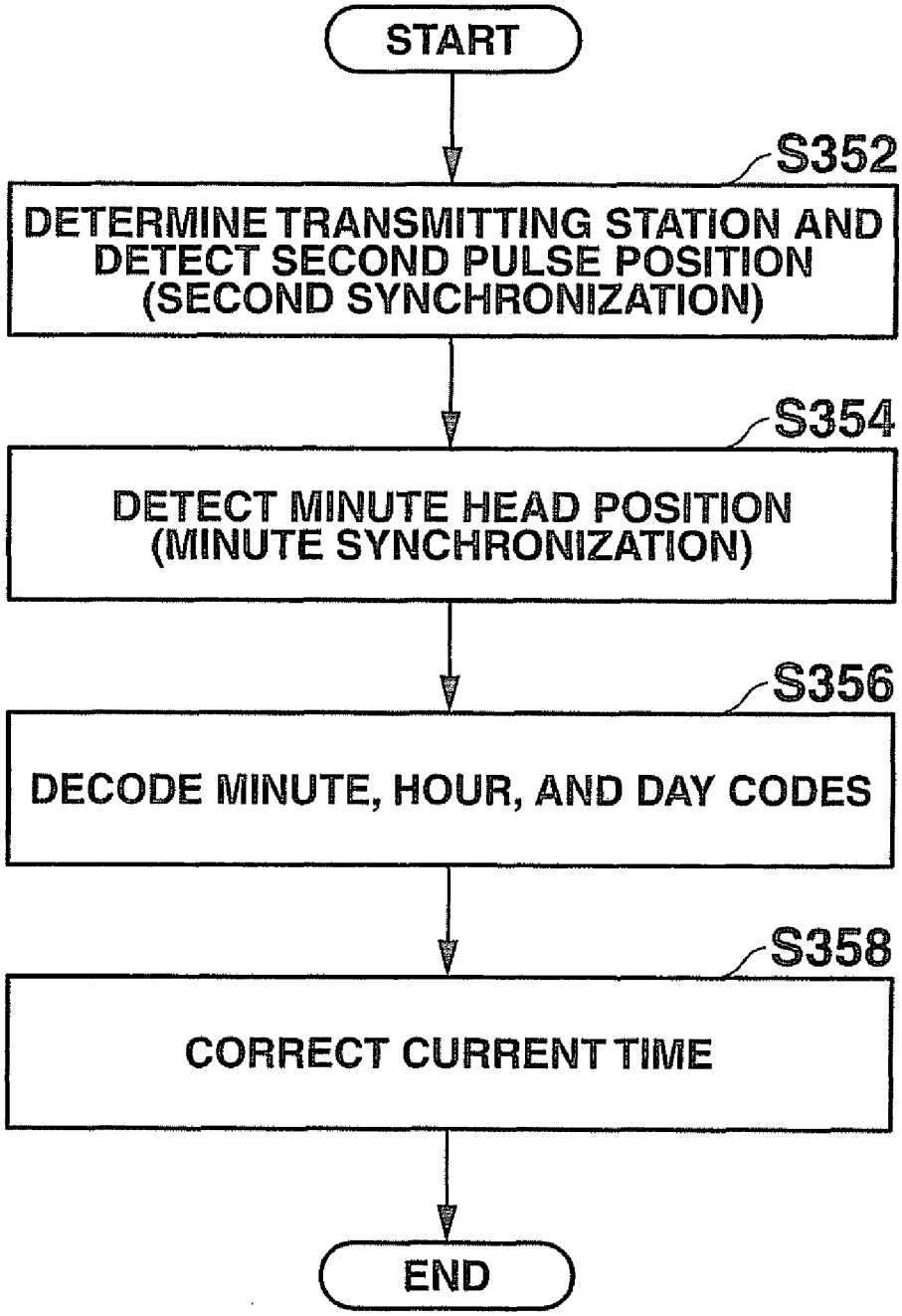
FIG. 33 is a flowchart schematically illustrating a process performed in a radio wave timepiece according to the third embodiment.

FIG. 33 is a flowchart schematically illustrating a process performed in the radio wave timepiece according to the third embodiment. The process shown in FIG. 33 is mainly performed by the CPU 11 and the signal comparator 18 (see FIG. 1) based on instructions from the CPU 11. As shown in FIG. 33, the CPU 11 and the signal comparator 18 (hereinafter, referred to as "CPU 11 and the like" for convenience of explanation) determine the transmitting station and detect the second pulse position (Step S352). The process of detecting the second pulse position is also referred to as second synchronization. As shown in FIGS. 5A and 53 in the first embodiment, in the standard time radio wave signal based on the JJY standard, predetermined codes are sequentially transmitted in the order determined by the standard. In the standard time radio wave signal based on the JJY standard, codes indicating P, 1, and 0 with a unit time length of 1 second are continuously arranged. In the standard time radio wave, one frame is 60 seconds and includes 60 codes. In addition, in the standard time radio wave, position markers P1, P2, . . . or a marker M is arranged at an interval of ten seconds. It is possible to know the head of the frame which is arranged at an interval of 60 seconds, that is, the head position of the minute by detecting a portion in which a position marker P0 arranged at the end of the frame and the marker M arranged at the head of the frame are continuously arranged.

Examples of the codes based on the JJY, WWVB, and MSF standards are the same as those shown in FIGS. 6A to 6K in the first embodiment and thus a description thereof will be omitted.

The standard time radio wave based on the JJY standard, the standard time radio wave based on the WWVB standard, and the standard time radio wave based on the MSF standard which are transmitted from the transmitting stations in Saga, Japan each have a transmission frequency of 60 kHz. Therefore, it is difficult to determine the kind of standard time radio wave by changing a tuning frequency of the receiver. Therefore, in the third embodiment, the kind of standard time radio wave, that is, the transmitting station that transmits the standard time radio wave is determined based on the correlation value (covariance value) between the input waveform data based on the standard time radio wave and predicted waveform data, which will be described below.

In the third embodiment, in order to accurately detect the standard time radio wave signal, for example the signal of JJY which changes from a low level to a high level at the head of the second, a plurality of predicted waveform data is generated in which a predetermined number of waveform data items (four data items in this embodiment) each having a unit time length and a predetermined data value are continuously arranged at a time interval of 50 ms. The correlation values between the plurality of predicted waveform data and the input waveform data are calculated and a changing point of the predicted waveform data indicating the optimal correlation value from a low level to a high level is determined to be the second pulse position (the head position of the second). A plurality of predicted waveform data with the same shape may be used to detect the change of the signal of WWVB or MSF from a high level to a low level at the head of the second.

When Step S352 ends, the CPU 11 and the like detect the head position of the minute, i.e. the head position of one frame of the standard time radio wave signal (Step S354).

Then, the CPU 11 and the like decode various kinds of codes (for example, a code M1 indicating one's place of the minute, a code M10 indicating ten's place of the minute, and other codes indicating the date or day in JJY) of the standard time radio wave signal based on the comparison between the predicted waveform data and the input waveform data (Step S356).

The process (Step S352) of determining the transmitting station and detecting the second pulse position according to the third embodiment will be described in more detail. The predicted waveform data used in second synchronization according to the third embodiment is the same as that shown in FIG. 7 in the first embodiment and thus a description thereof will be omitted.

Figure 34:
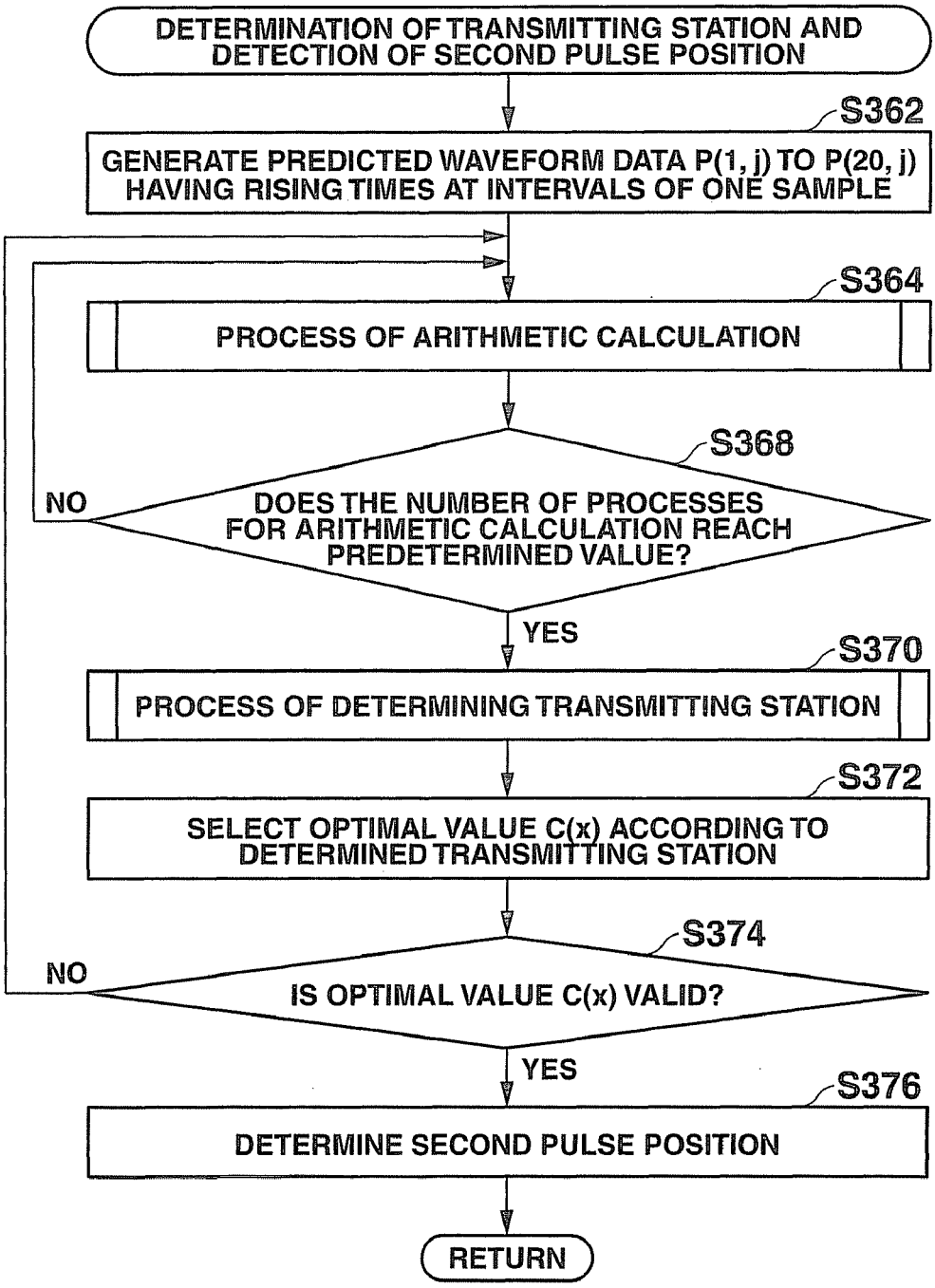
FIG. 34 is a flowchart illustrating a process of determining a transmitting station and detecting a second pulse position (second synchronization) according to the third embodiment.

FIG. 34 is a flowchart illustrating the process (Step S352 in FIG. 33) of determining the transmitting station and detecting the second pulse position (second synchronization) according to the third embodiment in more detail. A flowchart illustrating an example of a process (Step S364) of calculating the covariance value in the process of detecting the second pulse position shown in FIG. 34 is the same as FIG. 17 in the second embodiment. In addition, a diagram schematically illustrating the process of detecting the second pulse position is the same as FIG. 9 in the first embodiment As shown in FIG. 34, the CPU 11 controls the predicted waveform data generator 223 to generate 20 predicted waveform data items P(1, j) to P(20, j) with 4 unit time lengths (4 seconds) in which the positions where the data items change from a low level to a high level are arranged at intervals of 50 ms (Step S362: reference numeral 901 in FIG. 9). The value of the predicted waveform data is any one of the first value, the second value, and the third value, as described with reference to FIG. 7 in the first embodiment.

Then, the signal comparator 18C performs a process of calculating the covariance value (Step S364). Since the process of calculating the covariance value is the same as that in the second embodiment shown in FIG. 17, a description thereof will be omitted.

Figure 35:
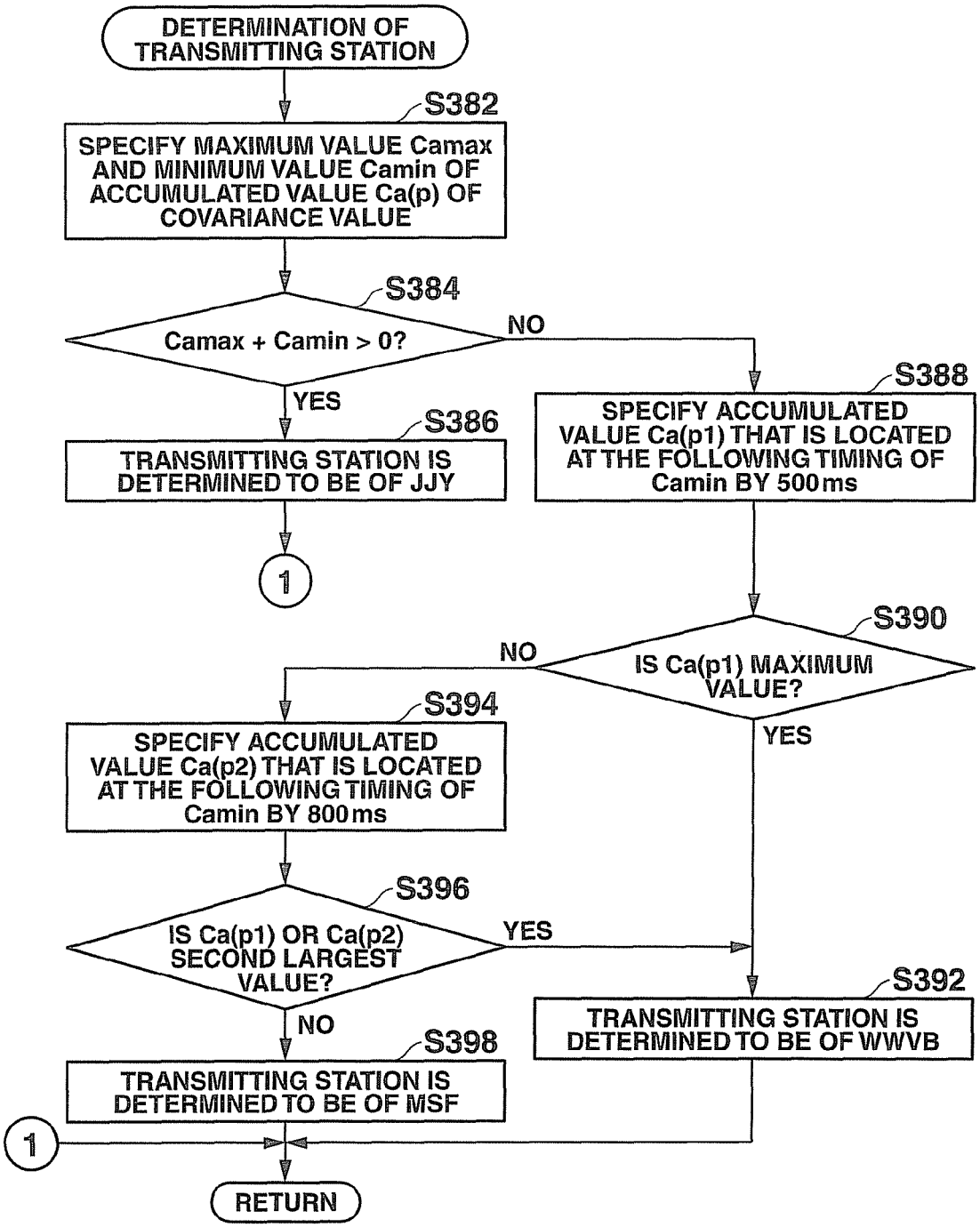
FIG. 35 is a flowchart illustrating an example of the process of determining a transmitting station according to the third embodiment.

After Step S364 (the process of calculating the covariance value) in FIG. 34, the CPU 11 determines whether the number of processes that calculate the covariance value (Step S364) reaches a predetermined value (Step S368). If the determination result in Step S368 is "No," the process returns to Step S364. On the other hand, if the determination result in Step S368 is "Yes," the CPU 11 controls the transmitting station determinator 227 to perform a process of determining a transmitting station (Step S370). FIG. 35 is a flowchart illustrating an example of the process of determining a transmitting station in Step S370.

Figure 36A:
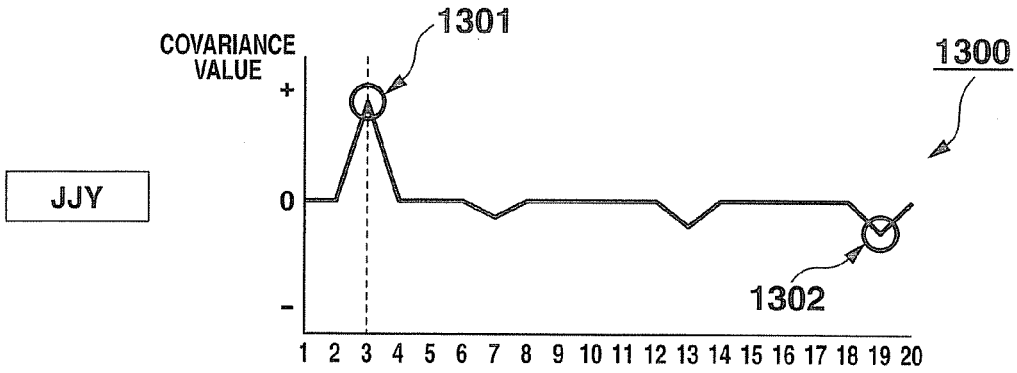
FIG. 36A is a histogram illustrating an example of an accumulated value Ca(p) (p=1 to 20) of a covariance value between predicted waveform data P(p) (p=1 to 20) and input waveform data Sn(j) obtained from a standard time radio wave signal of JJY.
Figure 36B:
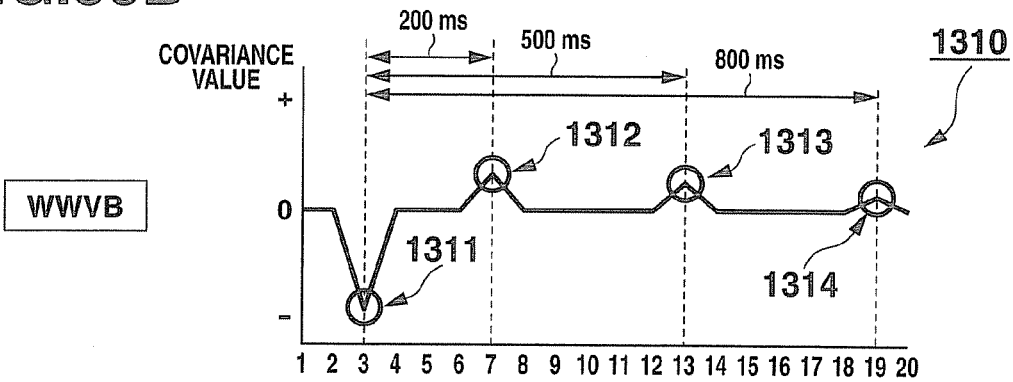
FIG. 36B is a histogram illustrating an example of an accumulated value Ca(p) (p=1 to 20) of a covariance value between predicted waveform data P(p) (p=1 to 20) and input waveform data Sn(j) obtained from a standard time radio wave signal of WWVB.
Figure 36C:
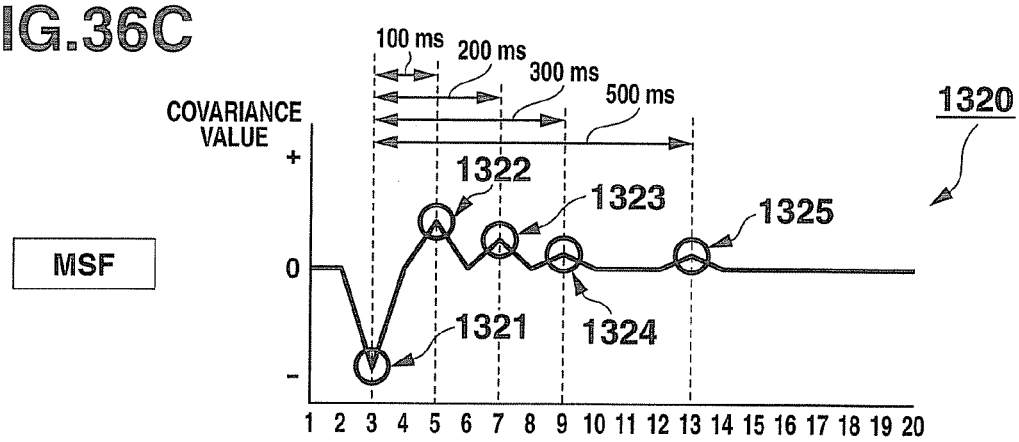
FIG. 36C is a histogram illustrating an example of an accumulated value Ca(p) (p=1 to 20) of a covariance value between predicted waveform data P(p) (p=1 to 20) and input waveform data Sn(j) obtained from a standard time radio wave signal of MSF.

As shown in FIG. 35, the transmitting station determinator 227 detects the maximum value Camax and the minimum value Camin of the accumulated value Ca(p) of the covariance value (Step S382). FIGS. 36A to 36C are histograms illustrating examples of the accumulated value Ca(p) (p=1 to 20) of the covariance value between the input waveform data Sn(j) and the predicted waveform data P(p, j) (p=1 to 20). FIGS. 36A to 36C are obtained based on input waveform data based on the standard time radio wave signal of JJY, input waveform data based on the standard time radio wave signal of WWVB, and input waveform data based on the standard time radio wave signal of MSF, respectively (see reference numerals 1300, 1310, and 1320).

In these examples, p=3 corresponds to the head position of the second. The correlation value (the accumulated value of the covariance value) Ca(p) shown in the histogram indicates the correlation (the similarity of the waveform) between the input waveform data and the predicted waveform data. The predicted waveform data P(p, j) (in the example of FIG. 36A, P(3, j)) corresponding to the position indicated by the maximum value Cmax (in the example shown in FIG. 36A, p=3 at Ca(3): see reference numeral 1301) has the highest positive correlation with the input waveform data. In the examples shown in FIGS. 36B and 36C, the predicted waveform data corresponding to the position indicated by the minimum value Camin (p=3: see reference numerals 1311 and 1321) has the highest negative correlation with the input waveform data.

As described with reference to FIGS. 6A to 6K in the first embodiment, in the standard time radio wave signal of JJY, the signal level rises at the head position of the second, whereas in the standard time radio wave signals of WWVB and MSF, the signal level falls at the head position of the second. Therefore, as shown in FIG. 36A, in the input waveform data obtained from the standard time radio wave signal of JJY, the maximum value Camax (see reference numeral 1301) indicating the highest positive correlation is greater than the minimum value Camin (see reference numeral 1302) indicating the highest negative correlation. On the other hand, as shown in FIGS. 36B and 36C, in the input waveform data obtained from the standard time radio wave signals of WWVB and MSF, the minimum value Camin (see reference numerals 1311 and 1321) indicating the highest negative correlation is greater than the maximum value Camax (for example, see reference numerals 1312 and 1322) indicating the highest positive correlation. Therefore, the transmission determinator 27 discriminates JJY from WWVB and MSF using the following determining process.

The transmitting station determinator 227 determines whether the sum of the maximum value Camax and the minimum value Camin is greater than 0 based on the accumulated value of the covariance value (Step S384). If the determination result in Step S384 is "Yes," the transmitting station determinator 227 determines whether the transmitting station is a JJY transmitting station (Step S386). After Step S386, the process returns to the main routine (Step S372 in FIG. 34).

If the determination result in Step S384 is "No," it is necessary to determine whether the transmitting station is a WWVB or MSF transmitting station. As shown in FIG. 36B, in the input waveform data obtained from the standard time radio wave signal of WWVB, the maximum value of the accumulated value appears at the positions that are 200 ms, 500 ms, and 800 ms away from the head position of the second (the position where the minimum value Camin appears) (see reference numerals 1312, 1313, and 1314). In the standard time radio wave of WWVB, a code 0 has the rising edge of the pulse at the position that is 200 ms away from the second head position, a code 1 has the rising edge of the pulse at the position that is 500 ms away from the second head position, and a code P has the rising edge of the pulse at the position that is 800 ms away from the second head position. In some cases, the rising edge of the pulse of the code is aligned with the rising edge of the input waveform data. Therefore, the maximum value indicating a positive correlation appears at the above-mentioned positions.

As shown in FIG. 36C, in the input waveform data obtained from the standard time radio wave signal of MSF, the maximum value of the accumulated value appears at the positions that are 100 ms, 200 ms, 300 ms, and 500 ms away from the head position of the second (the position where the minimum value Camin appears) (see reference numerals 1322 to 1325). In the standard time radio wave of MSF, a code "A=0, B=0" has the rising edge of the pulse at the position that is 100 ms away from the second head position, a code "A=1, B=0" has the rising edge of the pulse at the position that is 200 ms away from the second head position, a code "A=0, B=1" has the rising edge of the pulse at the positions that are 100 ms and 300 ms away from the second head position, a code "A=1, B=1" has the rising edge of the pulse at the position that is 300 ms away from the second head position, and a code M has the rising edge of the pulse at the position that is 500 ms away from the second head position. In some cases, the rising edge of the pulse of the code is aligned with the rising edge of the input waveform data. Therefore, the maximum value indicating a positive correlation appears at the above-mentioned positions.

In the input waveform data obtained from the standard time radio wave of WWVB, when taking the appearance frequency of the code into consideration, it is expected that the maximum value of the accumulated value will appear at the position that is 200 ms or 500 ms away from the head position of the second. Since the code P is a marker, the appearance frequency of the code P is lower than that of other codes 0 and 1. Therefore, it is not considered that the maximum value of the accumulated value appears at the position that is 800 ms away from the head position of the second.

In the input waveform data obtained from the standard time radio wave of MSF, when the appearance frequency of the code is considered, it is expected that the maximum value of the accumulated value will appear at the position that is 100 ms, 200 ms or 300 ms away from the head position of the second. Since the code M is a marker, the appearance frequency of the code M is lower than that of other codes. Therefore, it is not considered that the maximum value of the accumulated value appears at the position that is 500 ms away from the head position of the second.

If the determination result in Step S384 is "No," the transmitting station determinator 227 detects the accumulated value Ca(p1) that is at a position 500 ms away from the position where the minimum value Camin of the accumulated value appears (Step S388). Then, the transmitting station determinator 227 determines whether the Ca(p1) is the maximum value of the accumulated value (Step S390). If the determination result in Step S390 is "Yes," the transmitting station determinator 227 determines that the transmitting station is a WWVB transmitting station (Step S392). After Step S392, the process returns to the main routine (Step S372 in FIG. 34).

If the determination result in Step S390 is "No," the transmitting station determinator 227 detects the accumulated value Ca(p2) that is at a position 800 ms away from the position where the minimum value Camin of the accumulated value appears, in addition to the accumulated value Ca(p1) that is 500 ms away from the position where the minimum value Camin of the accumulated value appears (Step S394), and determines whether Ca(p1) or Ca(p2) is the second largest value of the accumulated value Ca (Step S396). If the determination result in Step S396 is "Yes," the transmitting station determinator 227 determines that the transmitting station is a WWVB transmitting station (Step S392).

On the other hand, if the determination result in Step S396 is "No," the transmitting station determinator 227 determines that the transmitting station is an MSF transmitting station (Step S398). After Step S398, the process returns to the main routine (Step S372 in FIG. 34).

When the process of determining the transmitting station shown in FIG. 35 (Step S370 in FIG. 34) ends, the correlation value comparator 226 compares the accumulated values Ca(1) to Ca(20) of the correlation values and finds the optimal value C(x) of the accumulated value corresponding to the transmitting station (Step S372). When the transmitting station is a JJY transmitting station, the optimal value is the maximum value. On the other hand, when the transmitting station is a WWVB or MSF transmitting station, the optimal value is the minimum value. The CPU 11 receives the optimal value C(x) and determines whether the optimal value is valid (Step S374).

Next, the process of determining whether the optimal value is valid when the transmitting station is a JJY transmitting station will be described. The maximum value C(x) of the obtained covariance values C(p) indicates a predicted waveform with the highest correlation. However, in the covariance value obtained from a sample with insufficient parameters, the erroneous maximum value is likely to appear due to an unexpected factor caused by noise. In order to exclude this case, for example, in Step S374, the following criteria are set to prevent an error in detection:

(1) The number of input waveform data used to calculate the covariance is equal to or more than a predetermined value;

(2) The value of x indicating C(x) appears plural times, the values of x appearing plural times are equal to each other, and the frequency of the value of x is higher than that of other values (x is a mode value);

(3) The values of x that continuously appear a predetermined number of times or more are equal to each other (the continuity of a mode value);

(4) The variance of C(p) is equal to or less than a predetermined value; and (5) Kurtosis or the degree of distortion, which is the amount of statistics of C(p), or an evaluation function thereof is calculated and it is determined whether the calculation result reaches a predetermined value.

When the criteria (1) to (3) are applied, a set of Steps S364 to S374 in FIG. 34 is performed plural times.

A method of determining validity is not limited to the above-mentioned method. The average value of the correlation values or the standard deviation may be used and the correlation value smaller than the average value may be determined to be insignificant even though the correlation value is the maximum value. In addition, the level of significance (for example, 5 percent) that is generally used in statistics may be used.

If it is determined that the optimal value C(x) is valid (Yes in Step S374), the CPU 11 determines the changing point of the signal level of the predicted waveform data indicated by the optimal value C(x), that is, the position where the first value indicating a low level changes to the second value indicating a high level, to be the second pulse position (Step S376). The CPU 11 stores the information of the second pulse position in the RAM 15. The second pulse position is used in, for example, a process of detecting a minute head position, which will be described below.

As shown in FIG. 33, when the determination of the transmitting station and the detection of the second pulse position (Step S352) end, the minute head position is detected (Step S354). The detection of the minute head position is also referred to as minute synchronization. The second pulse position (head position of the second) is already settled in step S352. For example, in JJY, as shown in FIG. 5 in the first embodiment, in a one-minute frame, a code indicating the position marker P0 is arranged at the end and a code indicating the marker M is arranged at the head. Each of the position marker P0 and the marker M is a code P with a 20% duty. In the minute synchronization, predicted waveform data that has a predetermined unit time length and includes portions before and after the head position of the minute is generated.

Next, the case in which the transmitting station is a JJY transmitting station will be described. In this case, predicted waveform data with 2 unit time lengths is generated in which the codes P with a 20% duty are continuously arranged. In addition, 60 input waveform data items each having 2 unit time lengths (2 seconds) starting at the second pulse position (that is, the head position of the second) are generated. It is possible to obtain 60 correlation values (covariance values) C(1) to C(60) by calculating the correlation value between the predicted waveform data and each of the 60 input waveform data items.

A flowchart illustrating an example of the detection of the minute head position (minute synchronization) according to the third embodiment in more detail is the same as FIG. 26 in the second embodiment. In addition, a diagram illustrating the input waveform data and the predicted waveform data in the detection of the minute head position according to the third embodiment is the same as FIG. 27 in the second embodiment and thus a description thereof will be omitted. The second pulse position (second head position) is settled by the second synchronization.

When the detection of the minute head position shown in FIG. 33 (Step S354), that is, when the minute synchronization ends, codes, such as minute, hour, and day codes, are decoded (Step S356). In a minute decoding process, one's place of the minute and ten's place of the minute are decoded. In an hour decoding process, one's place of the hour and ten's place of the hour are decoded. Next, the decoding of one's place of the minute when the transmitting station is a JJY transmitting station will be described.

A flowchart illustrating an example of the process of detecting one's place of the minute according to the third embodiment is the same as FIG. 29 in the second embodiment and thus a description thereof will be omitted.

Other codes, such as ten's place of the minute, one's place and ten's place of the hour, and the day, may be decoded in the same manner as the method of decoding the one's place of the minute. When time information including, for example, the current date, day, and time is acquired through the code decoding process, the CPU 11 stores the obtained time information in the RAM 15. In addition, the CPU 11 corrects the current time measured by the internal timer 17 based on the current time obtained from the code and displays the obtained current time on the display device 13 (Step S358).

The second synchronization, the minute synchronization, and the code decoding process of the signal in JJY have been described above. As described in the first and second embodiments, in other standards, such as WWVB and MSF, the second synchronization, the minute synchronization, and the decoding of the codes may also be performed.

Next, covariance in WWVB or MSF will be described again. As shown in FIGS. 6D to 6K in the first embodiment, in WWVB or MSF, a signal changes from a high level to a low level at the head of the second. As described in the first embodiment, FIGS. 11A to 11C are diagrams illustrating the covariance value between the input waveform data and the predicted waveform data. In FIG. 11A, the input waveform data Sn(j) changes from a low level to a high level at the head position of the second (see reference numeral 1100). The maximum value of the covariance value C between the predicted waveform data P(j) that has the first value corresponding to a low level before the rising point and has the second value corresponding to a high level after the rising point and the input waveform data Sn(j) is 2. As such, in the waveform that rises at the head position of the second, such as the input waveform data based on JJY, the maximum value of the covariance value (or the accumulated value of the covariance value) appears at the head position of the second.

As shown in FIG. 11B, input waveform data S'n(j) that changes from a high level to a low level at the head position of the second (second pulse position) is considered. The minimum value of the covariance value C between the input waveform data S'n(j) and the predicted waveform data P(j) is −2. That is, as in WWVB or MSF, for data that changes from a high level to a low level at the head position of the second, the minimum value of the covariance value (or the accumulated value of the covariance value) may be selected as the optimal value.

Alternatively, as in WWVB or MSF, in order to detect the head position of the second in the data that changes from a high level to a low level at the head position of the second, another predicted waveform data, which is the inverted data of the predicted waveform data P(p, j), may be used. In FIG. 11C, the input waveform data S'n(j) is the same as that shown in FIG. 11B. Predicted waveform data P'(j) is the inverted data of the predicted waveform data P(j) shown in FIG. 11B. In this case, when p is 2, the covariance value C(2) is the maximum value. Therefore, the maximum value of the covariance value (or the optimal value of the covariance value) may be selected as the optimal value by inverting the shape of the predicted waveform data.

The process of detecting the head position of the minute and the process of detecting one's place of the minute in the case in which the transmitting station is a JJY transmitting station have been described above with reference to FIGS. 26 and 29. Even though the transmitting station is a WWVB or MSF transmitting station, it is possible to calculate the optimal value of the covariance value (or the accumulated value of the covariance value) using the input waveform data and the predicted waveform data and detect the head position of the minute or the code.

In the detection of the minute head position, similar to FIG. 26, the predicted waveform data including a predetermined number of codes before and after the minute head position according to the WWVB or MSF standard is generated. Then, the characteristic section of the predicted waveform data is extracted. In the detection of the value of the code, similar to FIG. 29, input waveform data is acquired and the characteristic section thereof is extracted. In addition, the predicted waveform data according to the WWVB or MSF standard is generated and the characteristic section thereof is extracted. Next, the characteristic section of the code based on WWVB and the characteristic section of the code based on MSF will be described.

Figure 37A:
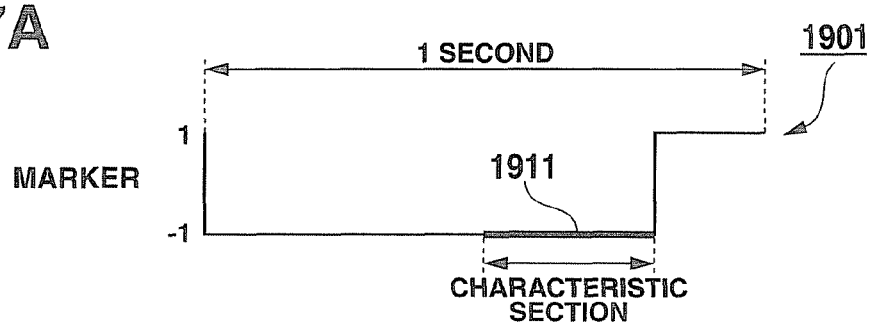
FIG. 37A is a diagram illustrating a characteristic section of a marker of WWVB.
Figure 37B:
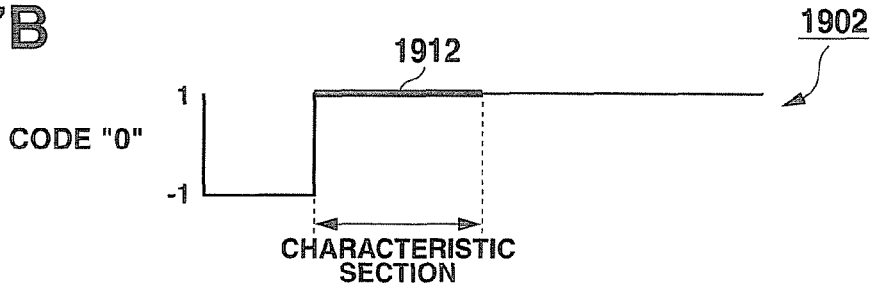
FIG. 37B is a diagram illustrating a characteristic section of a code 0 of WWVB.
Figure 37C:
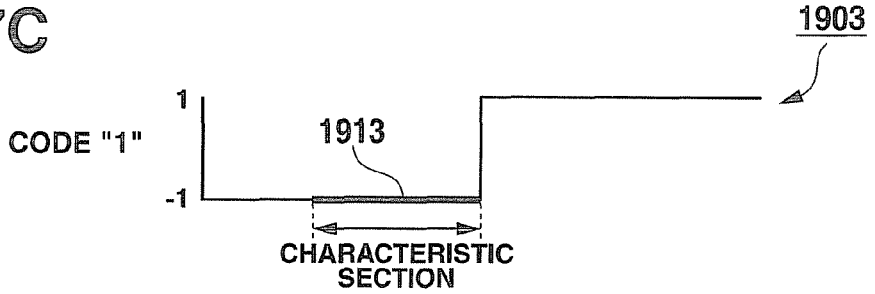
FIG. 37C is a diagram illustrating a characteristic section of a code 1 of WWVB.

FIGS. 37A, 37B, and 37C are diagrams illustrating the characteristic section of each code in WWVB. As shown in FIGS. 37A, 37B, and 37C, in the codes of WWVB, a marker (see reference numeral 1901), a code 0 (see reference numeral 1902), and a code 1 (see reference numeral 1903) have sections with different data values. The marker is at a low level and has a data value −1 which is peculiar to the maker and is different from those of other codes in the section from 500 ms to 800 ms (see reference numeral 1911). In this embodiment, as shown in FIG. 37A, in the marker of WWVB, the section from 500 ms to 800 ms is the characteristic section. In addition, the data value of the marker in the characteristic section is −1 indicating a low level.

As shown in FIG. 37B, the code 0 is at a high level and has a data value 1 which is peculiar to the code 0 and is different from that of the code 1 in the section from 200 ms to 500 ms (see reference numeral 1912). As shown in FIG. 37C, the code 1 is at a low level and has a data value −1 which is peculiar to the code 1 and is different from that of the code 0 in the section from 200 ms to 500 ms (see reference numeral 1913). Therefore, in each of the codes 0 and 1, the section from 200 ms to 500 ms is the characteristic section. In addition, the data values of the codes 0 and 1 in the characteristic sections are 1 and −1.

FIGS. 38A, 38B, 38C, 38D, and 38E are diagrams illustrating the characteristic sections of each code of MSF. As shown in FIGS. 38A, 38B, 38C, 38D, and 38E, in the codes of MSF, a marker (see reference numeral 2001), a code "00" (see reference numeral 2002), code "01" (see reference numeral 2003), a code "10" (see reference numeral 2004), and a code "11" (see reference numeral 2005) have sections with different data values in the characteristic sections.

Figure 38A:
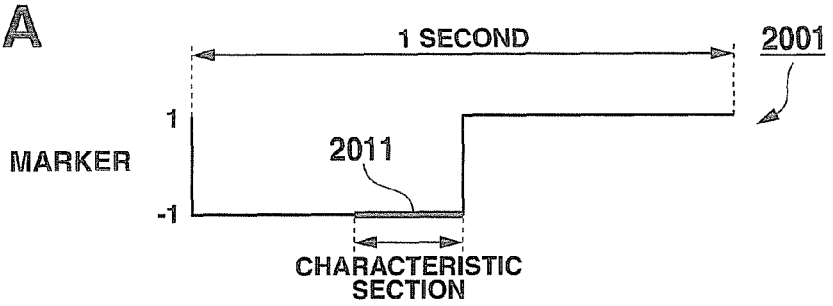
FIG. 38A is a diagram illustrating a characteristic section of a marker of MSF.

As shown in FIG. 38A, the marker is at a low level and has a data value −1 which is peculiar to the maker and is different from those of other codes in the section (see reference numeral 2011) from 300 ms to 500 ms. In this embodiment, in the marker of MSF, the section from 300 ms to 500 ms is the characteristic section. In addition, the data value of the marker in the characteristic section is −1 indicating a low level.

Figure 38B:
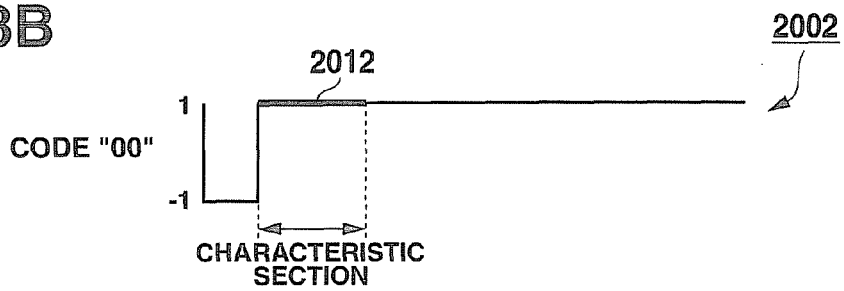
FIG. 38B is a diagram illustrating a characteristic section of a code "00" of MSF.
Figure 38C:
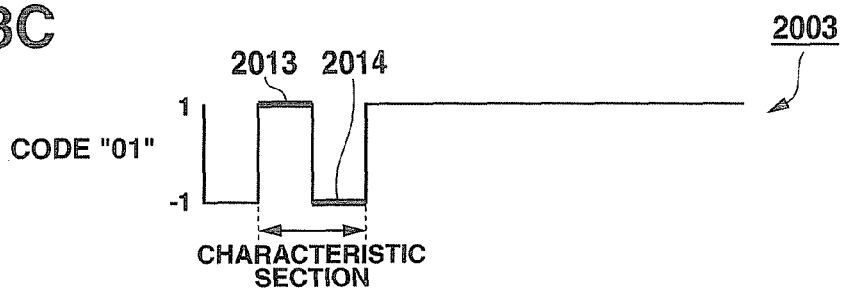
FIG. 38C is a diagram illustrating a characteristic section of a code "01" of MSF.
Figure 38D:
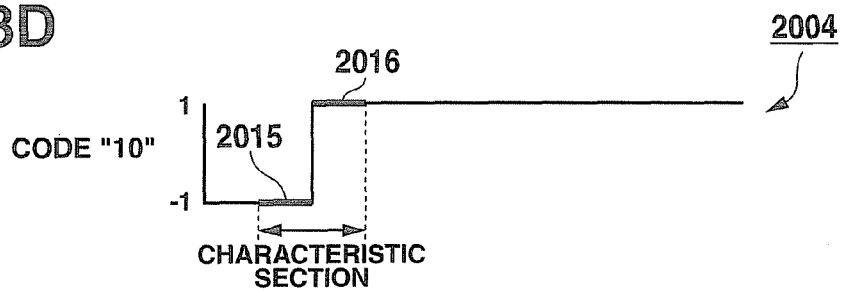
FIG. 38D is a diagram illustrating a characteristic section of a code "10" of MSF.
Figure 38E:
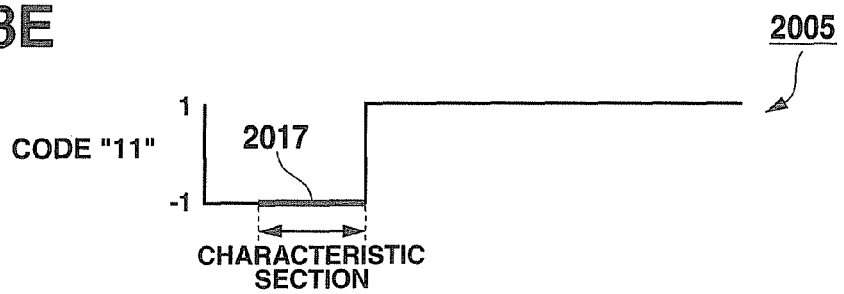
FIG. 38E is a diagram illustrating a characteristic section of a code "11" of MSF.

As shown in FIG. 38B, the code "00" is at a high level and has a data value 1 which is peculiar to the code "00" and is different from those of other codes in the section (see reference numeral 2012) from 100 ms to 300 ms. As shown in FIG. 38C, the code "01" is at a high level (data value "1") in the section (see reference numeral 2013) from 100 ms to 200 ms and is at a low level (data value "−1") in the section (see reference numeral 2014) from 200 ms to 300 ms. The code "01" has a combination of values (the first half is 1 and the second half is −1) different from those of other codes in the sections. As shown in FIG. 38D, the code "10" is at a low level (data value "−1") in the section (see reference numeral 2015) from 100 ms to 200 ms and is at a high level (data value "1") in the section (see reference numeral 2016) from 200 ms to 300 ms. The code "10" has a combination of values (the first half is −1 and the second half is 1) different from those of other codes in the sections. As shown in FIG. 38E, the code "11" is at a low level and has a data value −1 which is peculiar to the code "11" and is different from those of other codes in the section (see reference numeral 2017) from 100 ms to 300 ms. Therefore, the section from 100 ms to 300 ms is the characteristic section. The data value of each code in the section is as shown in the drawings.

In this embodiment, the transmitting station determinator 227 determines the kind of transmitting station transmitting the standard time radio wave based on the accumulated value of the correlation value calculated by the correlation value calculator 225. The correlation value comparator 226 compares the accumulated values and detects the optimal value of the accumulated value based on the kind of transmitting station determined by the transmitting station determinator 227. The CPU 11 detects the second pulse position in the time code based on the predicted waveform data with the optimal value. As such, the accumulated value of the correlation value is used to determine the kind of transmitting station and is also used to detect the second pulse position. It is possible to determine the kind of transmitting station and specify the second pulse position substantially at the same time using the optimal value of the correlation value. Therefore, it is possible to reduce the processing time and power consumption.

In this embodiment, the transmitting station determinator 227 determines the kind of transmitting station based on the sum of the maximum value and the minimum value of the accumulated value. When the values of the input waveform data and the predicted waveform data change at the same time and have the same phase, the correlation value indicates a positive correlation. On the other hand, when the values of the input waveform data and the predicted waveform data change at the same time and have opposite phases, the correlation value indicates a negative correlation. In this way, according to this embodiment, it is possible to discriminate between the transmitting station (for example, a JJY transmitting station) outputting a code with a waveform that rises at the head position of the second and the transmitting station (for example, a WWVB or MSF transmitting station) outputting a code with a waveform that falls at the head position of the second.

The transmitting station determinator 227 determines the kind of transmitting station based on a difference between the minimum value and the maximum value of the accumulated value or a difference between the maximum value and the minimum value of the accumulated value. For example, in the standard time radio waves of a plurality of standards in which the values thereof change in phase (for example, falling) at the head position of the code, the codes of the standard time radio waves have different shapes. The kind of transmitting station is determined based on the difference between the minimum value (or the maximum value) of the accumulated value that is considered as the head position of the second and the maximum value (or the minimum value) that is considered as the changing point of the value of the code. In this way, it is possible to discriminate a plurality of standards in which the values change in phase at the head position of the code.

For example, in the above-described embodiment, the predicted waveform data generator 223 generates a plurality of predicted waveform data in which each sampling point has any one of the first value indicating a low level in either one of the predetermined sections before and after the changing point of the signal level, the second value indicating a high level in the other one of the predetermined sections before and after the changing point of the signal level, and the third value in sections other than the predetermined sections and the waveforms thereof are arranged at intervals of a predetermined number of samples. When the sum of the maximum value and the minimum value is a positive value, the transmitting station determinator 227 can determine that the kind of transmitting station is a JJY transmitting station outputting a code with a waveform that rises at the head position of the second.

In this embodiment, the head position of the minute in the time code is specified and the codes included in the time code are acquired based on the kind of transmitting station and the second pulse position specified by the above-mentioned process and the signal levels before and after the head position of the time code. Then, the values of the codes including the date, hour, and minute codes are acquired based on the values indicated by the codes, and the current time is calculated based on the acquired values of the codes. Therefore, it is possible to correct the time obtained by the internal timer 17 with the calculated current time.

Next, a modification of the third embodiment will be described. In the third embodiment, JJY, WWVB, or MSF is determined according to whether the sum of the maximum value and the minimum value of the accumulated value of the covariance value is a positive value or a negative value. In the modification, the conditions of determining JJY, WWVB, or MSF are changed considering the influence of noise.

Figure 39:
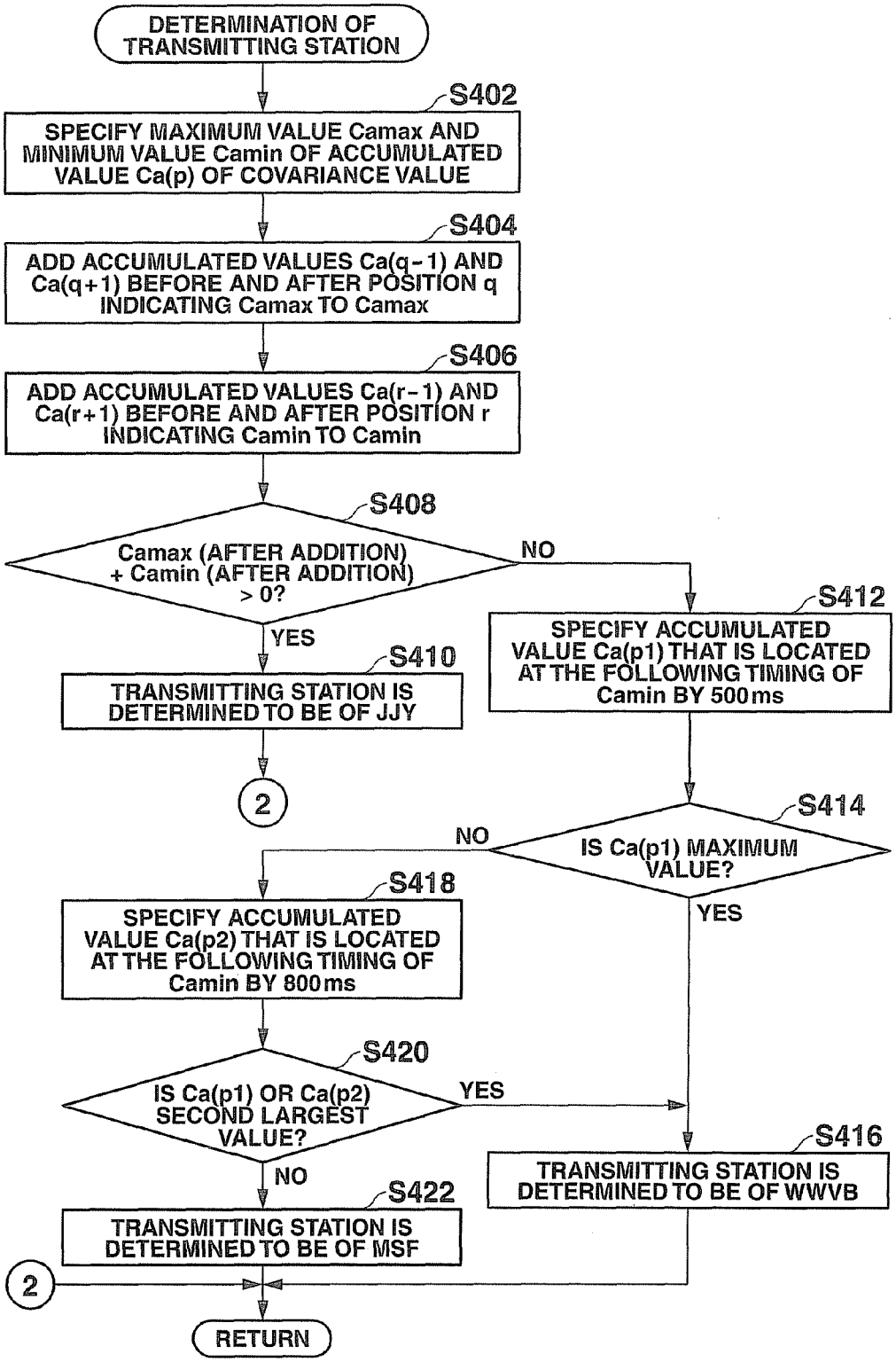
FIG. 39 is a flowchart illustrating an example of the process of determining a transmitting station according to the third embodiment.

FIG. 39 is a flowchart illustrating an example of a process of determining a transmitting station according to a modification of the third embodiment. The transmitting station determinator 227 detects the maximum value Camax and the minimum value Camin of the accumulated value Ca(p) of the covariance value (Step S402). Step S402 is the same as Step S382 shown in FIG. 35. Then, the transmitting station determinator 227 adds the accumulated values Ca(q−1) and Ca(q+1) before and after a position p indicating the maximum value Camax to the original maximum value Camax (=Ca(q)) (Step S404). After the addition, the maximum value Camax is as follows:

$$Ca\max = Ca(q-1) + Ca(q) + Ca(q+1).$$

Similarly, the transmitting station determinator 227 adds the accumulated values Ca(r−1) and Ca(r+1) before and after a position r indicating the minimum value Camin to the original minimum value Camin (=Ca(r)) (Step S406). After the addition, the minimum value Camin is as follows:

$$Ca\min = Ca(r-1) + Ca(r) + Ca(r+1).$$

The transmitting station determinator 227 determines whether the sum of the maximum value Camax after the addition and the minimum value Camin after the addition is greater than 0 (Step S408). If the determination result in Step S408 is "Yes," the transmitting station determinator 227 determines that the transmitting station is a JJY transmitting station (Step S410). If the determination result in Step S408 is "No," the process proceeds to Step S412. Steps S412 to S422 are the same as Steps S388 to S398 shown in FIG. 35.

The advantages when the modification of the third embodiment is applied will be described. In some cases, the actual head position of the second is disposed in the vicinity of the center between adjacent sampling points according to the sampling timing. In this case, the accumulated value Ca is the maximum value or the minimum value at one of the adjacent sampling points on both sides of the head position. However, the absolute value of the maximum value or the minimum value is not sufficient and the transmitting station is not likely to be accurately determined.

Figure 40A:
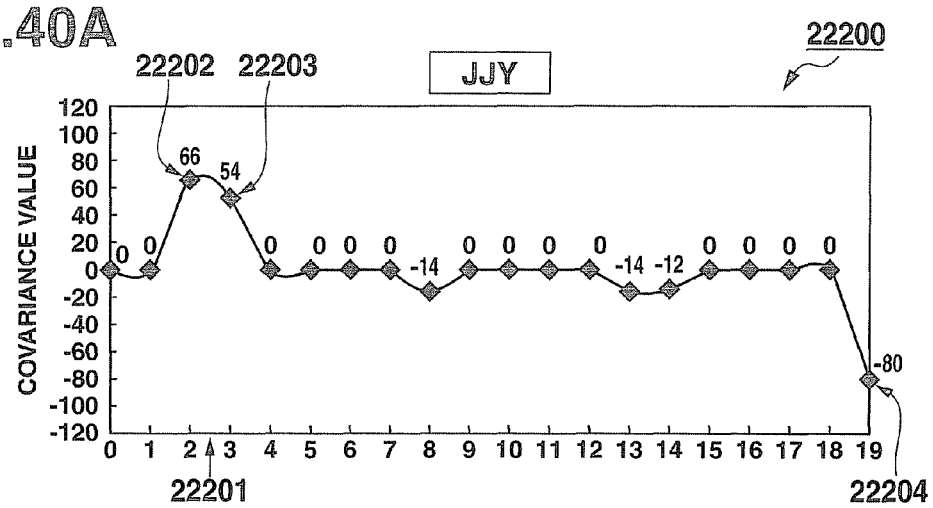
FIG. 40A is a histogram illustrating another example of the accumulated value Ca(p) (p=0 to 19) of the covariance value between the predicted waveform data P(p, j) (p=1 to 20) and the input waveform data Sn(j) based on the standard time radio wave signal of JJY.
Figure 40B:
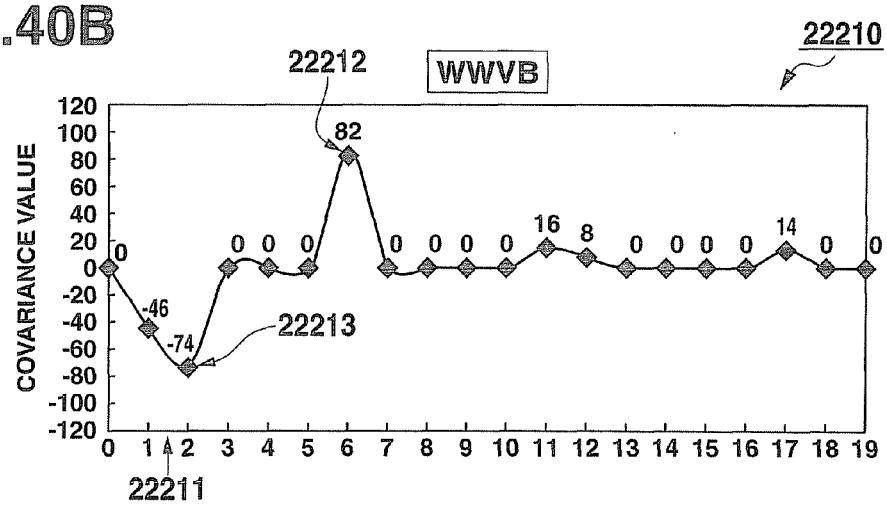
FIG. 40B is a histogram illustrating another example of the accumulated value Ca(p) (p=0 to 19) of the covariance value between the predicted waveform data P(p, j) (p=1 to 20) and the input waveform data Sn(j) based on the standard time radio wave signal of WWVB.
Figure 40C:
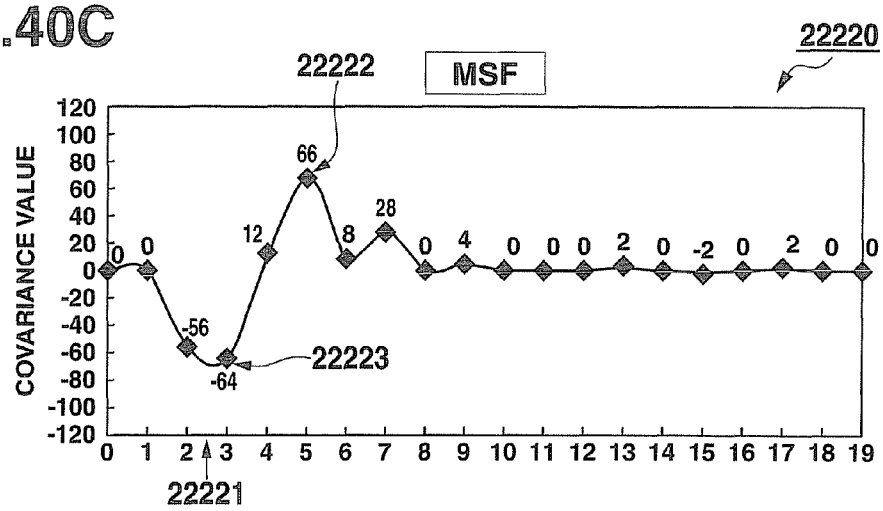
FIG. 40C is a histogram illustrating another example of the accumulated value Ca(p) (p=0 to 19) of the covariance value between the predicted waveform data P(p, j) (p=1 to 20) and the input waveform data Sn(j) based on the standard time radio wave signal of MSF.

FIGS. 40A to 40C are histograms showing other examples of the accumulated value Ca(p) (p=0 to 19) of the covariance value between the input waveform data Sn(1) and the predicted waveform data P(p, j) (p=1 to 20). FIGS. 40A to 40C are obtained based on input waveform data based on the standard time radio wave signal of JJY, input waveform data based on the standard time radio wave signal of WWVB, and input waveform data based on the standard time radio wave signal of MSF, respectively (see reference numerals 22200, 22210, and 22220). In FIGS. 40A to 40C, the parameters p indicating the position are 0 to 19. In FIG. 40A, the head position of the second is disposed between the position where p=2 and the position where p=3 (see an arrow 22201). Therefore, the maximum value Camax of the accumulated value is Ca(2)=66 (see reference numeral 22202) and an adjacent value Ca(3) is 54 (see reference numeral 22203). As a result, the maximum value Camax is not sufficient. Meanwhile, the minimum value Camin of the accumulated value is Ca(19)=−80 (see reference numeral 22204). Therefore, when the sum of the maximum value Camax and the minimum value Camin is simply considered, Camax+Camin=−14<0 is established. As a result, according to the method of the first embodiment, it is determined that the input waveform data is not based on at least JJY.

In FIG. 40B, the head position of the second is disposed between the position where p=1 and the position where p=2 (see an arrow 22211). The maximum value Camax of the accumulated value is Ca(6)=82 (see reference numeral 22212), and the minimum value Camin of the accumulated value is Ca(2)=−74 (see reference numeral 22213). Therefore, Camax+Camin=8>0 is established. According to the method of the third embodiment, it is determined that the input waveform data is based on JJY. Similarly, in FIG. 40C, the head position of the second is disposed between the position where p=2 and the position where p=3 (see an arrow 22221). The maximum value Camax of the accumulated value is Ca(5)=62 (see reference numeral 22222) and the minimum value Camin of the accumulated value is Ca(3)=−64 (see reference numeral 22223). Therefore, Camax+Camin=2>0 is established. According to the method of the third embodiment, it is determined that the input waveform data is based on JJY.

As described above, in order to prevent an error in determination when the head position of the second is disposed between the sampling points, in the modification of the third embodiment, the accumulated values corresponding to the positions before and after the position where the maximum value appears and the accumulated values corresponding to the positions before and after the position where the minimum value appears are considered.

According to the modification of the third embodiment, in the examples shown in FIGS. 40A to 40C, the following determination results are obtained. In FIG. 40A, when the accumulated values corresponding to the positions before and after the position where the maximum value appears and the accumulated values corresponding to the positions before and after the position where the minimum value appears are considered, the maximum value Camax after the addition is Ca(1)+Ca(2)+Ca(3)=120. In addition, when the accumulated values corresponding to the positions before and after the position where the maximum value appears and the accumulated values corresponding to the positions before and after the position where the minimum value appears are considered, the minimum value Camin after the addition is Ca(18)+Ca(19)+Ca(0)=−80. Therefore, in this case, Camax+Camin 40>0 is established. As a result, it is determined that the input waveform data is based on JJY.

In FIG. 40B, when the accumulated values corresponding to the positions before and after the position where the maximum value appears and the accumulated values corresponding to the positions before and after the position where the minimum value appears are considered, the maximum value Camax after the addition is Ca(5)+Ca(6)+Ca(7)=82. In addition, when the accumulated values corresponding to the positions before and after the position where the maximum value appears and the accumulated values corresponding to the positions before and after the position where the minimum value appears are considered, the minimum value Camin after the addition is Ca(1)+Ca(2)+Ca(3)=−120. Therefore, in this case, Camax+Camin=−38<0 is established. As a result, it is determined that the input waveform data is not based on at least JJY.

Similarly, in FIG. 40C, when the accumulated values corresponding to the positions before and after the position where the maximum value appears and the accumulated values corresponding to the positions before and after the position where the minimum value appears are considered, the maximum value Camax after the addition is Ca(4)+Ca(5)+Ca(6)=86. In addition, when the accumulated values corresponding to the positions before and after the position where the maximum value appears and the accumulated values corresponding to the positions before and after the position where the minimum value appears are considered, the minimum value Camin after the addition is Ca(2)+Ca(3)+Ca(4)=−108. Therefore, in this case, Camax+Camin=−22<0 is established. As a result, it is determined that the input waveform data is not based on at least JJY.

According to the modification of the third embodiment, the transmitting station determinator 227 adds the accumulated values Ca(q−n) to Ca(q+n) (for example, Ca(q−1), Ca(q), and Ca(q+1)) corresponding to a plurality of samples adjacent to the position indicated by the accumulated value Ca(q), which is the maximum value, and acquires the added maximum value. In addition, the transmitting station determinator 227 adds the accumulated values Ca(r−n) to Ca(r+n) (for example, Ca(r−1), Ca(r), and Ca(r+1)) corresponding to a plurality of samples adjacent to the position indicated by the accumulated value Ca(r), which is the minimum value, and acquires the added minimum value. Then, the transmitting station determinator 227 determines the kind of transmitting station based on the sum of the added maximum value and the added minimum value. In this way, even when the second head position is disposed between the sampling points or a relatively large amount of noise is included in the input waveform data, it is possible to appropriately determine the kind of transmitting station.

The invention is not limited to the above-described embodiments, but various modifications and changes of the invention can be made without departing from the scope and spirit of the invention. The modifications and changes are also included in the scope of the invention.

For example, in the third embodiment, the processes in Steps S388 to S398 shown in FIG. 35 are performed in order to determine whether the transmitting station is a WWVB transmitting station or an MSF transmitting station. However, the invention is not limited thereto.

Figure 41:
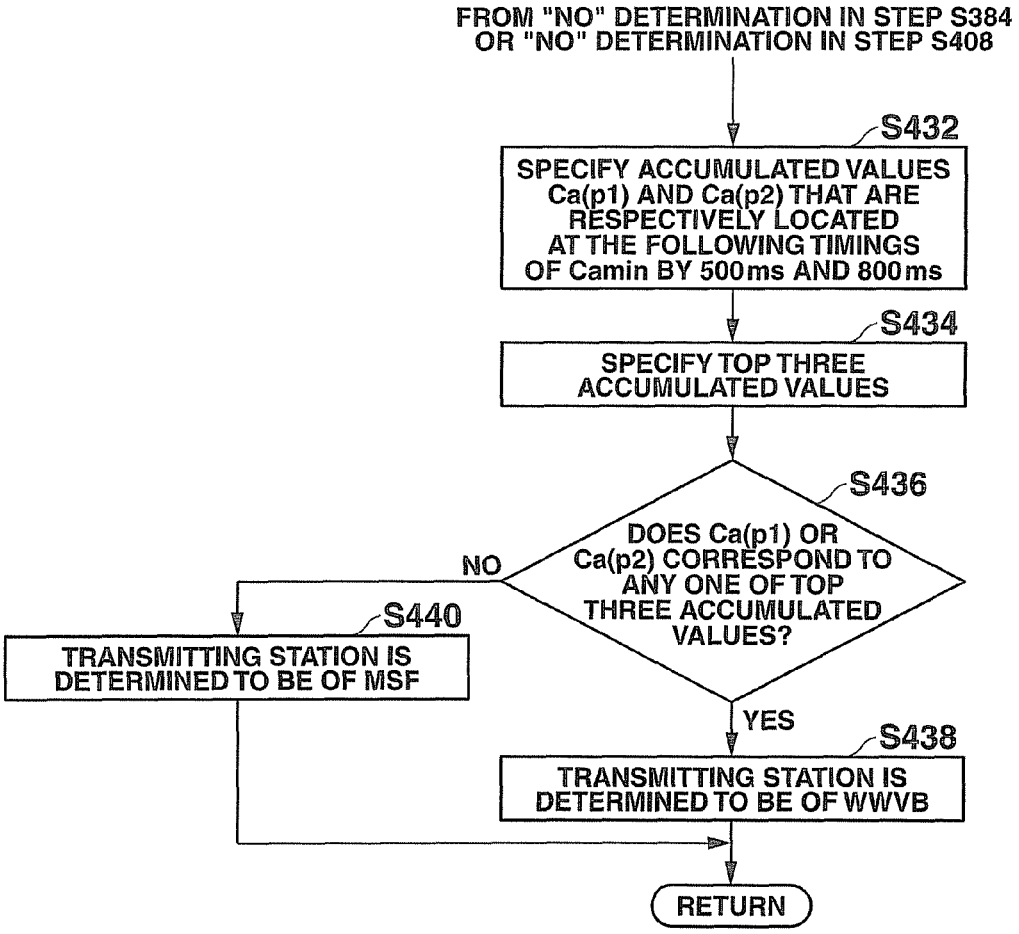
FIG. 41 is a flowchart illustrating a portion of a process of determining a transmitting station according to a modification of the third embodiment.

FIG. 41 is a flowchart illustrating a portion of a process of determining a transmitting station according to a second modification of the third embodiment. FIG. 41 shows a process performed after the determination result in Step S384 shown in FIG. 35 is "No" or the determination result in Step S408 shown in FIG. 39 is "No." The transmitting station determinator 227 detects the accumulated value Ca(p1) that is 500 ms away from the position where the minimum value Camin of the accumulated value appears and the accumulated value Ca(p2) that is 800 ms away from the position (Step S432). In addition, the transmitting station determinator 227 detects the top three accumulated values (Step S434).

Then, the transmitting station determinator 227 determines whether the accumulated value Ca(p1) or Ca(p2) corresponds to one of the top three accumulated values (Step S436). If the determination result in Step S436 is "Yes," the transmitting station determinator 227 determines that the transmitting station is a WWVB transmitting station (Step S438). On the other hand, if the determination result in Step S436 is "No,"

the transmitting station determinator 227 determines that the transmitting station is an MSF transmitting station (Step S440).

Figure 42A:
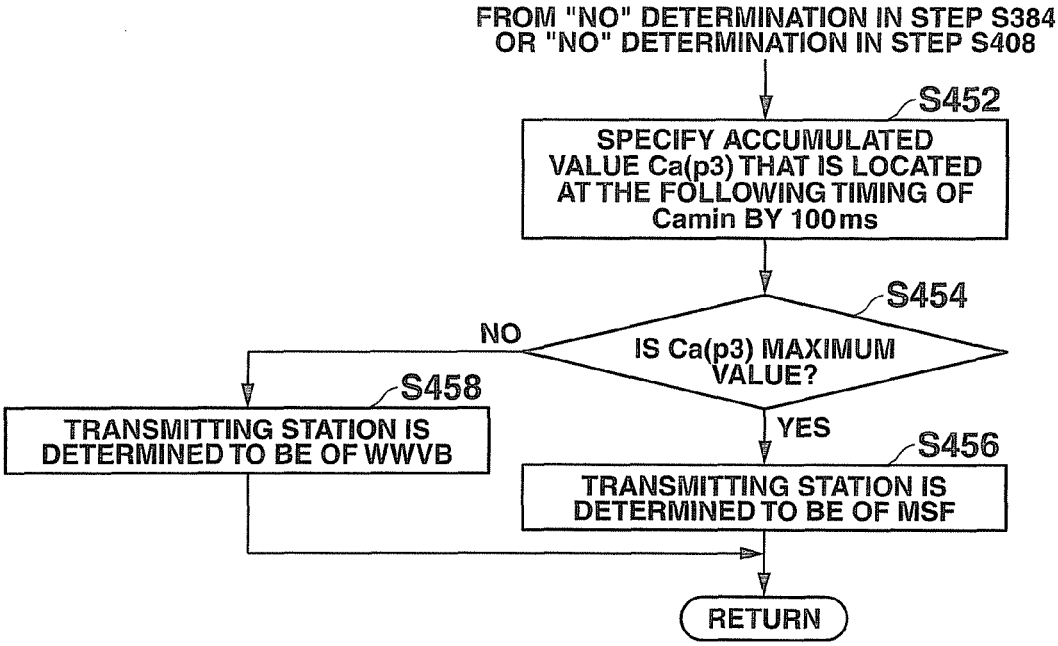
FIG. 42A is a flowchart illustrating a portion of a process of determining a transmitting station according to a modification of the third embodiment.

FIG. 42A is a flowchart illustrating a portion of a process of determining a transmitting station according to a third modification of the third embodiment. FIG. 42A shows a process performed after the determination result in Step S384 shown in FIG. 35 is "No" or the determination result in Step S408 shown in FIG. 39 is "No." In the modification, the transmitting station determinator 227 detects the accumulated value Ca(p3) that is 100 ms away from the position where the minimum value of the accumulated value appears (Step S452). Then, the transmitting station determinator 227 determines whether the accumulated value Ca(p3) is the maximum value (Step S454). If the determination result in Step S454 is "Yes," the transmitting station determinator 227 determines that the transmitting station is an MSF transmitting station (Step S456). On the other hand, if the determination result in Step S454 is "No," the transmitting station determinator 227 determines that the transmitting station is a WWVB transmitting station (Step S458).

Figure 42B:
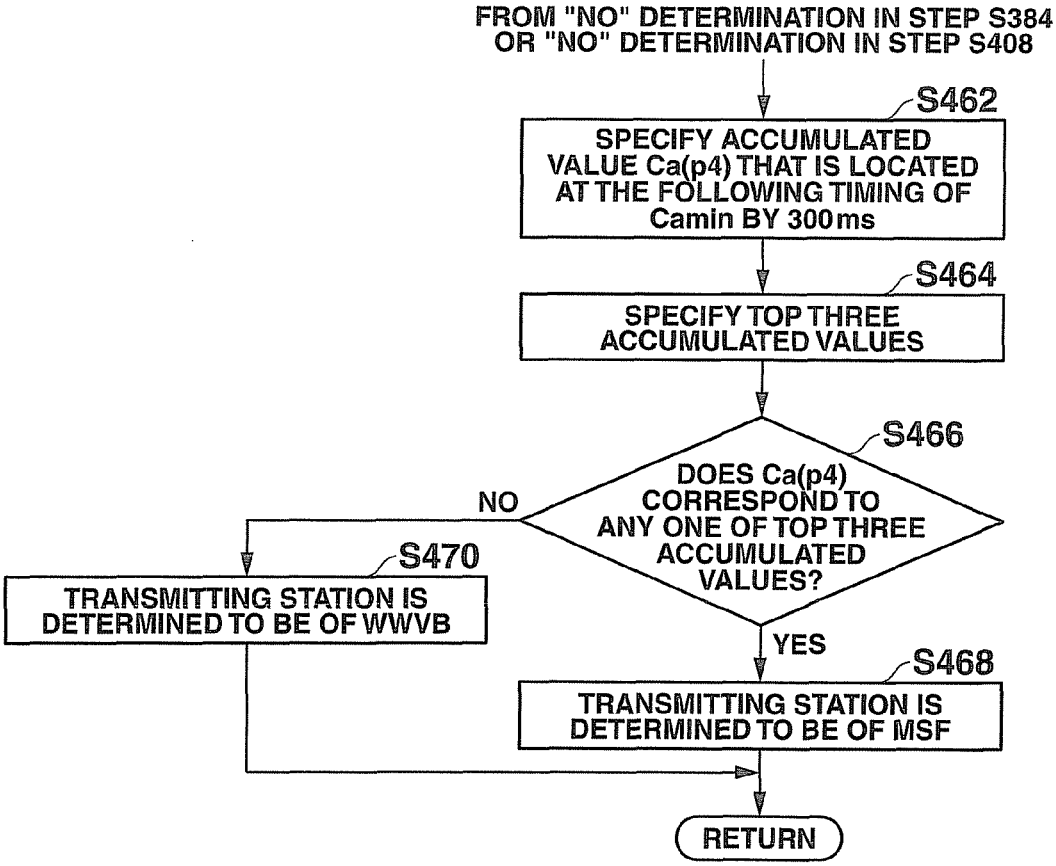
FIG. 42B is a flowchart illustrating a portion of a process of determining a transmitting station according to a modification of the third embodiment of the invention.

FIG. 42B is a flowchart illustrating a portion of a process of determining a transmitting station according to a fourth modification of the third embodiment. FIG. 42B shows a process performed after the determination result in Step S384 shown in FIG. 35 is "No" or the determination result in Step S408 shown in FIG. 39 is "No." In the modification, the transmitting station determinator 227 detects the accumulated value Ca(p4) that is 300 ms away from the position where the minimum value Camin of the accumulated value appears (Step S462). In addition, the transmitting station determinator 227 detects the top three accumulated values (Step S464).

Then, the transmitting station determinator 227 determines whether the accumulated value Ca(p4) corresponds to any one of the top three accumulated values (Step S466). If the determination result in Step S466 is "Yes," the transmitting station determinator 227 determines that the transmitting station is an MSF transmitting station (Step S468). On the other hand, if the determination result in Step S466 is "No," the transmitting station determinator 227 determines that the transmitting station is a WWVB transmitting station (Step S470).

In the third embodiment, the first value indicating a low level is −1, the second value indicating a high level is 1, and the third value other than the first and second values is 0. However, the invention is not limited thereto. The first value and the second value may be as follows.

(1) When the first value appears from the input waveform data and the first value appears from the predicted waveform data, or when the second value appears from the input waveform data and the second value appears from the predicted waveform data, the values are arithmetically operated to obtain a predetermined positive value indicating a positive correlation. That is, when the same value appears from the input waveform data and the predicted waveform data, a predetermined positive value is obtained.

(2) When the first value appears from the input waveform data and the second value appears from the predicted waveform data, or when the second value appears from the input waveform data and the first value appears from the predicted waveform data, the values are arithmetically operated to obtain a predetermined negative value indicating a negative correlation. That is, when different values appear from the input waveform data and the predicted waveform data, a predetermined negative value is obtained. It is preferable that the predetermined negative value and the predetermined positive value have the same absolute value.

The third value may not be 0. However, the third value should not affect the correlation value, such as the covariance value, when it is arithmetically operated by the first value or the second value.

In the third embodiment, the covariance value is used as the correlation value, but the invention is not limited thereto. For example, a residual, which is the total sum of the absolute values of differences, may be used as the correlation value. Alternatively, a correlation coefficient may be used instead of the covariance or the residual.

In the third embodiment, the accumulated values (for example, Ca(p1) and Ca(p2)) that are respectively 500 ms and 800 ms from the position where the minimum value Gamin appears are referred to in order to determine whether the transmitting station is of WWVB or MSF, (for example, see Steps S388 and S394 in FIG. 35). However, the invention is not limited thereto. The accumulated values (for example, Ca(p1−n) to Ca(p1+n) or Ca(p2−n) to Ca(p2+n)) (n is an integer equal to or greater than 1) corresponding to the samples, which are disposed in a predetermined range before and after the position, may be referred to.

In the first modification of the third embodiment, the accumulated values corresponding to two samples before and after the position indicating the maximum value Camax are added to the maximum value and the accumulated values corresponding to two samples before and after the position indicating the minimum value Camin are added to the minimum value (see Steps S404 and S406 in FIG. 39). However, the invention is not limited thereto. The accumulated values corresponding to 2n samples before and after the position (n is an integer equal to or greater than 1) may be added.

What is claimed is:

1. A time information-acquiring apparatus comprising:

a receiver configured to receive a standard time radio wave including a time code;

an input waveform generator configured to sample a signal output from the receiver and including the time code with a predetermined sampling period and to generate input waveform data with one or more unit time lengths, the input waveform data at each sampling point having one of a first value indicating a low level and a second value indicating a high level;

a predicted waveform generator configured to generate plural predicted waveform data, each of the plural predicted waveform data having the one or more unit time lengths, each of the plural predicted waveform data at each sampling point having one of the first value and the second value, and a phase of each of the plural predicted waveform data being shifted by a predetermined number of samples;

a correlation calculator configured to arithmetically operate the input waveform data at a sampling point and the plural predicted waveform data at a corresponding sampling point and to calculate correlation values between the input waveform data and the plural predicted waveform data, wherein the correlation calculator is configured to calculate a first correlation value indicating a positive correlation by arithmetically operating the first value of the input waveform data and the first value of the predicted waveform data or arithmetically operate the second value of the input waveform data and the second value of the predicted waveform data, and to calculate a second correlation value indicating a negative correlation by arithmetically operating the first value of the input waveform data and the second value of the predicted waveform data or arithmetically operate the second value of the input waveform data and the first value of the predicted waveform data;

a comparator configured to compare the correlation values calculated by the correlation calculator and to detect an optimal value of the correlation values; and a controller configured to detect a head position of a second in the time code based on predicted waveform data related to the optimal value.

2. The time information-acquiring apparatus according to claim 1, wherein each sampling point of the predicted waveform data generated by the predicted waveform generator has the first value in one of predetermined sections before and after a changing point of a signal level, has the second value in the other one of the predetermined sections before and after the changing point, and has a third value in sections other than the predetermined sections.

3. The time information-acquiring apparatus according to claim 2, wherein the correlation calculator is configured to arithmetically operate the first value of the input waveform data and the third value of the predicted waveform data or arithmetically operate the second value of the input waveform data and the third value of the predicted waveform data and to calculate a third correlation value indicating no correlation.

4. The time information-acquiring apparatus according to claim 2, wherein the time code changes from the low level to the high level at a head position of a second;

the predicted waveform data has the first value in the predetermined section before the changing point of the signal level, has the second value in the predetermined section after the changing point of the signal level, and has the third value in other sections; and the comparator is configured to select a maximum value of the first and the second correlation values as the optimal value.

5. The time information-acquiring apparatus according to claim 2, wherein the time code changes from the high level to the low level at a head position of a second;

the predicted waveform data has the first value in the predetermined section before the changing point of the signal level, has the second value in the predetermined section after the changing point, and has the third value in other sections; and the comparator is configured to select a minimum value of the first and the second correlation values as the optimal value.

6. The time information-acquiring apparatus according to claim 1, wherein the correlation calculator is configured to arithmetically operate the predicted waveform data at sample points in the predetermined section and the input waveform data at sample points in the predetermined section.

7. The time information-acquiring apparatus according to claim 1, wherein the controller is configured to detect a changing point of a signal level in the predicted waveform data related to the optimal value as a head position of a second in the time code.

8. The time information-acquiring apparatus according to claim 1, wherein the controller is configured to detect a head position of a minute in the time code based on the detected head position of a second and signal levels before and after a head position of the time code, to acquire codes included in the time code, to acquire values of the codes comprising date, hour, and minute that form the time code based on values indicated by the codes, and to calculate a current time based on the acquired values of the codes.

9. A radio wave timepiece comprising:

the time information-acquiring apparatus according to claim 8;

an internal timer configured to measure a current time using an internal clock;

a time corrector configure to correct the current time measured by the internal timer with the current time calculated by the controller included in the time information-acquiring apparatus according to claim 8; and a display device configured to display the current time measured by the internal timer or corrected by the time corrector.

10. The time information-acquiring apparatus according to claim 1, wherein the controller is configured to determine whether to continue or stop detection of the head position of a second based on the optimal value of the correlation values calculated by the correlation calculator.

11. The time information-acquiring apparatus according to claim 10, wherein the controller is configured to determine to stop the detection of the head position of a second when a degree of a positive correlation indicated by the optimal value of the correlation values that are repeatedly calculated is less than a predetermined value.

12. The time information-acquiring apparatus according to claim 11, wherein the controller is configured to accumulate the optimal value of the correlation values to calculate an accumulated value and to determine whether the degree of the positive correlation indicated by the optimal value is less than the predetermined value with reference to a threshold value determined by the number of repetitions to calculate the correlation values.

13. The time information-acquiring apparatus according to claim 10, wherein the controller is configured to count first correlation values calculated by the correlation calculator and to determine whether to continue or stop the detection of the head position of a second based on a count value.

14. The time information-acquiring apparatus according to claim 13, wherein when the count value is equal to or more than a threshold value determined by the number of times of the operation of calculating the correlation value, the controller is configured to determine to stop the detection of the head position of a second.

15. The time information-acquiring apparatus according to claim 10, wherein the controller is configured to calculate a level value indicating a reception level of the standard time radio wave based on the optimal value of the correlation value between the input waveform data and the plural predicted waveform data, the correlation values being repeatedly calculated by the correlation calculator, and to display the level value on a display device.

16. The time information-acquiring apparatus according to claim 15, wherein the controller increases or decreases the level value based on an increase or decrease in the degree of the positive correlation indicated by the accumulated value, with reference to the accumulated value of the optimal value.

17. The time information-acquiring apparatus according to claim 10, wherein the predicted waveform generator is configured to generate predicted waveform data in which each sampling point has the first value in either one of predetermined sections before and after a changing point of signal level, has the second value in the other one of the predetermined sections before and after the changing point of the signal level, and has a third value in sections other than the predetermined sections.

18. The time information-acquiring apparatus according to claim 10, wherein the predicted waveform generator is configured to generate plural predicted waveform data having waveforms indicating a predetermined code in the time code.

19. The time information-acquiring apparatus according to claim 10, wherein the controller is configured to detect a head position of a minute in the time code and to acquire codes included in the time code, based on a detected head position of a second and signal levels before and after a head position of the time code, to acquire values of codes comprising date, hour, and minute which form the time code based on values indicated by the codes, and to calculate a current time based on acquired values of the codes.

20. A radio wave timepiece comprising:

the time information-acquiring apparatus according to claim 19;

an internal timer configured to measure a current time using an internal clock;

a time corrector configured to correct the current time measured by the internal timer with the current time calculated by a controller of the time information-acquiring apparatus according to claim 19; and a display device configured to display the current time measured by the internal timer or corrected by the time corrector.

21. The time information-acquiring apparatus according to claim 1, further comprising:

a transmitting station determinator configured to determine a kind of transmitting station transmitting the standard time radio wave based on an accumulated value of the correlation values calculated by the correlation calculator, and wherein the comparator is configured to detect the optimal value of the accumulated value of the correlation values based on the kind of transmitting station determined by the transmitting station determinator.

22. The time information-acquiring apparatus according to claim 21, wherein the transmitting station determinator is configured to determine the kind of transmitting station based on a sum of a maximum value and a minimum value of the accumulated value.

23. The time information-acquiring apparatus according to claim 22, wherein the predicted waveform generator is configured to generate N predicted waveform data items P(p), a phase of each of the items being shifted by a predetermined number of samples, wherein N is a positive integer and p changes from 1 to N; and the transmitting station determinator is configured to add accumulated values Ca(q−n) to Ca(q+n) corresponding to sampling points adjacent to a position indicated by a maximum accumulated value Ca(q) in order to acquire an added maximum value, to add accumulated values Ca(r−n) to Ca(r+n) corresponding to sampling points adjacent to a position indicated by a minimum accumulated value Ca(r) in order to acquire an added minimum value, and to determine the kind of transmitting station based on a sum of the added maximum value and the added minimum value, wherein q and r are positive integers.

24. The time information-acquiring apparatus according to claim 21, wherein the transmitting station determinator is configured to determine the kind of transmitting station based on a difference between the minimum value and the maximum value of the accumulated value or a difference between the maximum value and the minimum value of the accumulated value.

25. The time information-acquiring apparatus according to claim 21, wherein each sampling point of the predicted waveform data generated by the predicted waveform generator has the first value in one of predetermined sections before and after a changing point of a signal level, has the second value in the other one of the predetermined sections before and after the changing point, and has a third value in sections other than the predetermined sections; and the transmitting station determinator is configured to determine a kind of transmitting station as a transmitting station transmitting a standard radio wave comprising a time code having a code with a waveform which rises at the head position of a second when the sum of the maximum value and the minimum value is a positive value.

26. The time information-acquiring apparatus according to claim 21, wherein the controller is configured to detect a head position of a minute in the time code and to acquire codes included in the time code, based on a detected head position of a second and signal levels before and after a head position of the time code, to acquire values of codes comprising date, hour, and minute which form the time code based on values indicated by the codes, and to calculate a current time based on the acquired values of the codes.

27. A radio wave timepiece comprising:

the time information-acquiring apparatus according to claim 26;

an internal timer configured to measure a current time using an internal clock;

a time corrector configured to correct the current time measured by the internal timer with the current time calculated by a controller of the time information-acquiring apparatus according to claim 26; and a display device configured to display the current time measured by the internal timer or corrected by the time corrector.

* * * * *